US012667769B2

(12) United States Patent
Didyk

(10) Patent No.: US 12,667,769 B2
(45) Date of Patent: Jun. 30, 2026

(54) DYNAMIC WORKSTATION APPARATUS, METHODS, AND SYSTEMS

(71) Applicant: William Didyk, Vancouver (CA)

(72) Inventor: William Didyk, Vancouver (CA)

( * ) Notice: Subject to any disclaimer, the term of this patent is extended or adjusted under 35 U.S.C. 154(b) by 0 days.

(21) Appl. No.: 18/709,482

(22) PCT Filed: Nov. 10, 2023

(86) PCT No.: PCT/CA2023/051508

§ 371 (c)(1),
(2) Date: May 10, 2024

(87) PCT Pub. No.: WO2024/098162

PCT Pub. Date: May 16, 2024

(65) Prior Publication Data

US 2025/0262507 A1 Aug. 21, 2025

Related U.S. Application Data

(60) Provisional application No. 63/424,848, filed on Nov. 11, 2022.

(51) Int. Cl.

| | |
|---|---|
| ***A63B 71/04*** | (2006.01) |
| ***A63B 21/00*** | (2006.01) |
| ***A63B 21/005*** | (2006.01) |

(52) U.S. Cl.

CPC ..... *A63B 71/04* (2013.01); *A63B 21/0058* (2013.01); *A63B 21/153* (2013.01); (Continued)

(58) Field of Classification Search

CPC ..... A63B 2225/093; A63B 21/4035; A47B 21/00–06

See application file for complete search history.

(56) References Cited

U.S. PATENT DOCUMENTS

| | | | |
|---|---|---|---|
| 2,844,428 | A | 7/1958 | Puntenney |
| 4,249,726 | A | 2/1981 | Faust |

(Continued)

FOREIGN PATENT DOCUMENTS

| | | | |
|---|---|---|---|
| CN | 106170321 | A | 11/2016 |
| CN | 111178472 | A | 5/2020 |

(Continued)

OTHER PUBLICATIONS

"Mount-It! Single Screen Dual-Pole Heavy-Duty Floor to Ceiling Mount." B & H Photo, Video, and Audio, Feb. 24, 2023, https://www.bhphotovideo.com/c/product/1744972-REG/mount_it_mi_20609_single_screen_dual_pole_heavy_duty_floor_to_ceiling.html?ap=y&smp=y&Isft=BI%3A514&gclid=CjwKCAiA3KefBhByEiwAi2LDHIgvqCeD1sjwpejnn9rs0Blb7tDIrW481eJ3xQ3yX076T5aPIBgT3xoCyyQQAvD_BwE. Online ad.

(Continued)

*Primary Examiner* — Joshua T Kennedy

(57) ABSTRACT

An apparatus comprising: a frame that is expandable in a generally vertical direction to obtain a press fit between a ceiling and a floor; a work surface that is attachable to the frame and selectively positionable at a plurality of different work surface heights between the ceiling and the floor when the frame is press fit between the ceiling and the floor, the plurality of different work surface heights including a ceiling height, a standing height, a seated height, and a floor height; and an actuator that is attachable to and operable with the frame to move the work surface within a range of movement including the plurality of different work surface heights while maintaining an orientation of the work surface relative to the frame. Related methods, systems, and kits also are disclosed.

15 Claims, 44 Drawing Sheets

(52) U.S. Cl.
CPC .... *A63B 21/4035* (2015.10); *A63B 2225/093* (2013.01); *A63B 2225/685* (2013.01)

(56) References Cited

U.S. PATENT DOCUMENTS 4,286,782 A 9/1981 Fuhrhop
5,048,826 A 9/1991 Ryan
5,190,510 A 3/1993 Goodger
5,257,701 A 11/1993 Edelson
5,323,695 A 6/1994 Borgman et al.
5,605,311 A 2/1997 McGrath et al.
5,687,654 A 11/1997 Huggins
5,813,947 A 9/1998 Densmore
5,823,921 A 10/1998 Dawson
5,989,164 A 11/1999 Kullman et al.
5,989,166 A 11/1999 Capizzo et al.
6,224,516 B1 * 5/2001 Disch ..... A63B 22/02 482/54
6,248,048 B1 6/2001 Zuckerman et al.
6,293,892 B1 9/2001 Slawinski et al.
6,558,299 B1 5/2003 Slattery
6,743,152 B2 6/2004 Weiss
6,893,381 B2 5/2005 Slawinski
6,926,649 B2 8/2005 Slawinski
7,001,314 B1 2/2006 Hummer, Jr.
7,169,097 B1 1/2007 Stearns
7,497,812 B2 * 3/2009 Neff ..... A63B 22/0694 482/8
7,677,678 B2 3/2010 Mosel et al.
7,892,148 B1 * 2/2011 Stauffer ..... A63B 22/0235 482/8
7,963,886 B1 6/2011 Schwinn et al.
8,337,370 B2 12/2012 Rogers et al.
8,485,945 B2 7/2013 Leonhard
8,870,720 B1 10/2014 Webber et al.
8,965,541 B2 2/2015 Martinez et al.
9,050,496 B2 6/2015 Towley, III et al.
9,167,894 B2 10/2015 DesRoches et al.
9,295,871 B2 3/2016 Luedeka
9,327,160 B2 5/2016 Tauriainen
9,403,048 B2 8/2016 Balandis et al.
9,486,070 B2 11/2016 Labrosse et al.
9,682,307 B2 6/2017 Dalebout
9,723,919 B1 8/2017 Randolph et al.
9,723,920 B1 8/2017 Wu
9,901,780 B2 2/2018 Deluca et al.
9,907,396 B1 3/2018 Labrosse et al.
9,925,403 B1 * 3/2018 Zarli ..... A47B 83/045
10,174,515 B1 1/2019 Krivens
10,258,150 B2 4/2019 Lin
10,575,630 B1 3/2020 Poniatowski
10,603,534 B2 3/2020 Taft et al.
10,661,114 B2 5/2020 Watterson et al.
10,827,829 B1 11/2020 Labrosse et al.
10,864,400 B2 12/2020 Schween
11,007,400 B1 5/2021 Stoddard et al.
11,911,649 B2 * 2/2024 Hull ..... A63B 21/4035
12,208,304 B2 * 1/2025 Akeel ..... A63B 21/00076
2002/0082145 A1 6/2002 Hamilton
2002/0142898 A1 * 10/2002 Willis ..... A63B 21/1609 482/904
2004/0092369 A1 5/2004 Slawinski et al.
2006/0035765 A1 2/2006 Smith
2006/0230992 A1 10/2006 Newhouse et al.
2007/0099773 A1 5/2007 Hummer
2008/0070759 A1 3/2008 Chaulk
2008/0096745 A1 4/2008 Perry
2008/0245279 A1 10/2008 Pan
2008/0289544 A1 11/2008 Buitmann et al.
2009/0062072 A1 * 3/2009 Packham ..... A63B 22/02 482/4
2011/0061574 A1 3/2011 Klinke
2011/0082013 A1 4/2011 Bastian
2013/0150214 A1 * 6/2013 Wu ..... A63B 21/4033 482/4
2014/0213414 A1 7/2014 Balandis et al.
2015/0165256 A1 6/2015 Salamon et al.
2016/0037909 A1 2/2016 Maas et al.
2017/0106235 A1 4/2017 Carter et al.
2018/0064994 A1 3/2018 Back et al.
2018/0117382 A1 5/2018 Johanson et al.
2019/0125073 A1 5/2019 Angelini et al.
2020/0188726 A1 6/2020 Carter et al.
2020/0367644 A1 11/2020 Laudadio et al.
2021/0046354 A1 2/2021 Oaks
2021/0339074 A1 * 11/2021 Hull ..... A63B 21/16
2021/0339079 A1 11/2021 Dalebout et al.
2021/0394011 A1 12/2021 Neuhaus et al.
2022/0062738 A1 3/2022 Neuhaus et al.
2022/0233907 A1 7/2022 Cobb
2022/0233908 A1 7/2022 Neuhaus et al.

FOREIGN PATENT DOCUMENTS

DE 3607365 A1 9/1987
DE 20118054 U 3/2003
EP 3363503 A1 8/2018
GB 1058187 A 2/1967
KR 20160088021 A 7/2016
KR 20220131756 A 9/2022
WO 1991007212 A1 5/1991
WO 9962375 A2 12/1999
WO 0024291 A1 5/2000
WO 2011156046 A2 12/2011
WO 2012177919 A2 12/2012
WO 2016141943 A1 9/2016
WO 2021223019 A1 11/2021

OTHER PUBLICATIONS

Exer Desk. (Oct. 1, 2022). Product Details Exer Desk.https://exer-desk.com/product/.
International Search Report and Written Opinion for International Patent No. PCT/CA2023/051508 mailed Feb. 14, 2024 (17 pages).

* cited by examiner

DYNAMIC WORKSTATION APPARATUS, METHODS, AND SYSTEMS

CROSS-REFERENCE TO RELATED APPLICATIONS

This application is a § 371 National Stage Entry of International Patent Application No. PCT/CA2023/051508, filed Nov. 10, 2023, claiming the benefit of priority of U.S. Provisional Patent Application No. 63/424,848, filed Nov. 11, 2022, the entireties of which are hereby incorporated by reference into this application.

TECHNICAL FIELD

Aspects of this disclosure relate generally to dynamic workstation apparatus, methods, systems, and kits. Some aspects comprise selectively moveable exercise grips and related structures.

BACKGROUND

The benefits of regular exercise for an office worker are well established. For example, regular changes of body position and movement are known to be healthier for the worker's muscles, joints, and circulation, in contrast with the detrimental health effects of sitting or standing at a workstation in fixed positions for an extended period of time.

Existing workstations are commonly adjustable between chair-seated and standing positions, but do not allow the office worker to work in a squatted position, while seated on the floor, or while hanging from an overhead structure. Different types of fitness equipment may permit these movements, but are typically located separately from the workstation, limiting the changes in body position the office worker may experience during the day.

Further improvements are required to improve the health of office workers by providing more frequent opportunities to work in different body positions and exercise regularly each day.

SUMMARY

Aspects of dynamic workstation apparatus, methods, systems, and kits are disclosed.

One aspect of this disclosure is an apparatus. For example, the apparatus may comprise: a frame that is expandable in a generally vertical direction to obtain a press fit between a ceiling and a floor; a work surface that is attachable to the frame and selectively positionable at a plurality of different work surface heights between the ceiling and the floor when the frame is press fit between the ceiling and the floor, the plurality of different work surface heights including a ceiling height, a standing height, a seated height, and a floor height; and an actuator that is attachable to and operable with the frame to move the work surface within a range of movement including the plurality of different work surface heights while maintaining an orientation of the work surface relative to the frame.

The frame may comprise posts that are independently expandable in the generally vertical direction to obtain the press fit. The posts may be independently expandable toward the floor. Each post may comprise a leveling mechanism that is expandable toward the floor. Each post may comprise a base plate with a plurality of leveling feet that are independently expandable toward the floor. Each post may comprise a base plate, a threaded bolt that is rotatably attached to the base plate, and a floor contact that is attached to the threaded bolt so that rotation of the threaded bolt relative to the base plate moves the floor contact toward the floor. The threaded bolt may be attached to the contact plate by a multiaxial connection so that the contact plate is adjustable relative to the floor. The frame may comprise a header that spans between the posts and is expandable in the generally vertical direction toward the ceiling to obtain the press fit.

The header may comprise a leveling mechanism that is expandable toward the ceiling. The header may comprise a plurality of jack screws that are independently expandable toward the floor. The header may comprise a top plate, a threaded shaft that is rotatably attached to the top plate, and a ceiling contact that is attached to the threaded shaft so that rotation of the threaded shaft relative to the top plate moves the ceiling contact toward the ceiling. The threaded shaft may be attached to the ceiling contact by a multiaxial connection so that the ceiling contact is adjustable relative to the ceiling. A portion of the actuator may be located in the header. The actuator may comprise an electric motor that is located in the header. The actuator may comprise a controller that is located in the header and electronically operable with the electric motor to move the work surface within the range of movement. The controller may be electronically operable with the electric motor responsive to one or more of a switch, a timer, a sensor, a program, and a mobile device.

The apparatus may comprise a lift system in the posts that is operable with the actuator to cause vertical movements of the work surface within the range of movement and stabilize the work surface during the vertical movements of the work surface. The apparatus may comprise a gear box in the header that is operable with the actuator and the lift system to cause the vertical movements of the work surface. The gear box may comprise a manual crank that is located outside the interior cavity of the header and operable with the lift system to cause the vertical movements of the work surface. The manual crank may be operable to cause the vertical movements of the work surface without electricity.

The apparatus may comprise a lift system operable with an input torque applied by the actuator to cause the vertical movements of the work surface. The lift system may comprise a threaded rod that is rotatably mounted and vertically fixed in a first post of the posts. The lift system may comprise a first actuator member in the first post that is operably attached to the threaded rod and the work surface so that rotation of the threaded rod causes the vertical movements of the work surface. The apparatus may comprise a first actuator member comprising threads that are operable with corresponding threads of the threaded rod to cause the vertical movements of the work surface when the threaded rod is rotated, stabilize the work surface during the vertical movements within the range of movement, and maintain a vertical position of the work surface when the threaded rod is not rotated.

The apparatus may comprise a first post comprising a first elongated opening and a portion of the first actuator member may extend through the elongated opening to vertically support the work surface. The first actuator member may comprise a plurality of wheels that act on the interior surfaces of the first post to stabilize the work surface during the vertical movements of the work surface. The first actuator member may be operable to position the plurality of wheels against the interior surfaces of the first post. The lift system may comprise: a guide rod that is rotatably and vertically fixed in a second post of the posts; and a second actuator member in the second post that is operably attached to the first actuator member, the guide rod, and the work surface so that rotation of the threaded rod causes the vertical movements of the work surface. Rotation of the threaded rod may cause the first actuator member to move together with the second actuator member in the generally vertical direction to maintain a generally level orientation of the work surface during the vertical movements of the work surface. The threads of the first actuator member may be operable with the corresponding threads of the threaded rod to cause the vertical movements of the work surface when the threaded rod is rotated, stabilize the work surface during the vertical movements within the range of movement, and maintain the vertical position of the work surface when the threaded rod is not rotated.

The second post may comprise a second elongated opening and a portion of the second actuator member extends through the second elongated opening to vertically support the work surface. The second actuator member may comprise a second plurality of wheels that act on interior surfaces of the second post to stabilize the second side of the work surface during the vertical movements within the range of movement. The second actuator member may be operable to position the second plurality of wheels against the interior surfaces of the second post. The lift system may comprise a cable that is operatively attached to the first actuator member and the second actuator member so that rotation of the threaded rod causes the first actuator member to move vertically with the second actuator member.

The cable may be routed through the first post, into the header, and into the second post. The cable may comprise: a first cable length extending downwardly from the first actuator member to a pulley located below the threaded rod; a second cable length extending upwardly from the first pulley to a first roller located above the threaded rod; a third cable length extending generally horizontally from the second pulley to a second roller located above the guide rod; and a fourth cable length extending downwardly from the second roller to the second actuator member. The first cable length, the pulley, and the second cable length may be located in the first post. The first roller, the third cable length, and the second roller may be located in the header. The fourth cable length may be located in the second post. The pulley may be attached to a first base plate that vertically supports the threaded rod.

The work surface may be operable with the frame to support a weight of a user at each height of the plurality of different work surface heights. The work surface may comprise an exercise grip that is operable to support the weight of the user. The exercise grip may be selectively movable: together with the work surface in the generally vertical direction between the plurality of different heights, and independent of the work surface in a generally horizontal direction between a plurality of different grip positions including a working position where the exercise grip is spaced apart from the desk and operable to support a weight of a user and a stored position where the exercise grip is adjacent the desk frame. An underside of the work surface may comprise a plurality of tubes operable to support the weight of the user. The exercise grip may be receivable in a tube of the plurality of tubes. The exercise grip may comprise a U-shape with a pair of grip shafts that are receivable in two tubes of the plurality of tubes.

The frame may comprise an equipment support that is operable with the frame to position a piece of exercise equipment at a plurality of different equipment support heights relative to the frame when the frame is press fit between the ceiling and the floor. The plurality of different equipment support heights may comprise an equipment ceiling height, an equipment standing height, an equipment seated height, and an equipment floor height. The apparatus may comprise the piece of exercise equipment. The piece of exercise equipment may comprise a plurality of exercise grips operable to support a weight of a user. The plurality of exercise grips may comprise one or more of: a pull-up bar; a plurality of monkey bars; and a plurality of finger grips. The piece of exercise equipment may be removably attached to the frame at each height of the plurality of different equipment support heights. The frame may comprise pegs and the piece of exercise equipment may be removably attachable to the pegs.

The apparatus may comprise a second actuator that is attachable to and operable with the frame to move the equipment support within a second range of movement including the plurality of different equipment support heights while maintaining an orientation of the equipment support relative to the frame. The second actuator may comprise a second electric motor. The second actuator may comprise a second controller that is electronically operable with the second electric motor to move the equipment support within the second range of movement. The second controller may be electronically operable with the second electric motor responsive to one or more of a second switch, a second timer, a second sensor, a second program, and a second mobile device.

The apparatus may comprise a second lift system in the posts that is operable with the second actuator to cause vertical movements of the equipment support within the second range of movement and stabilize the equipment support during the vertical movements of the equipment support. The second lift system may comprise a second threaded rod that is rotatably mounted and vertically fixed in the first post of the posts. A third actuator member in the first post may be operably attached to the second threaded rod and the equipment support so that rotation of the threaded rod causes the vertical movements of the work surface. The third actuator member may comprise threads that are operable with corresponding threads of the second threaded rod to cause the vertical movements of the equipment support when the second threaded rod is rotated, stabilize the equipment support during the vertical movements within the second range of movement, and maintain a vertical position of the equipment support when the second threaded rod is not rotated.

The second lift system may comprise a third threaded rod that is rotatably mounted and vertically fixed in the second post of the posts. A fourth actuator member in the second post may be operably attached to the third threaded rod and the equipment support so that rotation of the third threaded rod causes the vertical movements of the equipment support. The fourth actuator member may comprise threads that are operable with corresponding threads of the third threaded rod to cause the vertical movements of the equipment support when the third threaded rod is rotated, stabilize the equipment support during the vertical movements within the second range of movement, and maintain the vertical position of the equipment support when the third threaded rod is not rotated.

The first post may comprise a third elongated opening and a portion of the third actuator member extends through the third elongated opening to vertically support the equipment support. The second post may comprise a fourth elongated opening and a portion of the fourth actuator member extends through the fourth elongated opening to vertically support the equipment support. The third actuator member may comprise a third plurality of wheels that act on the interior surfaces of the first post to stabilize the equipment support during the vertical movements of the equipment support. The fourth actuator member may comprise a fourth plurality of wheels that act on the interior surfaces of the second post to stabilize the equipment support during the vertical movements of the equipment support. The third actuator member may be operable to position the third plurality of wheels against the interior surfaces of the first post. The fourth actuator member may be operable to position the fourth plurality of wheels against the interior surfaces of the second post. The second actuator may be operable to rotate the second threaded rod and the third threaded rod to at the same time to cause the vertical movements of the equipment support. The first lift system and the second lift system are independently operable.

Another aspect of this disclosure is an apparatus. For example, the apparatus may comprise: a frame; a work surface that is attachable to the frame and selectively positionable at a plurality of different work surface heights relative to the frame; and an actuator that is attachable to and operable with the frame to move the work surface within a range of movement including the plurality of different work surface heights while maintaining an orientation of the work surface relative to the frame, wherein the work surface comprises an exercise grip that is operable to support a weight of a user at each height of the plurality of different work surface heights.

The exercise grip may be selectively movable together with the work surface in a generally vertical direction between the plurality of different heights. The exercise grip is selectively movable independent of the work surface between a plurality of different grip positions including: a working position where the exercise grip is spaced apart from the work surface and operable to support the weight of the user; and a stored position where the exercise grip is adjacent the work surface. The exercise grip may be moveable in a generally horizontal direction between the plurality of different grip positions. An underside of the work surface may comprise a plurality of tubes operable to support the weight of the user. The exercise grip may be receivable in a tube of the plurality of tubes. The exercise grip may comprise a U-shape with a pair of grip shafts that are receivable in two tubes of the plurality of tubes. The exercise grip may be moveable in a generally lateral direction between the posts by removing the pair of grip shafts from a first set of two tubes of the plurality of tubes and receiving the pair of grip shafts in a second set of two tubes of the plurality of tubes. The apparatus may comprise a second the exercise grip is receivable in a second tube of the plurality of tubes. The second exercise grip may comprise a second U-shape with a second pair of grip shafts that are receivable in two different tubes of the plurality of tubes.

The frame may be free standing on the floor. The frame may comprise posts that are independently expandable in the generally vertical direction to obtain a press fit between a ceiling and a floor. The frame may comprise a header that spans between the posts and is expandable in the generally vertical direction toward the ceiling to obtain the press fit. A portion of the actuator may be located in the header. The apparatus may comprise a lift system in the posts that is operable with the actuator to cause vertical movements of the work surface within the range of movement and stabilize the work surface during the vertical movements of the work surface. The lift system may comprise a threaded rod that is rotatably mounted and vertically fixed in a first post of the posts. The lift system may comprise a first actuator member in the first post that is operably attached to the threaded rod and the work surface so that rotation of the threaded rod causes the vertical movements of the work surface. The first actuator member may comprise threads that are operable with corresponding threads of the threaded rod to cause the vertical movements of the work surface when the threaded rod is rotated, stabilize the work surface during the vertical movements within the range of movement, and maintain a vertical position of the work surface when the threaded rod is not rotated.

The first post may comprise a first elongated opening and a portion of the first actuator member extends through the elongated opening to vertically support the work surface. The first actuator member may comprise a plurality of wheels that act on the interior surfaces of the first post to stabilize the work surface during the vertical movements of the work surface. The first actuator member may be operable to position the plurality of wheels against the interior surfaces of the first post. The lift system may comprise: a guide rod that is rotatably and vertically fixed in a second post of the posts; and a second actuator member in the second post that is operably attached to the first actuator member, the guide rod, and the work surface so that rotation of the threaded rod causes the vertical movements of the work surface. Rotation of the threaded rod may cause the first actuator member to move together with the second actuator member in the generally vertical direction to maintain a generally level orientation of the work surface during the vertical movements of the work surface.

The threads of the first actuator member may be operable with the corresponding threads of the threaded rod to cause the vertical movements of the work surface when the threaded rod is rotated, stabilize the work surface during the vertical movements within the range of movement, and maintain the vertical position of the work surface when the threaded rod is not rotated. The second post may comprise a second elongated opening and a portion of the second actuator member extends through the second elongated opening to vertically support the work surface. The second actuator member may comprise a second plurality of wheels that act on interior surfaces of the second post to stabilize the second side of the work surface during the vertical movements within the range of movement. The second actuator member may be operable to position the second plurality of wheels against the interior surfaces of the second post.

The lift system may comprise a cable that is operatively attached to the first actuator member and the second actuator member so that rotation of the threaded rod causes the first actuator member to move vertically with the second actuator member. The frame may comprise an equipment support that is operable with the frame to position a piece of exercise equipment at a plurality of different equipment support heights relative to the frame when the frame is press fit between the ceiling and the floor. The plurality of different equipment support heights may comprise an equipment ceiling height, an equipment standing height, an equipment seated height, and an equipment floor height. The apparatus may comprise the piece of exercise equipment. The piece of exercise equipment may be removably attached to the frame at each height of the plurality of different equipment support heights.

The apparatus may comprise a second actuator that is attachable to and operable with the frame to move the equipment support within a second range of movement including the plurality of different equipment support heights while maintaining an orientation of the equipment support relative to the frame. The apparatus may comprise a second lift system in the posts that is operable with the second actuator to cause vertical movements of the equipment support within the second range of movement and stabilize the equipment support during the vertical movements of the equipment support. The second lift system may comprise a second threaded rod that is rotatably mounted and vertically fixed in the first post of the posts. The apparatus may comprise a third actuator member in the first post that is operably attached to the second threaded rod and the equipment support so that rotation of the threaded rod causes the vertical movements of the work surface. The third actuator member may comprise threads that are operable with corresponding threads of the second threaded rod to cause the vertical movements of the equipment support when the second threaded rod is rotated, stabilize the equipment support during the vertical movements within the second range of movement, and maintain a vertical position of the equipment support when the second threaded rod is not rotated.

The second lift system may comprise a third threaded rod that is rotatably mounted and vertically fixed in the second post of the posts. The apparatus may comprise a fourth actuator member in the second post that is operably attached to the third threaded rod and the equipment support so that rotation of the third threaded rod causes the vertical movements of the equipment support. The fourth actuator member may comprise threads that are operable with corresponding threads of the third threaded rod to cause the vertical movements of the equipment support when the third threaded rod is rotated, stabilize the equipment support during the vertical movements within the second range of movement, and maintain the vertical position of the equipment support when the third threaded rod is not rotated. The first post may comprise a third elongated opening and a portion of the third actuator member extends through the third elongated opening to vertically support the equipment support. The second post may comprise a fourth elongated opening and a portion of the fourth actuator member may extend through the fourth elongated opening to vertically support the equipment support.

The third actuator member may comprise a third plurality of wheels that act on the interior surfaces of the first post to stabilize the equipment support during the vertical movements of the equipment support. The fourth actuator member may comprise a fourth plurality of wheels that act on the interior surfaces of the second post to stabilize the equipment support during the vertical movements of the equipment support. The third actuator member may be operable to position the third plurality of wheels against the interior surfaces of the first post. The fourth actuator member may be operable to position the fourth plurality of wheels against the interior surfaces of the second post. The second actuator may be operable to rotate the second threaded rod and the third threaded rod to at the same time to cause the vertical movements of the equipment support. The first lift system and the second lift system may be independently operable.

Another aspect of this disclosure is an apparatus. For example, the apparatus may comprise a frame that is expandable in a generally vertical direction to obtain a press fit between a ceiling and a floor; and a work surface that is attachable to the frame and selectively positionable at a plurality of different work surface heights between the ceiling and the floor when the frame is press fit between the ceiling and the floor, the plurality of different work surface heights including at least a seated height and a standing height.

Another aspect of this disclosure is an apparatus. For example, the apparatus may comprise: a frame; a work surface that is attachable to the frame and selectively positionable at a plurality of different work surface heights; and an actuator that is attachable to and electronically or manually operable with the frame to move the work surface between the plurality of different work surface heights while maintaining an orientation of the work surface relative to the frame.

Another aspect of this disclosure is an apparatus. For example, the apparatus may comprise: a frame that comprising an upper portion attachable to an upper support structure and a lower portion attachable to a lower support structure; a work surface that is attachable to the frame and selectively positionable at a plurality of different work surface heights between the upper support structure and the lower support structure; and an actuator that is attachable to and operable with the frame to move the work surface within a range of movement including the plurality of different work surface heights while maintaining an orientation of the work surface relative to the frame.

The upper support structure may comprise a first portion of a building and the lower support structure may comprise a second portion of the building. The upper support structure may comprise one of: a door frame; a window frame; and a wall. The lower support structure my comprise a floor.

Another aspect of this disclosure is an apparatus. For example, the apparatus may comprise: a door or window frame; and a work surface that is attachable to the door or window frame and selectively positionable at a plurality of different work surface heights, the plurality of different work surface heights including at least a seated height and a standing height.

Another aspect of this disclosure is an apparatus. For example, the apparatus may comprise: a door or window frame; and an equipment support that is attachable to the door or window frame and selectively positionable at a plurality of different equipment support heights.

Another aspect of this disclosure is an apparatus. For example, the apparatus may comprise a work surface that is attachable to a door frame, a window frame, or a wall and selectively positionable at a plurality of different work surface heights relative to the door frame, the window frame, or the wall.

Another aspect of this disclosure is an apparatus. For example, the apparatus may comprise an equipment support that is attachable to a door frame, a window frame, or a wall and selectively positionable at a plurality of different equipment support heights relative to the door frame, the window frame, or the wall.

Any apparatus described herein may comprise a resistance training system that is located in the work surface and operable at each height of the plurality of different work surface heights. The resistance training system may comprise one or more of: an exercise grip; and a resistance device that is attached to the work surface operable to apply a resistance force to the exercise grip when moved away from the work surface. The resistance device may comprise a cable and work surface may comprise an internal frame that is attachable to the frame, the resistance device is rigidly attached to the internal frame, and the cable is operatively attached to exercise grip and the resistance device. The cable may be removably attached to the exercise grip. The resistance device may comprise an electronic motor that is operable to apply the resistance force. The electronic motor may comprise a spool, the spool may be operatively attached to the cable, and the electronic motor may apply the resistance force by rotating the spool. The internal frame may comprise a tube defining a lumen and the cable may be routed from the spool and through the lumen.

The apparatus may comprise a cable guide defining a cable guide lumen. The cable guide may be slidably mounted in the tube. The cable may be routed through the cable guide lumen. The cable guide is slidable between a first position where the cable exits the cable guide lumen at a first location spaced apart from the internal frame and a second position where the cable exits the cable guide lumen at a second location adjacent the frame. The exercise grip may comprise one of a palm grip and a bar. The apparats may comprise a track that is attached to the frame; and a support structure that is moveably attachable to the track and operable to maintain a vertical position of the exercise grip by countering the resistance force.

The track may comprise a front surface comprising an elongated opening and a rear surface comprising a plurality of holes; and the support structure may comprise a hook portion extending through the elongated opening and a protrusion that is receivable in one hole of the plurality of holes and operable to resist counter the resistance force when received in the one hole. The support structure may comprise an L-shaped body with a vertical leg, a horizontal leg, and wheels on the vertical leg. The hook portion may be located on the horizontal leg. The hook portion may comprise one or both of: a first J-hook operable to counter the resistance force when the work surface is at the ceiling height; and a second J-hook operable to counter the resistance force when the work surface is at the floor height.

Any apparatus described herein may comprise a mounting arm that is moveably attached to the frame and operable to support a piece of electronic equipment. The piece of electronic equipment may comprise one of: a camera; a light; a microphone; a monitor; a motion sensor; and a script prompter.

Any apparatus described herein may comprise a retractable computer system that is removably attached to a computer and moveable between: a working position where a monitor of the computer is visible to a user; and a stored position where the monitor is contained in the work surface. The work surface may comprise a monitor cavity and the monitor may be folded into the monitor cavity when the retractable computer system is moved into the stored position. The work surface may comprise a keyboard cavity and a keyboard of the computer may be stowable in the keyboard cavity when the retractable computer system is moved into the stored position. The work surface may comprise a peripheral cavity and a mouse of the computer is stowable in the peripheral cavity when the retractable computer system is moved into the stored position. The retractable computer system may comprise a monitor stand that is foldable between: a first position operable to support the monitor in the working position; and a second position operable to cover the plurality of cavities.

Any apparatus described herein may comprise a side support that is extendable from the work surface and operable to support one or both of a side table and a weight of the user.

Another aspect of this disclosure is an apparatus. For example, the apparatus may comprise a frame, a work surface that is attachable to the frame, and a resistance training system that is located in the work surface. The frame may be expandable in a generally vertical direction to obtain a press fit between a ceiling and a floor. The work surface may be attachable to the frame and selectively positionable at a plurality of different work surface heights between the ceiling and the floor when the frame is press fit between the ceiling and the floor. The plurality of different work surface heights may include a ceiling height, a standing height, a seated height, and a floor height. The actuator may be attachable to and operable with the frame to move the work surface within a range of movement including the plurality of different work surface heights while maintaining an orientation of the work surface relative to the frame. The frame may comprise posts that are independently expandable in the generally vertical direction to obtain the press fit.

The apparatus may comprise a lift system in the posts that is operable with the actuator to cause vertical movements of the work surface within the range of movement and stabilize the work surface during the vertical movements of the work surface. The lift system may comprise a threaded rod that is rotatably mounted and vertically fixed in a first post of the posts. The lift system may comprise a first actuator member in the first post that is operably attached to the threaded rod and the work surface so that rotation of the threaded rod causes the vertical movements of the work surface. The work surface may be operable with the frame to support a weight of a user at each height of the plurality of different work surface heights.

The resistance training system comprises an exercise grip that is selectively movable together with the work surface in the generally vertical direction between the plurality of work surface different heights, and independent of the work surface in a generally horizontal direction between a plurality of different grip positions including a working position where the exercise grip is spaced apart from the desk and a stored position where the exercise grip is adjacent the desk frame. The resistance training system may comprise a resistance device that is attached to the work surface and operable to apply a resistance force to the exercise grip when moved away from the work surface. The resistance training system comprises a cable. The work surface may comprise an internal frame that is attachable to the frame. The resistance device may be rigidly attached to the internal frame. And the cable may be operatively attached to exercise grip and the resistance device. The cable may be removably attached to the exercise grip. The resistance device may comprise an electronic motor that is operable to apply the resistance force.

The electronic motor may comprise a spool. The spool may be operatively attached to the cable. And the electronic motor may apply the resistance force by rotating the spool. The internal frame may comprise a tube defining a lumen and the cable may be routed from the spool and through the lumen. The apparatus may comprise a cable guide defining a cable guide lumen, wherein the cable guide is slidably mounted in the tube, the cable is routed through the cable guide lumen, and the cable guide is slidable between a first position where the cable exits the cable guide lumen at a first location spaced apart from the internal frame and a second position where the cable exits the cable guide lumen at a second location adjacent the frame. The exercise grip may comprise one of a palm grip and a bar.

The apparatus may comprise a track that is attached to the frame and a support structure that is moveably attachable to the track and operable to maintain a vertical position of the exercise grip by countering the resistance force. The track may comprise a front surface comprising an elongated opening and a rear surface comprising a plurality of holes. The support structure may comprise a hook portion extending through the elongated opening and a protrusion that is receivable in one hole of the plurality of holes and operable to resist counter the resistance force when received in the one hole. The support structure may comprise an L-shaped body with a vertical leg, a horizontal leg, and wheels on the vertical leg. The hook portion may be located on the horizontal leg. The hook portion may comprise one or both of: a first J-hook operable to counter the resistance force when the work surface is at the ceiling height; and a second J-hook operable to counter the resistance force when the work surface is at the floor height.

For any apparatus described herein, one or both of the first J-hook and the second J-hook may comprise a clamping mechanism operable to secure the exercise grip to the support structure so that apparatus may be operable like a Smith machine.

Related apparatus, methods, systems, and kits also are disclosed, each possible combination and variation thereof being part of this disclosure.

BRIEF DESCRIPTION OF THE DRAWINGS

The accompanying drawings, which are incorporated in and constitute part of this disclosure, illustrate exemplary aspects that, together with the written descriptions, serve to explain the principles of this disclosure. Numerous aspects are shown conceptually in the drawings and particularly described, pointed out, and taught in the written descriptions. Some structural and operational aspects may be better understood by referencing the written portions together with the accompanying drawings, of which.

Figure 1:
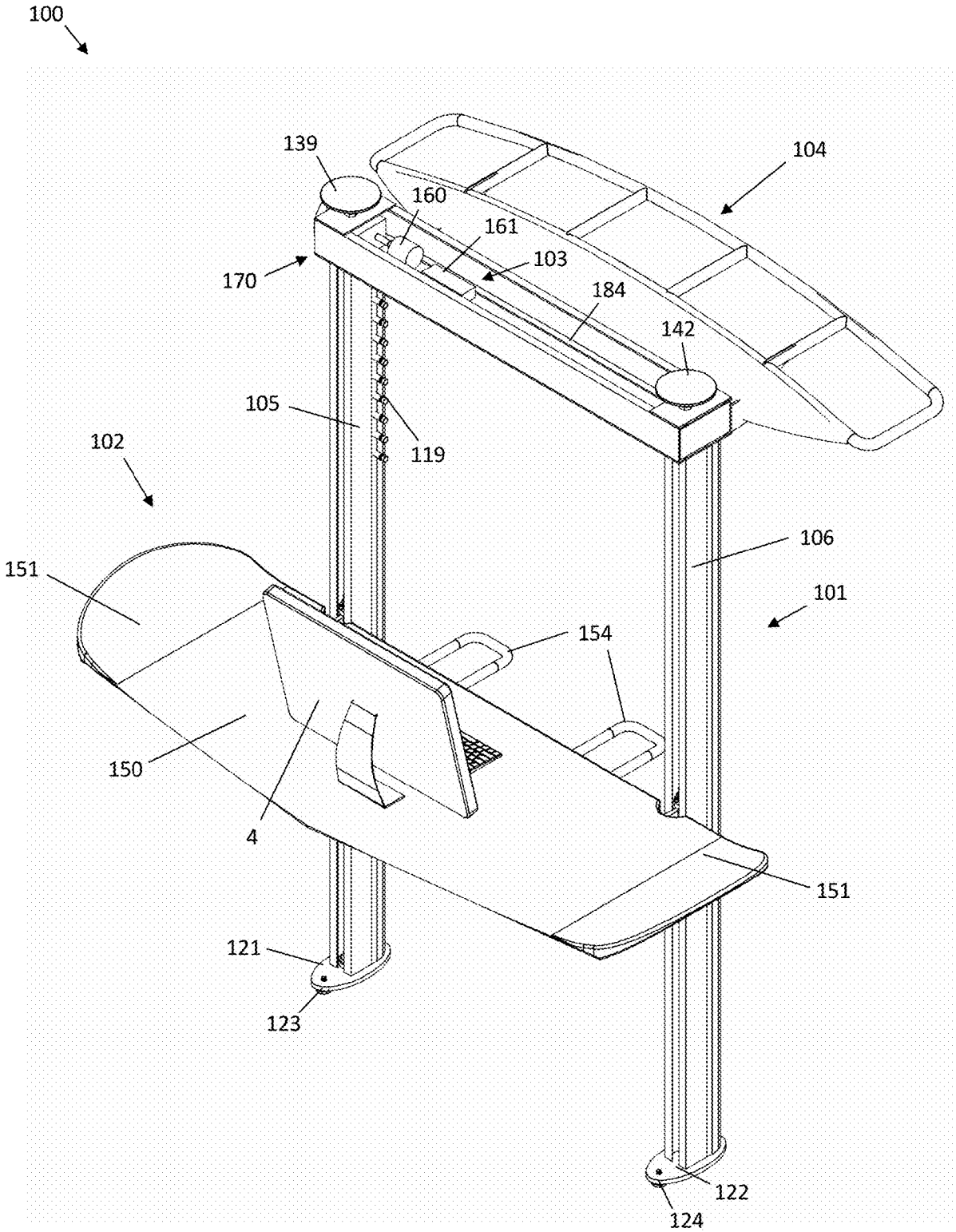
FIG. 1 depicts a perspective view of an exemplary workstation with a frame and a work surface that is selectively movable relative to the frame between a plurality of different work surface heights.

Aspects of the examples illustrated in the drawings may be explained further by way of citations to the drawing and element numbers in the text of the description. The drawings and any citations thereto are provided for illustration purposes, and to further clarify the description of the present disclosure and are not intended to limit the present disclosure unless claimed.

DETAILED DESCRIPTION

Aspects of the present disclosure are not limited to the exemplary structural details and component arrangements described in this description and shown in the accompanying drawings. Many aspects of this disclosure may be applicable to other aspects and/or capable of being practiced or carried out in various variants of use, including the examples described herein.

Throughout the written descriptions, specific details are set forth to provide a more thorough understanding to persons of ordinary skill in the art. For convenience and ease of description, some well-known elements may be described conceptually to avoid unnecessarily obscuring the focus of this disclosure. In this regard, the written descriptions and accompanying drawings should be interpreted as illustrative rather than restrictive, enabling rather than limiting.

Exemplary aspects of this disclosure reference dynamic workstation apparatus, methods, systems, and kits are disclosed. Some aspects are described with reference to particular elements (e.g., a work surface) moveable relative to other elements (e.g., a frame) utilizing particular mechanisms (e.g., an actuator) operable to cause particular movements (e.g., moving the work surface vertically relative to the frame) with particular movement characteristics (e.g., between a standing position and a floor position). Unless claimed, these descriptions are provided for convenience and not intended to limit this disclosure. Accordingly, any aspects described in this disclosure with reference to these particular examples may be similarly utilized with any comparable apparatus, methods, systems, and kits.

Several exemplary reference axes are described, including a lateral axis X-X, a longitudinal axis Y-Y, and a vertical axis Z-Z. Some elements and/or movements thereof are described relative to these axes, such as a first or upward movement direction D1 and a second or downward movement path D2. For example, lateral axis X-X and longitudinal axis Y-Y may define a horizontal working plane, and various elements may be movable along or about vertical axis Z-Z in directions toward and away from the plane. As a further example, some objects may be described as "elongated," meaning that they have a length greater than a width along a reference axis. Additional movements and forces are similarly described. These relative terms are provided for convenience and do not limit this disclosure unless claimed.

Inclusive terms such as "comprises," "comprising," "includes," "including," and variations thereof, are intended to cover a non-exclusive inclusion, such that any motion isolation apparatus, methods, systems, and kits described herein, or element(s) thereof described as comprising a list of elements does not include only those elements but may include other elements not expressly listed and/or inherent thereto. Unless stated otherwise, the term "exemplary" means "example" rather than "ideal." Various terms of approximation may be used, including "approximately" and "generally." Approximately means "roughly" or within 10% of a stated number or outcome and generally means "usually" or more than a 50% probability of a stated number or outcome.

Connective terms such as "attached to," "attachable to," and "attaching" are intended to generically describe a structural connection between two or more elements. Some structural connections may be "rigidly attached" so that the connected elements are generally non-rotatable relative to one another, as when the elements are formed together (e.g., cast, bolted, and/or welded) and cannot be rotated independently without deflecting relative to one another or being damaged. Other structural connections may be "rotatably or movably attached" so that the connected elements are coupled together to permit movements relative to one another, as when the elements are pinned together (e.g., with any type of rotating, sliding, and/or telescoping connection) and can be rotated or moved freely and independently without damage. Unless stated otherwise, these exemplary connective terms and their modifiers may comprise any such variations.

Aspects of any exemplary computing device are described. Functional terms such as "processing," "computing," "calculating," "determining," "displaying," and the like, may refer to actions and processes performable by the computing, which may comprise any type of software and/or hardware. The software of the computing device may comprise program objects (e.g., lines of codes) executable to perform various functions. Each program object may comprise a sequence of operations leading to a desired result, such as an algorithm. The operations may require or involve physical manipulations of physical quantities, such as electrical or magnetic signals capable of being stored, transferred, combined, compared, and otherwise manipulated. The signals may be described conceptually as bits, characters, elements, numbers, symbols, terms, values, or the like.

The hardware of the computing device also may comprise any known technologies for storing the program objects and any data associated therewith. For example, the program objects may be stored in any machine (e.g., computer) readable storage medium in communication with the processing unit, including any mechanism for storing or transmitting data and information in a form readable by a machine (e.g., a computer). Exemplary storage mediums may comprise read only memory ("ROM"); random access memory ("RAM"); erasable programmable ROMs ("EPROMs"); electrically erasable programmable ROMs ("EEPROMs"); magnetic or optical cards or disks; flash memory devices; and/or any electrical, optical, acoustical, or other form of propagated signals (e.g., carrier waves, infrared signals, digital signals, etc.).

In keeping with above, the computing device may comprise a smartphone or similar device, such as iPhone or other iOS device, an Android phone or other Android device, or any comparable and/or compatible devices operable as the computing device described herein.

Some aspects of the present disclosure are described with reference to methods, steps of which may be performable with the computing device. To help orient the reader, some methods may be described with reference to a conceptual drawing, such as a flowchart with boxes interconnected by arrows. Each box may represent a particular step or technology. The boxes may be combined, interconnected, and/or interchanged to provide options for additional modifications according to this disclosure. The arrows may define an exemplary sequence of operation for the steps, the order of which may be important. For example, a particular order of the steps may describe a sequence of operation that is performable by the computing element to realize specific processing benefits, such as improving a computational performance and/or an operational efficiency.

Figure 2:
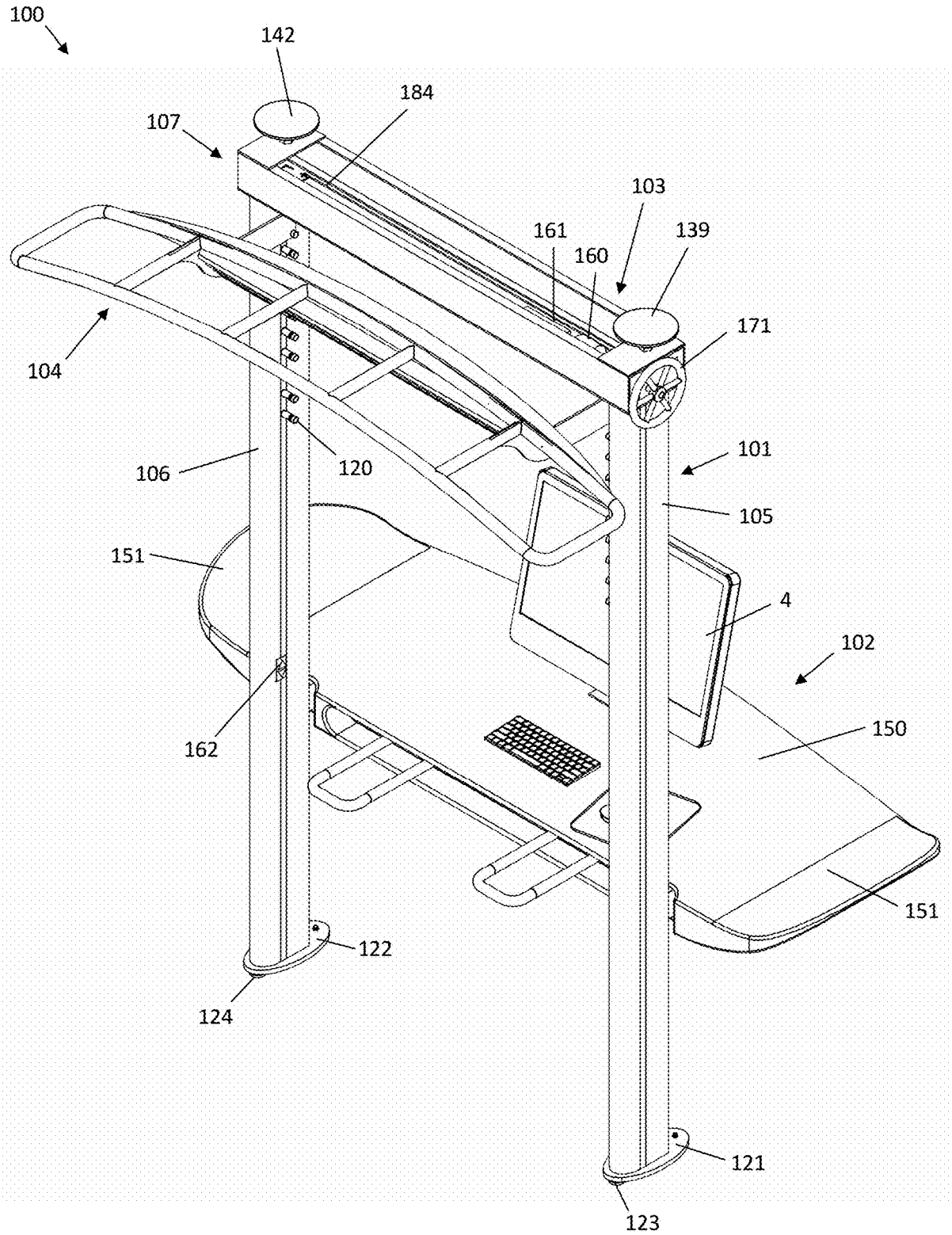
FIG. 2 depicts an opposite-facing perspective view of the FIG. 1 workstation.

Aspects of this disclosure are now described with reference to exemplary workstation 100. As shown in FIG. 1, for example, workstation 100 may comprise a work surface that is adjustable between an extended range of positions including a floor height, a seated height, a standing height, and a ceiling height. Workstation 100 may comprise overhead elements that are positioned to enable various types of fitness enhancing activities, such as hanging by the hands. Some of the elements may be moveable to different heights, allowing for customization. As shown in FIGS. 1 and 2, for example, workstation 100 may comprise a frame 101, a work surface 102, an actuator 103, and an overhead element 104, aspects of which are now described in detail.

Frame 101 may comprise a rigid configuration of structural shapes operable to support work surface 102, actuator 103, overhead element 104, and transfer any forces applied therewith and/or therewith to a supporting structure, such as a building. Aspects of frame 101 may be expandable in a generally vertical direction to obtain a press fit between an upper supporting structure such as a ceiling 2 and a lower supporting structure such as a floor 3 to reduce a footprint of workstation 100. As described further below, frame 101 may comprise or be integrated into a door frame, a window frame, and/or a wall, such that ceiling 2 and floor 3 are exemplary supporting structures provided to facilitate understanding of this disclosure and not limiting unless claimed as such.

Figure 3:
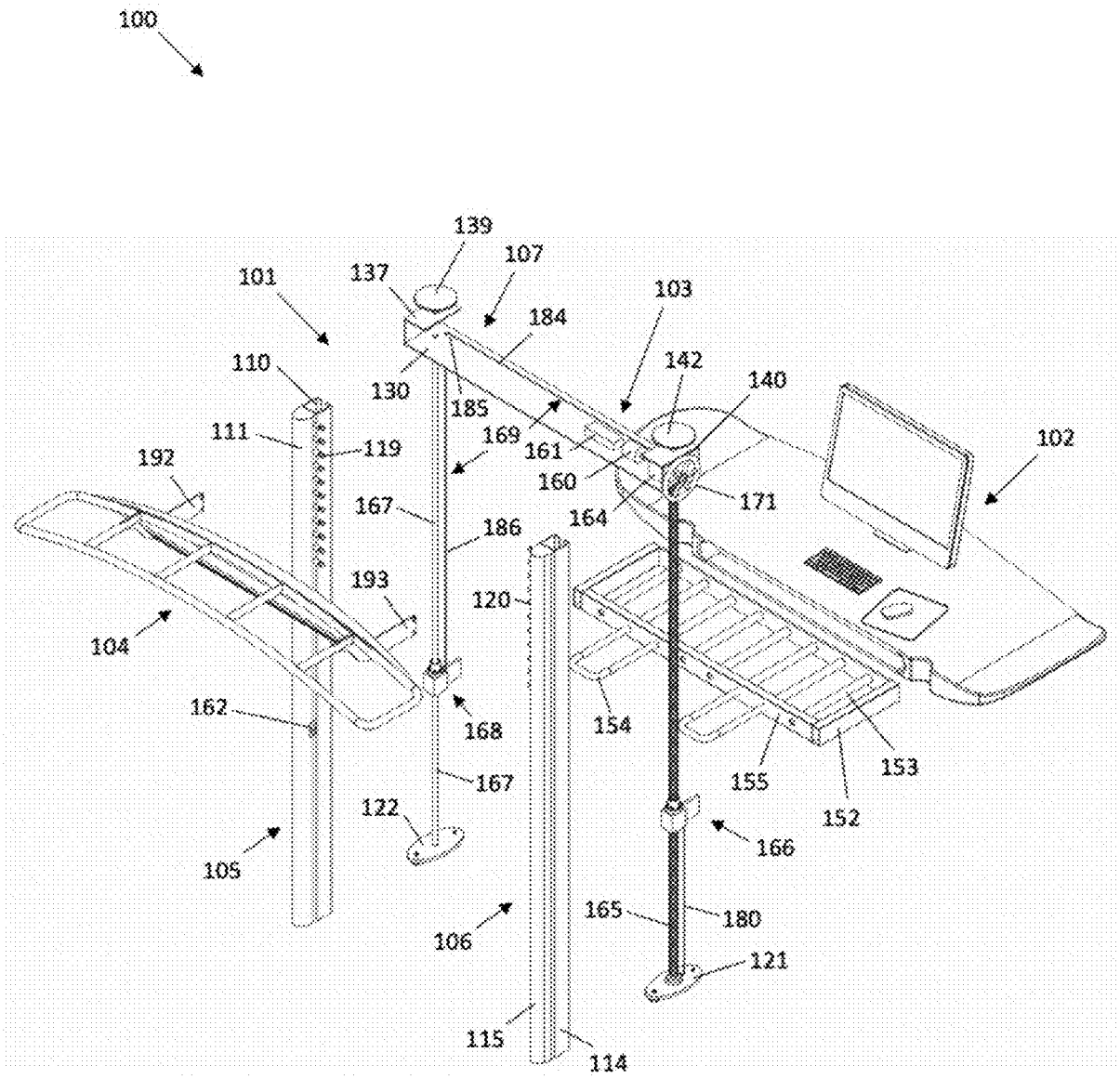
FIG. 3 depicts an exploded perspective view of the FIG. 1 workstation.
Figure 7:
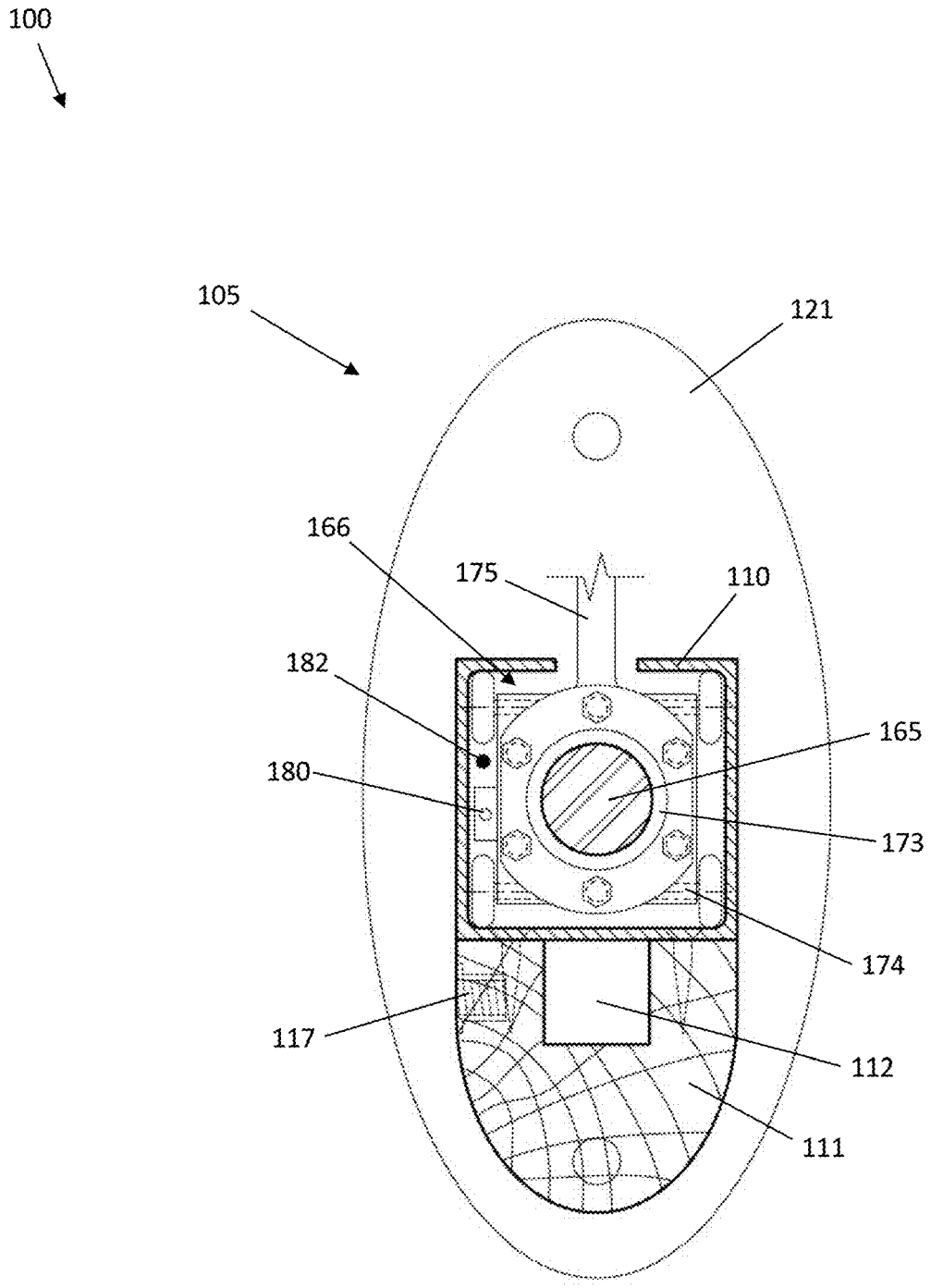
FIG. 7 depicts a top-down section view of a post of the FIG. 4 frame.
Figure 8:
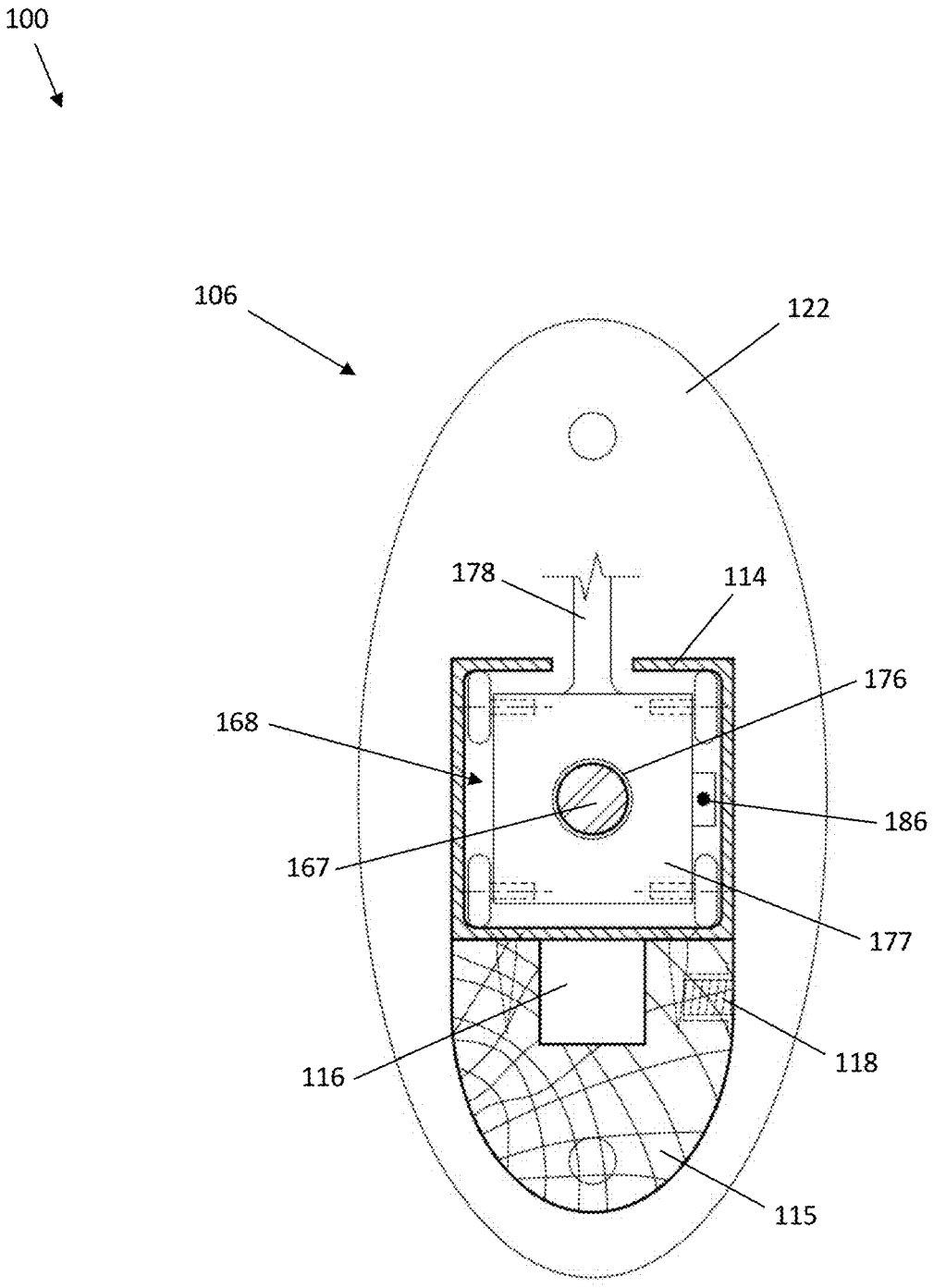
FIG. 8 depicts a top-down section view of another post of the FIG. 4 frame.

Frame 101 may comprise structural elements that are independently expandable upwards and/or downwards in the generally vertical direction to obtain the press fit. As shown in FIG. 3, for example, frame 101 may comprise a post 105, a post 106, and a header 107. As shown in FIG. 7, for example, post 105 may be a composite structure comprising a tube 110, a cladding element 111, and interior channel 112. As shown in FIG. 8, for example, post 106 may be a composite structure comprising a tube 114, a cladding element 115, and interior channel 116. Each tubes 110, 114 may be a structural shape, such as a 3"×3"×⅛" aluminum tube made of an aluminum alloy such as AA 6063. Cladding elements 111, 115 may be wooden structures that are attached to an outer side of tubes 110, 114 by adhesives and/or screws. Interior channels 112, 116 may be defined by vertical grooves in cladding elements 111, 115 that are sealed off by the outer sides of tubes 110, 114 when attached to elements 111, 115 to provide spaces for routing electrical wiring and controls. Cladding element 111 may comprise threaded inserts 117 (e.g., FIG. 7) and cladding element 115 may comprise threaded inserts 118 (e.g., FIG. 8). Pegs 119 (e.g., FIG. 1) may be inserted into threaded inserts 117 and pegs 120 (e.g., FIG. 2) may be inserted into threaded inserts 118, such that pegs 119, 120 may be aligned vertically and horizontally.

Figure 6:
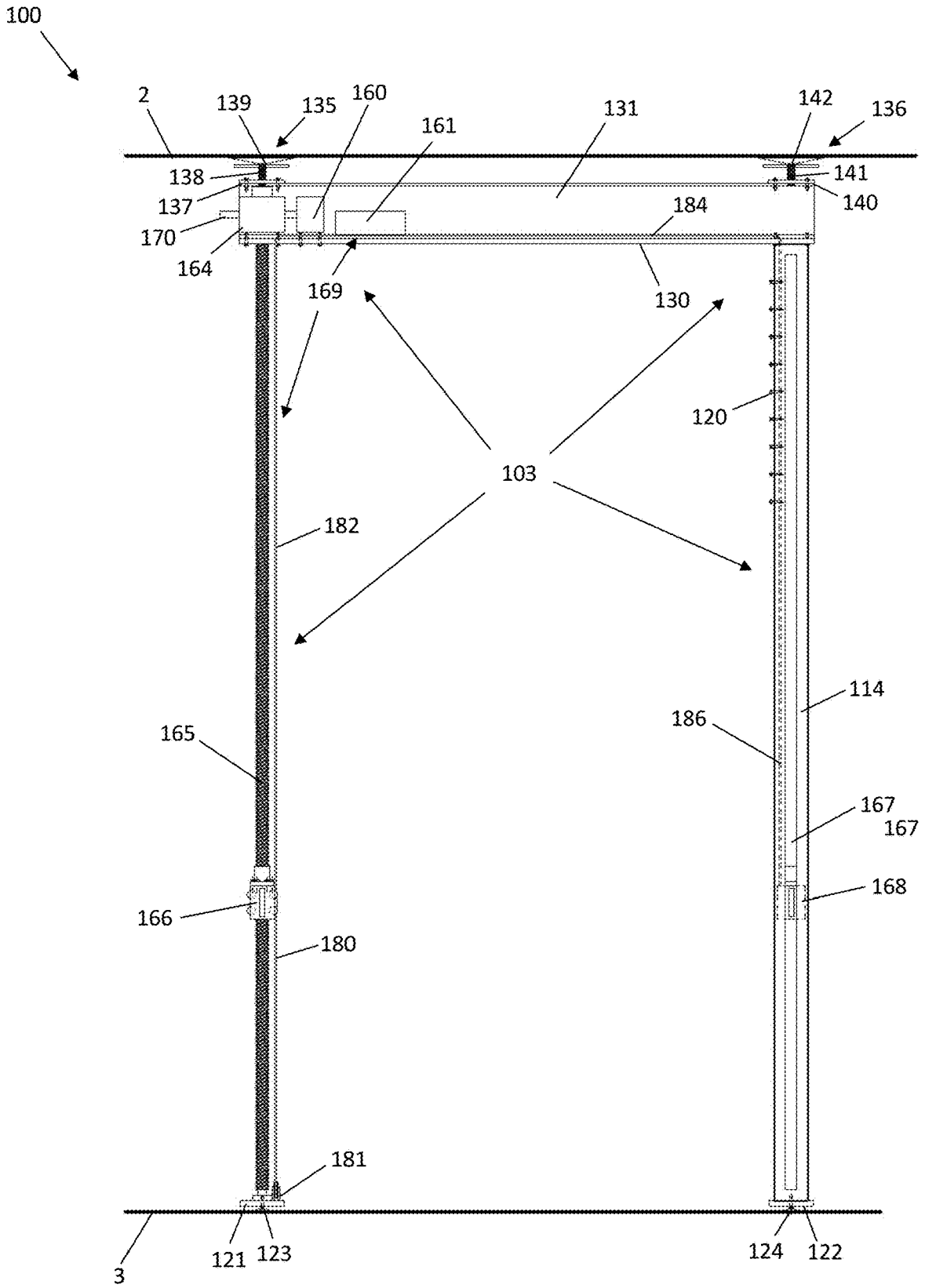
FIG. 6 depicts a profile view of the FIG. 5 actuator.
Figure 9:
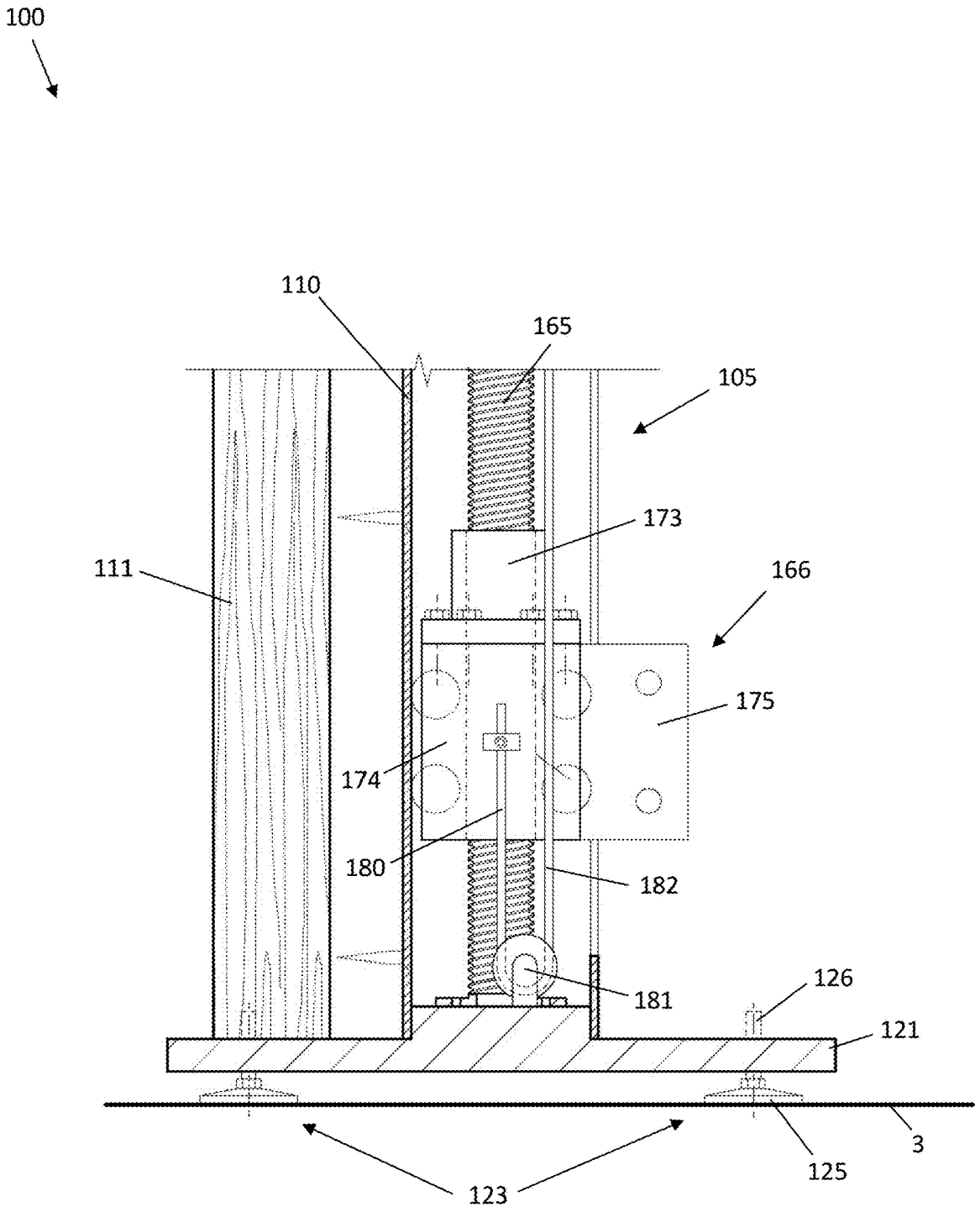
FIG. 9 depicts a profile section view of the FIG. 7 post.

Aspects of frame 101 may be independently expandable in the generally vertical direction to obtain the press fit. Posts 105, 106 may be independently expandable in a downward direction toward floor 3. Each post 105, 106 may comprise a leveling mechanism that is expandable downwardly toward floor 3. As shown in FIG. 6, for example, post 105 may be located between header 107 and a base plate 121 and post 106 may be located between header 107 and a base plate 122. As shown in FIG. 9, for example, base plate 121 may comprise a raised portion that is receivable inside of tube 110 and leveling feet 123 that are expandable to adjust a vertical location and orientation of post 105 relative to floor 3. Base plate 122 may similarly comprise a raised portion that is receivable inside of tube 114 and leveling feet 124 like feet 123, making plate 122 similarly expandable to adjust a vertical location and orientation of post 106 relative to floor 3. In keeping with FIG. 9, for example, leveling feet 123, 124 may comprise floor contact plates 125 and threaded bolts 126 that are rotatably attachable to threaded openings in base plates 121, 122 so that the vertical location and orientation of posts 105, 106 may be adjusted by rotating threaded bolts 126 to move floor contact plates 125, 126 toward or away from floor 3. Each threaded bolt 126 may be attached to floor contact plates 125, 126 by a multiaxial connection so that frame 101 may be adjustable relative to the floor 3, even it is unlevel.

Figure 4:
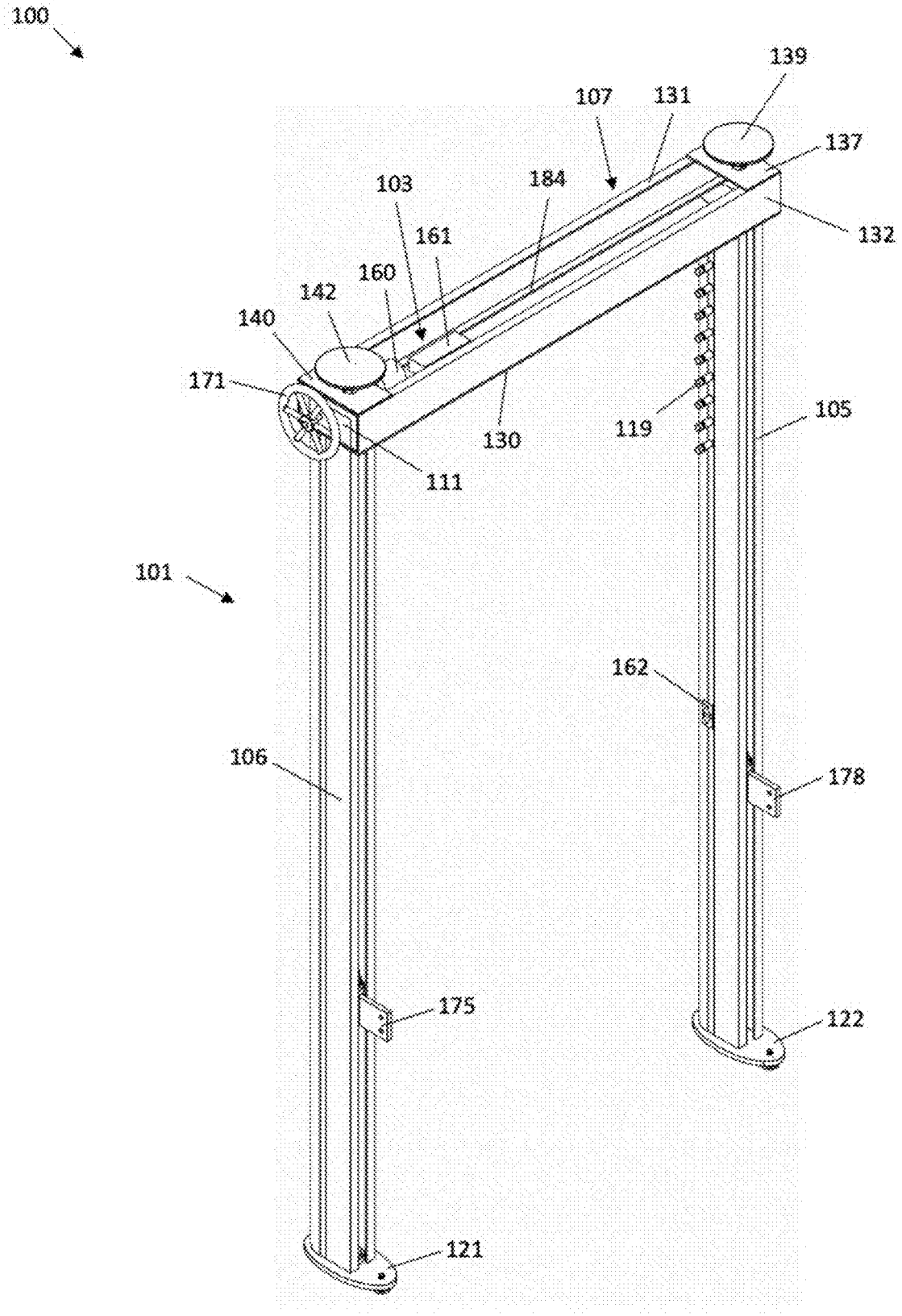
FIG. 4 depicts an assembled perspective view of a frame of the FIG. 1 workstation.

Header 107 may extend between posts 105 and 106. As shown in FIG. 4, for example, header 107 may comprise structural shapes rigidly attached to one another, like a box beam. As shown in FIGS. 4 and/or 10, for example, header 107 may comprise a header base plate 130, a C-channel 131, and a C-channel 132 that are bolted together to form a box beam spanning between post 105 and 106. Header base plate 130 may comprise a ⅜" steel plate and C-channels 131, 132 may comprise 3"×5"×¼" aluminum channels made of an aluminum alloy such as AA 6063. As shown in FIG. 4, for example, each end of header 107 may comprise an end plate (e.g., another ⅜" steel plate) that is rigidly attached to header base plate 130 and one of C-channels 131, 132. In keeping with FIG. 10, for example, header base plate 130 may comprise lowered portions that are receivable inside of and rigidly attached to tubes 110, 114.

Aspects of header 107 may be expandable in the generally vertical direction toward ceiling 2 to obtain the press fit. Like base plates 121, 122, header 107 may comprise a leveling mechanism that is vertically expandable toward ceiling 2, such as jack screws that are independently expandable toward ceiling 2. As shown in FIG. 6, for example, header 107 may comprise a jack screw 135 located above post 105 at one end of header 107 and a jack screw 136 located above post 106 at an opposite end of header 107. Jack screw 135 may comprise a base plate 137, a threaded shaft 138, and a ceiling contact plate 139 and jack screw 136 may comprise a base plate 140, a threaded shaft 141, and a ceiling contact plate 142. Base plate 137 may be rigidly attached to the one end of header 107 and base plate 140 may be rigidly attached to the opposite end of header 107. Threaded shafts 138, 141 may be rotatably engaged with threaded openings extending through base plates 137, 140. Jack screws 135, 136 may thus be operable to adjust the vertical location and orientation of frame 101 relative to ceiling 2 by rotating threaded shafts 138, 141 to move ceiling contact plates 139, 142 toward or away from ceiling 2. As shown in FIG. 6, for example, ceiling contact plates 139, 142 may comprise a lever and a multi-axial connection with threaded shafts 138, 141 so that jack screws 135, 136 may be adjustable relative to ceiling 2, even it is unlevel.

Figure 13:
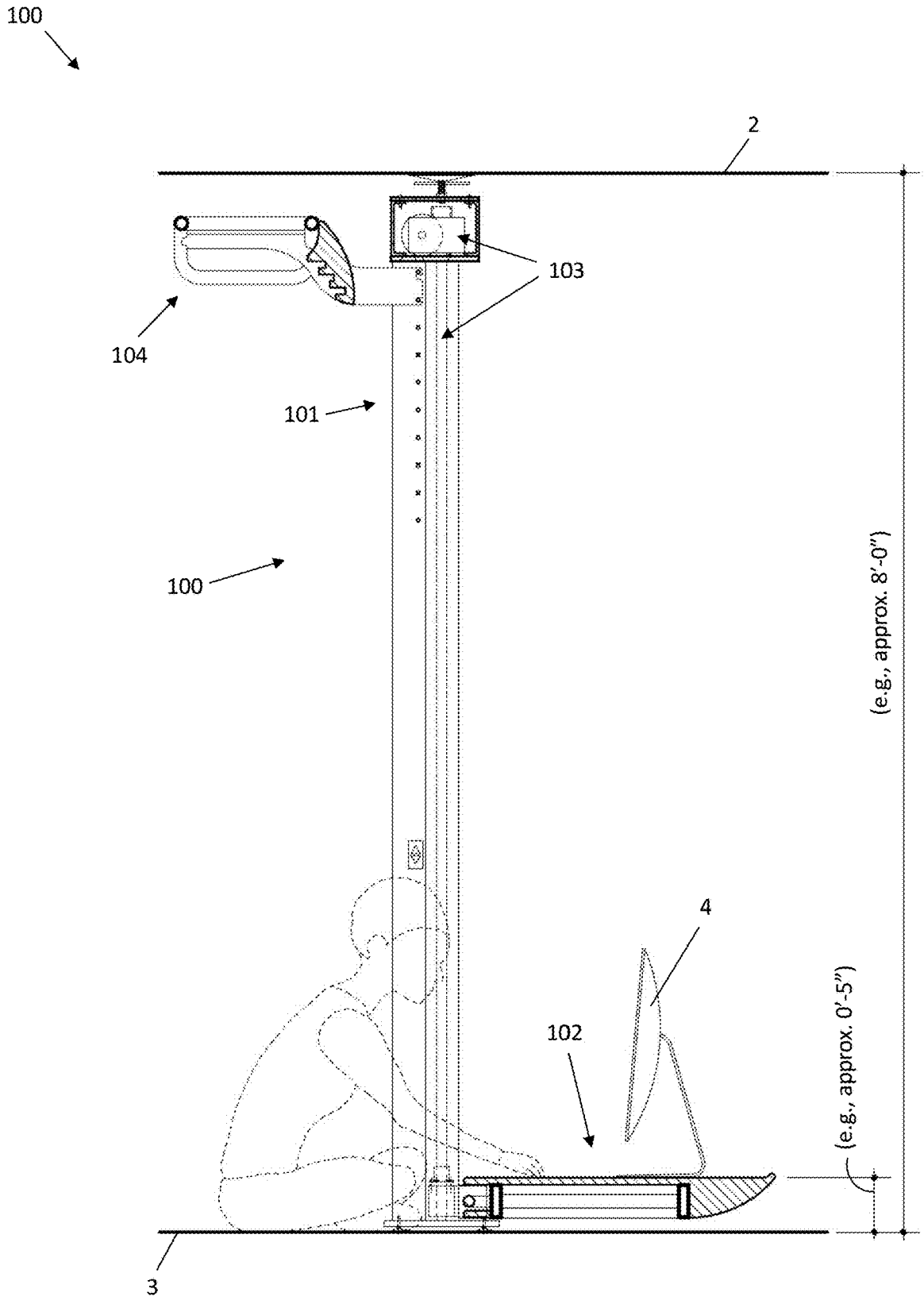
FIG. 13 depicts a section view of the FIG. 1 workstation with the work surface at a floor height.
Figure 14:
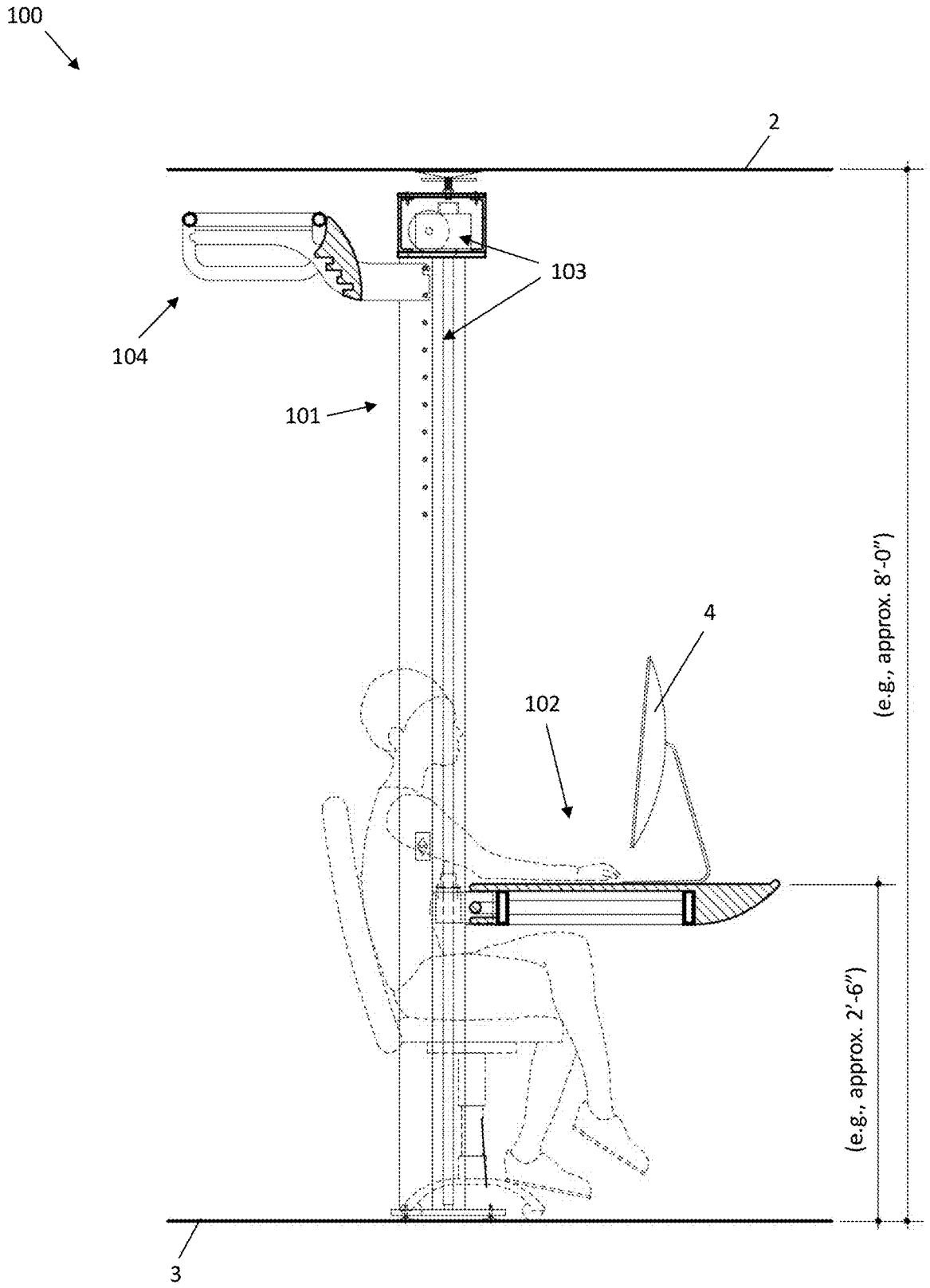
FIG. 14 depicts a section view of the FIG. 1 workstation with the work surface at a standing height.
Figure 15:
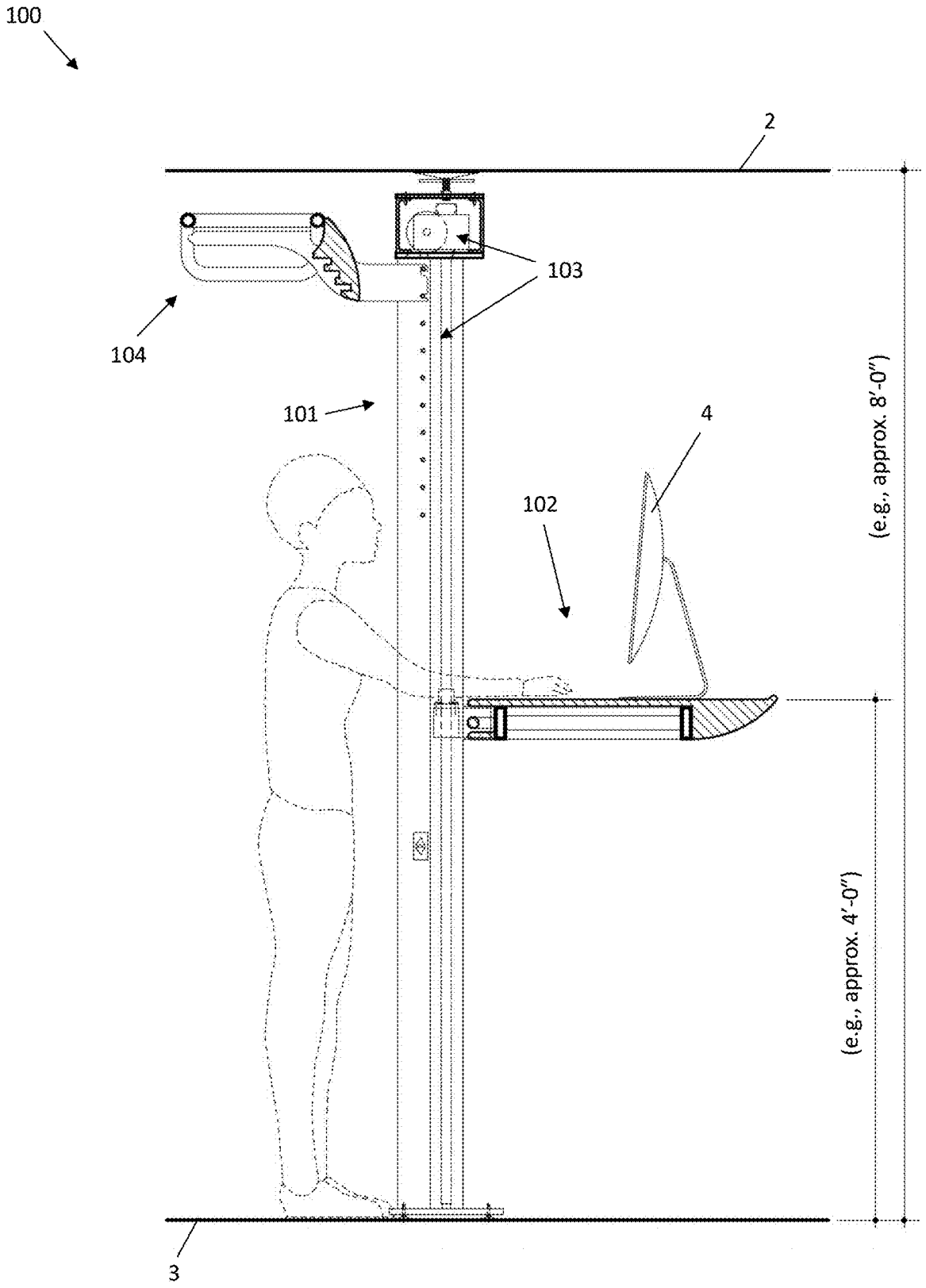
FIG. 15 depicts a section view of the FIG. 1 workstation with the work surface at a seated height.
Figure 16:
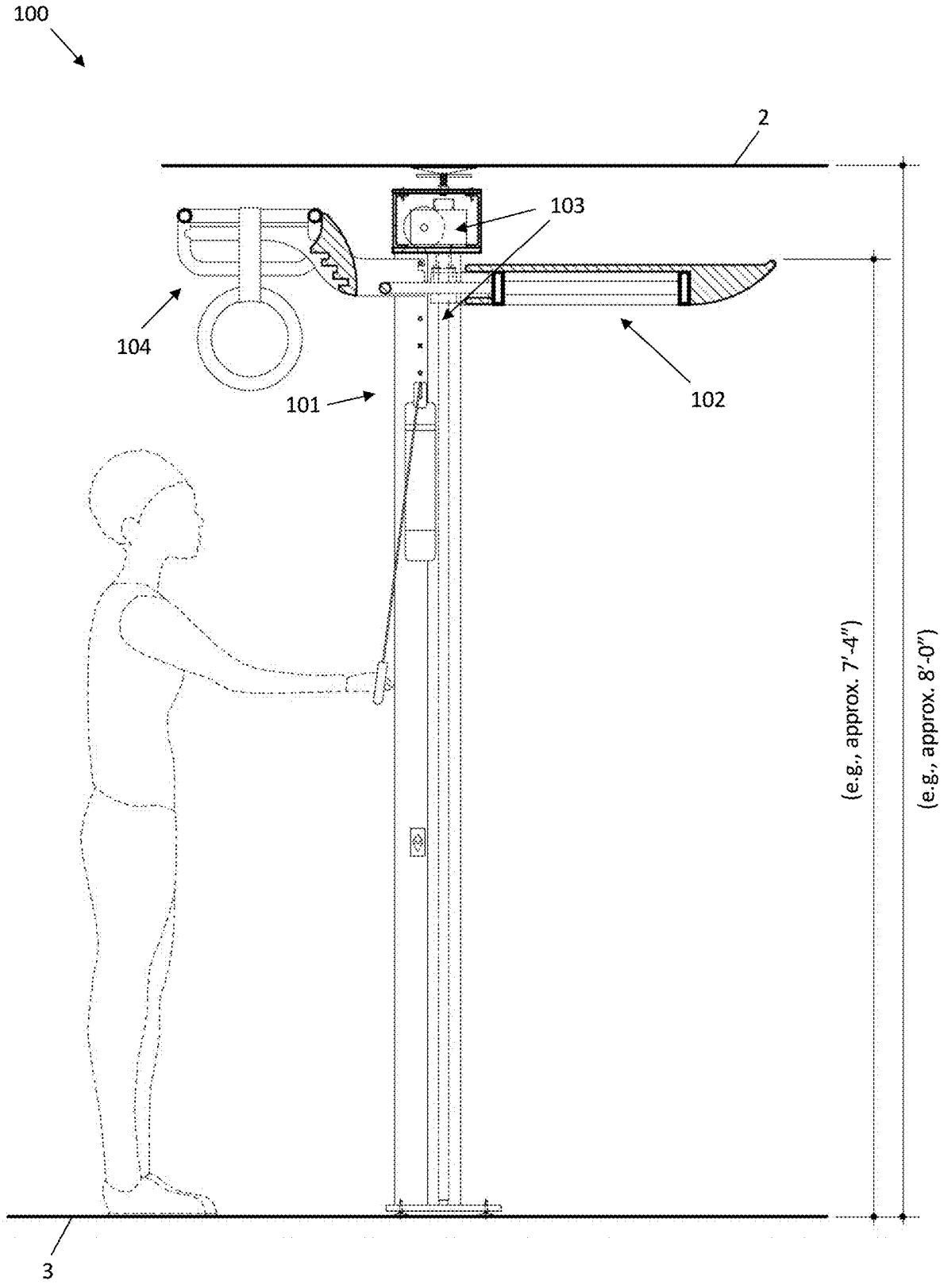
FIG. 16 depicts a section view of the FIG. 1 workstation with the work surface at a ceiling height.

Work surface 102 may be attachable to frame 101 and selectively positionable at a plurality of different work surface heights between ceiling 2 and floor 3. By way of example, the plurality of different work surface heights may comprise a floor height like that shown in FIG. 13, a seated height like that shown in FIG. 14, a standing height like that shown in FIG. 15, and a ceiling height like that shown in FIG. 16, in each of which the depicted person may be of average height. Work surface 102 may be made of any rigid materials that resist bending and provide a suitable work surface for any type of work requiring a flat surface. A computer 4 is shown in FIG. 1 as an example of desk-based work, although work surface 102 may be similarly utilized to support a bed, machines, a kitchen sink, tools, and/or anything requiring a generally flat surface or proximity thereto. As shown in FIGS. 1 and 2, for example, work surface 102 may have a "winged" profile shape defined by a flat surface area 150 flanked by a pair of curved surface areas 151.

Figure 11:
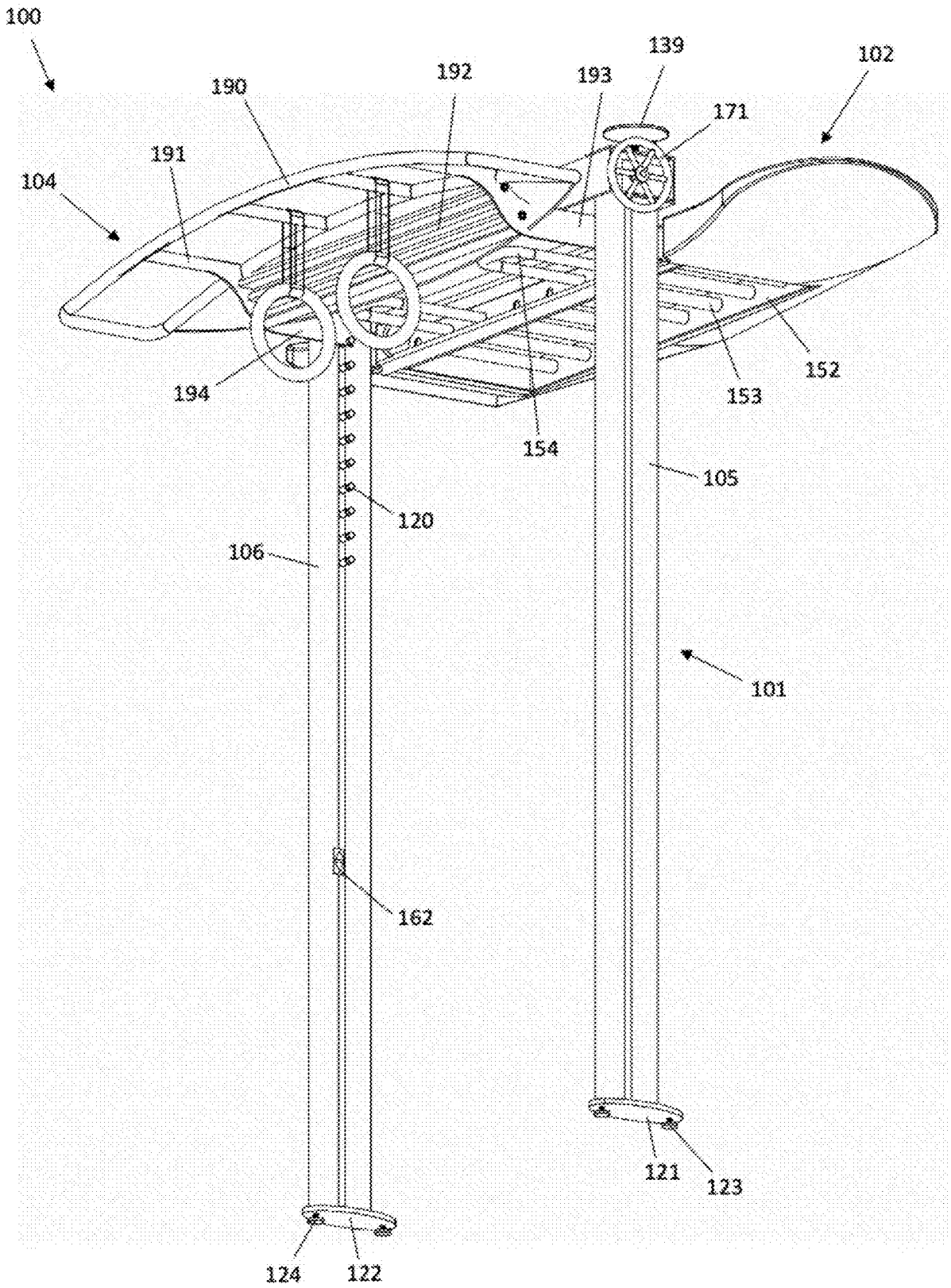
FIG. 11 depicts a perspective view of the FIG. 1 workstation looking under the work surface after being moved to a ceiling height.

Aspects of work surface 102 may be operable with frame 101 to support a weight of a user at each height of the plurality of different work surface heights. Edges of work surface 102 may support the weight and/or work surface 102 may comprise one or more exercise grips operable to support the weight. As shown in FIGS. 11 and/or 12, for example, work surface 102 may comprise an internal or internal frame 152, support grips 153, and movable grips 154.

Figure 12:
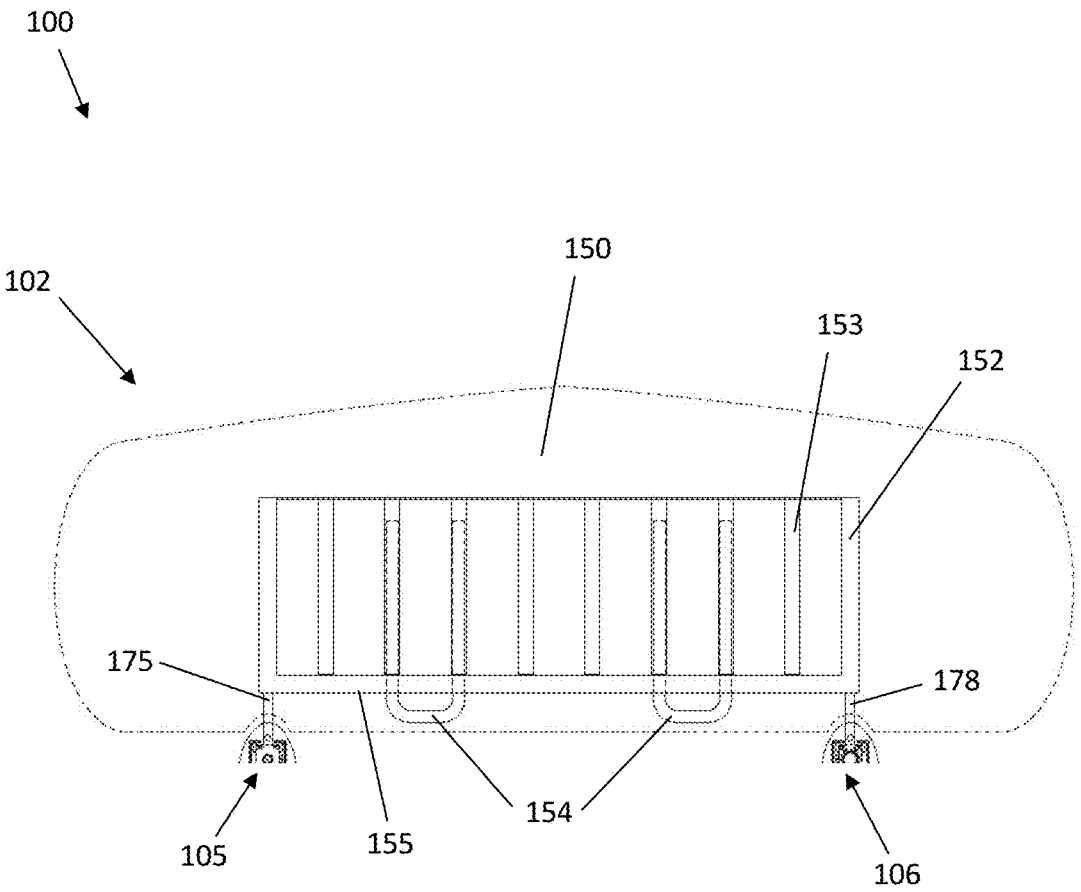
FIG. 12 depicts a bottom-up plan view of the FIG. 1 work surface.

Internal frame 152 may comprise a box frame structure formed by plurality of structural steel shapes that are arranged into a rectangular shape and rigidly attached to one another via bolting or welding. As shown in FIG. 12, for example, three sides of internal frame 152 may be embedded into work surface 102 and a side 155 of internal frame 152 may be offset from an outer perimeter of work surface 102. Side 155 of internal frame 152 may comprise holes and support grips 153 may comprise steel tubes that are inserted into the holes and rigidly attached to internal frame 152, resulting in lumens extending into work surface 102. As shown in FIG. 12, for example, support grips 153 may be fixed relative to internal frame 152 and used as pull-up bars or monkey bars when work surface 102 is at the ceiling height. Support grips 153 and moveable grips 154 may be moveable together with work surface 102 in the generally vertical direction between the plurality of different heights.

Moveable grips 154 may be selectively moveable relative to internal frame 152. As shown in FIG. 3, for example, each moveable grip 154 may comprise a U-shape defined by a palm grip with two grip shafts extending outwardly therefrom. The grip shafts may be receivable in two lumens of support grips 153, allowing the grip shafts to both support the weight of a user and be slid back and forth inside support grips 153. As shown in FIGS. 11 and 12, for example, moveable grips 154 may thus be moveable independent of work surface 102 in a generally horizontal direction between a plurality of different grip positions including a working position where they are spaced apart from the desk and operable to support a weight of a user (e.g., as in FIG. 11) and a stored position where they are adjacent the desk frame (e.g., as in FIG. 12). The grip portion of moveable grips 154 may be hidden under work surface 102 and similarly operable to support the weight of the user when in the stored position.

Actuator 103 may comprise mechanical and/or electrical components that are attachable to and operable with frame 101 to move work surface 102 within a range of movement including the plurality of different work surface heights while maintaining an orientation of work surface 102 relative to frame 101. All or portions of actuator 103 may be located inside elements of frame 101, such as inside of posts 105, 106 and/or header 107 to keep its components out of sight and harm's way. As shown in FIG. 3, for example, actuator 103 may comprise an electric motor 160 that is located in header 107, rigidly attached to header base plate 130, and operable with frame 101 to move work surface 102 within the range of movement including the plurality of different work surface heights. By way of example, electric motor 160 may comprise a drive motor with 500 W delivered to mechanical load with a maximum speed of 1,500 rpm (157 rad/s) (1.5 Nm of output motor shaft torque); or a rated power of 250 W, a rated volts of 42 VDC, a rated amps of 6 ADC, a max speed of 4000 RPM, and DC res of 0.60 OHMS.

As shown in FIG. 3, for example, actuator 103 may comprise a controller 161 that is located in header 107 and electronically operable with electric motor 160 to move work surface 102. Controller 161 may be electronically operable with electric motor 160 responsive to one or more of a switch, a timer, a sensor, a program, and a computing device, any of which may be part of computer 4 or controller 161 (e.g., FIG. 1), a control element 162 (e.g., FIG. 2), and/or an external control device in communication therewith over a wired or wireless connection, such as a mobile phone with a WiFi connection to controller 161 rendering workstation 100 operable with an application on the mobile phone.

Actuator 103 may comprise a lift system comprising mechanical components operable to generate an input torque sufficient to move work surface 102. As shown in FIGS. 3 and 5-10, for example, the lift system may be operable with frame 101 and an input torque applied by electric motor 160 to move work surface 102 within the range of movement including the plurality of different work surface heights, while maintaining an orientation of work surface 102 relative to frame 101. Portions of the lift system may be located in frame 101, such as in post 105, post 106, and/or header 107, to keep them out of harm's way. As shown in FIG. 3, for example, the lift system may comprise a gear box 164, a threaded rod 165, a first actuator member 166, a guide rod 167, a second actuator member 168, and a cable 169.

Gear box 164 may be located in header 107 and operable to cause the vertical movements of work surface 102. As shown in FIG. 6, for example, electric motor 160 may comprise an output shaft 170 extend into and through gear box 164. As shown in FIGS. 4 and/or 6, a manual crank 171 may be located outside of header 107, attached to output shaft 170, and operable to cause vertical movements of work surface 102. In the event of a power outage, manual crank 171 may thus be manually operable to cause vertical movements of work surface 102 without electricity.

Threaded rod 165 may be rotatably mounted and vertically fixed in post 105 between an upper rotational bearing located in gear box 164 (e.g., FIG. 10) and a lower rotational bearing located on base plate 121 (e.g., FIG. 9). Threaded rod 165 may comprise a 30 mm leadscrew with exterior threads. A drive gear located in gear box 164 may be operable with an input torque applied by output shaft 170 to rotate threaded rod 165 in a clockwise or counterclockwise direction within post 105. As shown in FIGS. 3, 7, and 9, for example, first actuator member 166 may be located in post 105 and operably attached to threaded rod 165 and work surface 102 so that rotation of threaded rod 165 with the input torque causes vertical movements of work surface 102.

Figure 5:
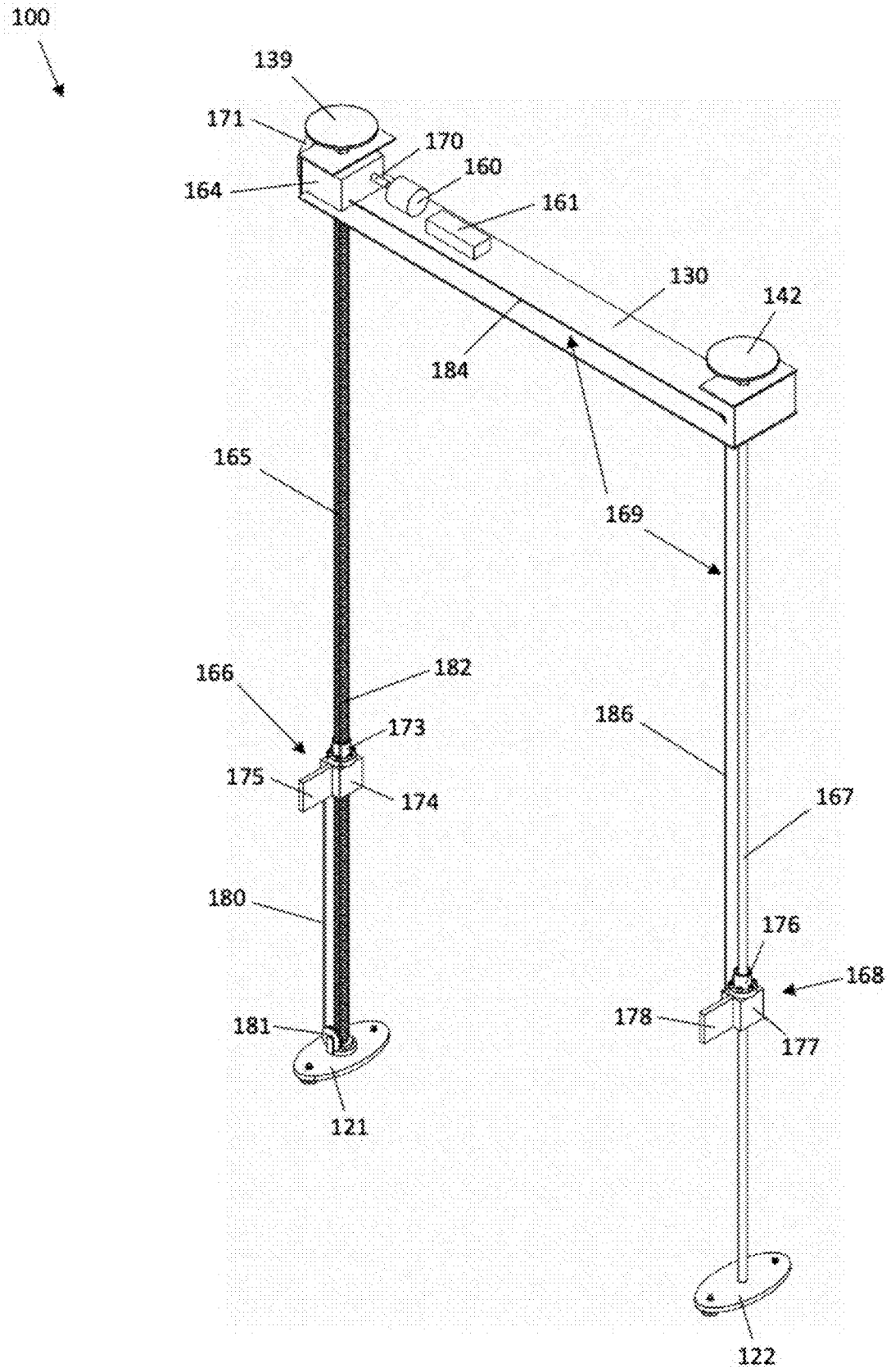
FIG. 5 depicts a perspective view of an actuator of the FIG. 1 workstation.

As shown in FIGS. 5, 7, and 9, for example, first actuator member 166 may comprise a lifting nut 173, a guide track 174, and a connector arm 175.

Lifting nut 173 may comprise threads operable with corresponding threads of threaded rod 165 to cause the vertical movements of work surface 102 when threaded rod 165 is rotated; stabilize work surface 102 during the vertical movements; and maintain a vertical position of work surface 102 when threaded rod 165 is not rotated. As shown in FIG. 9, for example, lifting nut 173 may comprise a circular bronze structure with internal threads. Guide track 174 may comprise a machined stainless-steel rectangular structure that is rigidly attached to lifting nut 173 and comprises wheels (e.g., nylon rollers) that act on interior surfaces of tube 110 to stabilize work surface 102 during vertical movements thereof. As shown in FIG. 9, for example, guide track 174 may be sized to position the wheels against the interior surfaces of tube 110 so that exterior surfaces of the wheels remain in contact therewith.

Connector arm 175 may be rigidly attached to guide track 174. As shown in FIG. 4, for example, post 105 may comprise an elongated opening extending in the generally vertical direction.

Connector arm 175 may extend outwardly from guide track 174 and through the elongated opening to vertically support work surface 102. As shown in FIGS. 9 and/or 12, for example, connector arm 175 may be rigidly attached to a portion of work surface 102, such as internal frame 152 and/or an underside of generally flat area 150, to transfer shear and moment forces from work surface 102, to guide track 175, and back to post 105 with the wheels of guide track 175.

As shown in FIGS. 3, 5-6, and 8, for example, guide rod 167 may be rotatably and vertically fixed in post 106 between an upper mount located on header base plate 130 (e.g., the opening shown in FIG. 3), and a lower mount located on base plate 122 (e.g., FIG. 5). Guide rod 167 may comprise a ¾" stainless steel solid-core shaft with a polished exterior finish. In contrast to threaded rod 165, guide rod 167 may not be rotatable. For example, each end of guide rod 167 may be rigidly attached to one of upper or lower mounts. Second actuator member 168 may be located in post 106 and operably attached to first actuator member 166, guide rod 167, and work surface 102 so that rotation of threaded rod 165 causes the vertical movements of work surface 102.

As shown in FIGS. 5 and 8, for example, second actuator member 168 may comprise a guide shaft 176, a guide track 177, and a connector arm 178.

Guide shaft 176 may comprise smooth interior surfaces operable with the corresponding smooth exterior surfaces of guide rod 167 to guide the vertical movements of work surface 102 so that rotation of threaded rod 165 causes first actuator member 166 to move together with second actuator member 168 in the generally vertical direction to maintain a generally level orientation of work surface 102 during the vertical movements of work surface 102. Because of their size and strength, the internal threads of first actuator member 166 may thus be operable with the corresponding threads of threaded rod 165 to cause the vertical movements of work surface 102 when threaded rod 165 is rotated manually or electronically; stabilize the work surface in cooperation with the interior surfaces of guide shaft 175 and the corresponding exterior surfaces of guide rod 166 during the vertical movements of work surface 102 within the range of movement; and maintain the vertical position of work surface 102 when threaded rod 165 is not rotated. Guide track 177 may comprise a machined stainless-steel rectangular structure that is rigidly attached to guide shaft 176 and comprises wheels (e.g., nylon rollers) that act on interior surfaces of tube 114 to stabilize work surface 102 during vertical movements thereof. As shown in FIG. 8, for example, guide track 177 may be sized to position the wheels against the interior surfaces of tube 114 so that exterior surfaces of the wheels remain in contact therewith.

Connector arm 178 may be rigidly attached to guide track 177. As shown in FIG. 4, for example, post 105 may comprise an elongated opening extending in the generally vertical direction. Connector arm 178 may extend outwardly from guide track 177 and through the elongated opening to vertically support work surface 102. As shown in FIGS. 8 and/or 12, for example, connector arm 178 may be rigidly attached to a portion of work surface 102, such as internal frame 152 and/or an underside of generally flat area 150, to transfer shear and moment forces from work surface 102, to guide shaft 177, and back to post 106 with wheels of guide track 177.

Cable 169 may be operable to transfer tensile forces from first actuator member 166 to second actuator member 168. A ⅛" braided steel cable may be used, which may comprise an external coating or surface treatment for durability and corrosion protection, such as a polymeric coating. As shown in FIGS. 3, 5, and/or 6, for example, cable 169 may be operatively attached to first actuator member 166 and second actuator member 169 so that rotation of threaded rod 165 causes first actuator member 166 to move vertically with second actuator member 168 at approximately the same time and speed in a smooth, controlled manner. Like other components of actuator 103, cable 169 may be located inside frame 101, such as by routing through post 105, post 106, and header 107, so that it is out sight and harm's way.

As shown in FIGS. 5 and 6, for example, cable 169 may comprise a continuous length comprising a first cable portion 180 extending downwardly from first actuator member 166 to a first pulley 181 located below threaded rod 165 (e.g., FIG. 9); a second cable portion 182 extending upwardly from first pulley 181 to a first guide roller 183 located above threaded rod 165 (e.g., FIG. 10); and a third cable portion 184 extending generally horizontally from first guide roller 183 to a second guide roller 185 located above guide rod 167 (e.g., FIG. 10); and a fourth cable portion 186 extending downwardly from second guide roller 185 to second actuator member 168 (e.g., FIG. 10). In this example, first cable portion 180, first pulley 181, and second cable portion 182 may be located in post 105; first guide roller 183, third cable portion 184, and second guide roller 185 may be located in header 107; and fourth cable portion 186 may be located in post 106. As shown in FIG. 9, for example, a terminal end of first cable portion 180 may be rigidly attached to guide track 174 and first pulley 181 may be rigidly attached to base plate 121.

Overhead element 104 may comprise exercise grips operable to support a weight of a user. Different types of exercise grips may be utilized. As shown in FIG. 11, for example, overhead element 104 may comprise a pull-up bar 190, monkey bars 191, and finger grips 192. Overhead element 104 may be removably attached to frame 101 at a plurality of different heights, making it adjustable to accommodate different users and/or removable when not in use. As shown in FIG. 11, for example, overhead element 104 may comprise a support leg 193 comprising a set of two grooves and a support leg 194 comprising another set of two grooves.

Operational aspects of workstation 100 are now described. As shown in FIG. 4, for example, the above-described elements of frame 101, work surface 102, and actuator 103, may be assembled on-site to provide functional structure 100 with a rigid U-shape that is ready for installation between ceiling 2 and floor 3. Fully assembled views of workstation 100 are provided in FIGS. 1 and 2, in which computer 4 has been on work surface 102; and again in FIG. 11, in which a pair of ring grips has been attached to overhead element 104.

Some portions of workstation 100, like post 105, post 106, and header 107 and the above-described elements of actuator 103 attached thereto, may be assembled in a factory setting and then fully assembled on-site to reduce shipping costs and simplify installation. In keeping with FIGS. 9 and 10, for example, once fully assembled, the rigid U-shape of frame 101 may then be stood on end, slid into a desired position between ceiling 2 and floor 3, and then expanded upwards and/or downwards by operation of leveling feet 123, 124 and/or jack screws 135, 138 until floor contact plates 125, 127 and ceiling contact plates 131, 134 are firmly pressed against ceiling 2 and floor 3, thereby establishing the press fit. Additional elements may be used to solidify these connections, such adhesives and/or screws for rigidly attaching plates 125, 127 and 131, 134 to ceiling 2 and floor 3 for increased safety and stability if needed.

Once the press fit has been obtained, work surface 102 may be removably attached to frame 101 by rigidly attaching connector arms 175, 178 to internal frame 152, preferably when first actuator member 166 and second actuator member 168 are in the floor position. For example, some leveling objects (e.g., wood blocks) may be used to safely align bolt openings of arms 175, 178 with corresponding bolt openings of internal frame 152 during attachment of work surface 102 to internal frame 152, although other methods are possible. The two grip shafts of each moveable grip 154 may then be slid into a corresponding two lumens of support grips 153, rendering grips 154 operable to support weight. Overhead element 104 may be removably attached to frame 101 at a desired height by receiving two of pegs 119, 120 in the corresponding two grooves of support legs 193, 194. Pegs 119, 120 may be used to support other pieces of exercise equipment, such as one or more resistive elements (e.g., FIG. 16), weight bar supports (e.g., FIG. 17), and the like. At this time, it may be desirable to double-check and/or further expand leveling feet 123, 124 and/or jack screws 135, 138 to ensure that the press fit may be safely maintained during operation of workstation 100.

Elements of actuator 103 (e.g., either electric motor 160 or manual crank 171) may then be operable to move work surface 102 in a generally vertical direction from the floor height to the seated height, from the seated height to the standing height, from the standing height to the ceiling height, and vice versa, all while maintaining a generally horizontal orientation of work surface 102 relative to frame 101 to avoid toppling computer 4 or otherwise disturbing items placed on work surface 102. When work surface 102 is at the floor height, first cable portion 180 may be at its shortest length (e.g., FIG. 9), second cable portion 182 may run the length of post 105, third cable portion 184 may run the length of header 107, and fourth cable portion 186 may run the length of post 106. For comparison, when work surface is at the ceiling height, first cable portion 180 and second cable portion 182 may run the length of post 105, third cable portion 184 may run the length of header 107, and fourth cable portion 186 may be at its shortest length.

As described herein, actuator 103 (e.g., either electric motor 160 or manual crank 171) may be electronically or manually operable to move work surface 102, together with moveable grips 154, by rotating threaded rod 165, causing its threads to interact with corresponding threads of lifting nut 173 and move first actuator member 166. This threaded interaction may, turn-by-turn, apply a tensile force to cable portion 169 that is routed through its cable portions 180, 182, 184, and 186, incrementally moving second actuator member 168 with first actuator member 166 in a generally vertical direction, upwardly or downwardly, at approximately the same time, in a smooth and controlled manner so that workstation 100 may be adjusted as needed for a desired use.

Additional aspects of this disclosure are now described with reference to exemplary workstations 200, 400, 500, and/or 600 that are similar to workstation 100, but for the differences shown in FIGS. 17 to 43 and described in relation thereto. Workstations 200, 400, 500, and/or 600 may comprise elements that are similar to those of workstation 100, but within the respective 200, 400, 500, and/or 600 series of numbers, whether or not those elements are called out in FIGS. 17 to 43 or expressly described herein. Any aspects described with reference to workstation 200, 400, 500, and/or 600 may be included within any variation thereof, each possible combination or iteration being part of this disclosure and available to provide support for the claims.

Figure 17:
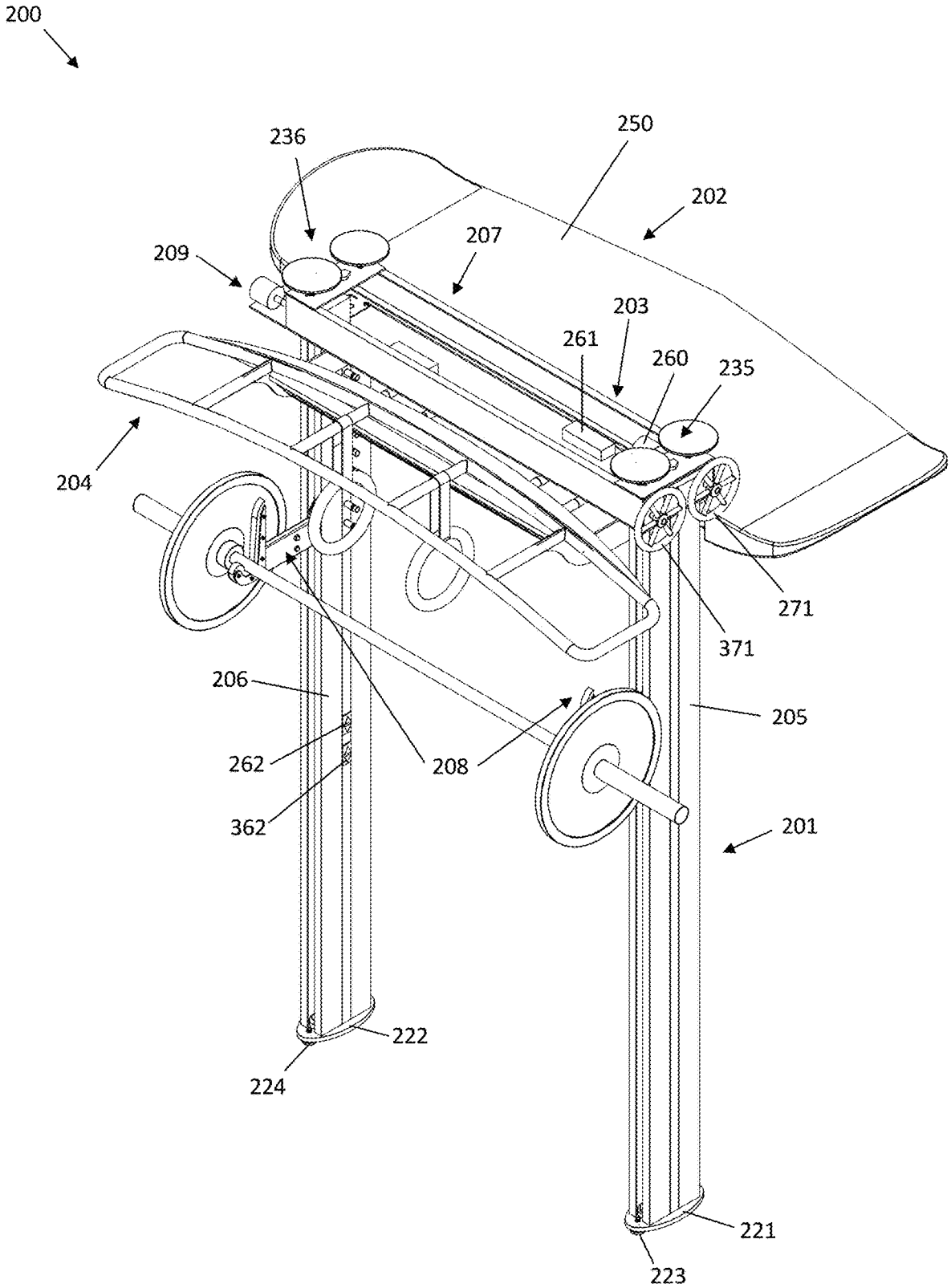
FIG. 17 depicts a perspective view of an exemplary workstation with frame, a work surface that is selectively movable relative to the frame between a plurality of different work surface heights, and an equipment support that is selectively movable relative to the frame between a plurality of different equipment support heights.

As shown in FIG. 17, for example, workstation 200 may similarly comprise a work surface that is adjustable between an extended range of positions including a floor height, a seated height, a standing height, and a ceiling height. Workstation 200 also may comprise overhead elements that are positioned to enable various types of fitness enhancing activities, such as hanging by the hands. Some of the elements may be moveable to different heights, allowing for customization. In contrast to workstation 100, workstation 200 also may comprise an equipment support that is adjustable between an extended range of positions including a floor height, a seated height, a standing height, and a ceiling height.

As shown in FIG. 17, for example, workstation 200 may comprise a frame 201, a work surface 202, an actuator 203, an overhead element 204, an equipment support 208, and an actuator 209.

Like frame 101, frame 201 may comprise a rigid configuration of structural shapes operable to support work surface 202, actuator 203, overhead element 204, equipment support 208, and actuator 209 and transfer any forces applied therewith and/or therewith to a supporting structure, such as a building. Frame 201 may be expandable in a generally vertical direction to obtain a press fit between an upper support structure such as a ceiling 2 and a lower support structure such as a floor 3 thereby reducing a footprint of workstation 200. As described further below, frame 201 may comprise or be integrated into a door frame, a window frame, and/or a wall, such that ceiling 2 and floor 3 are exemplary supporting structures provided to facilitate understanding of this disclosure and not limiting unless claimed as such.

Figure 18:
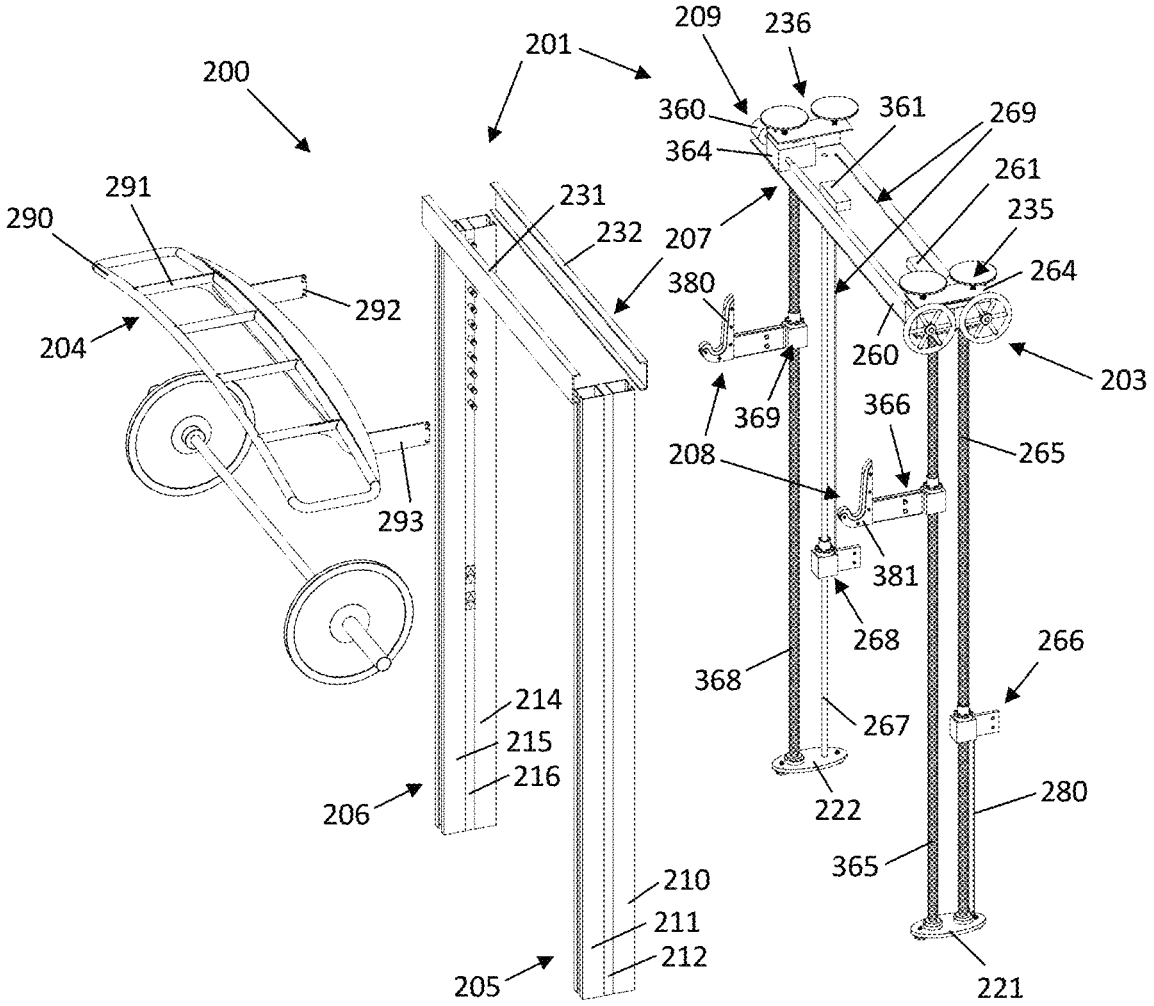
FIG. 18 depicts an exploded perspective view of the FIG. 17 workstation.
Figure 18:
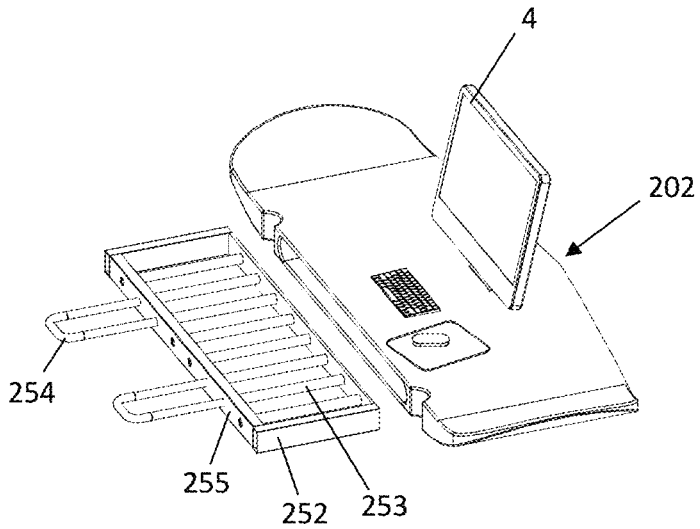
Figure 20:
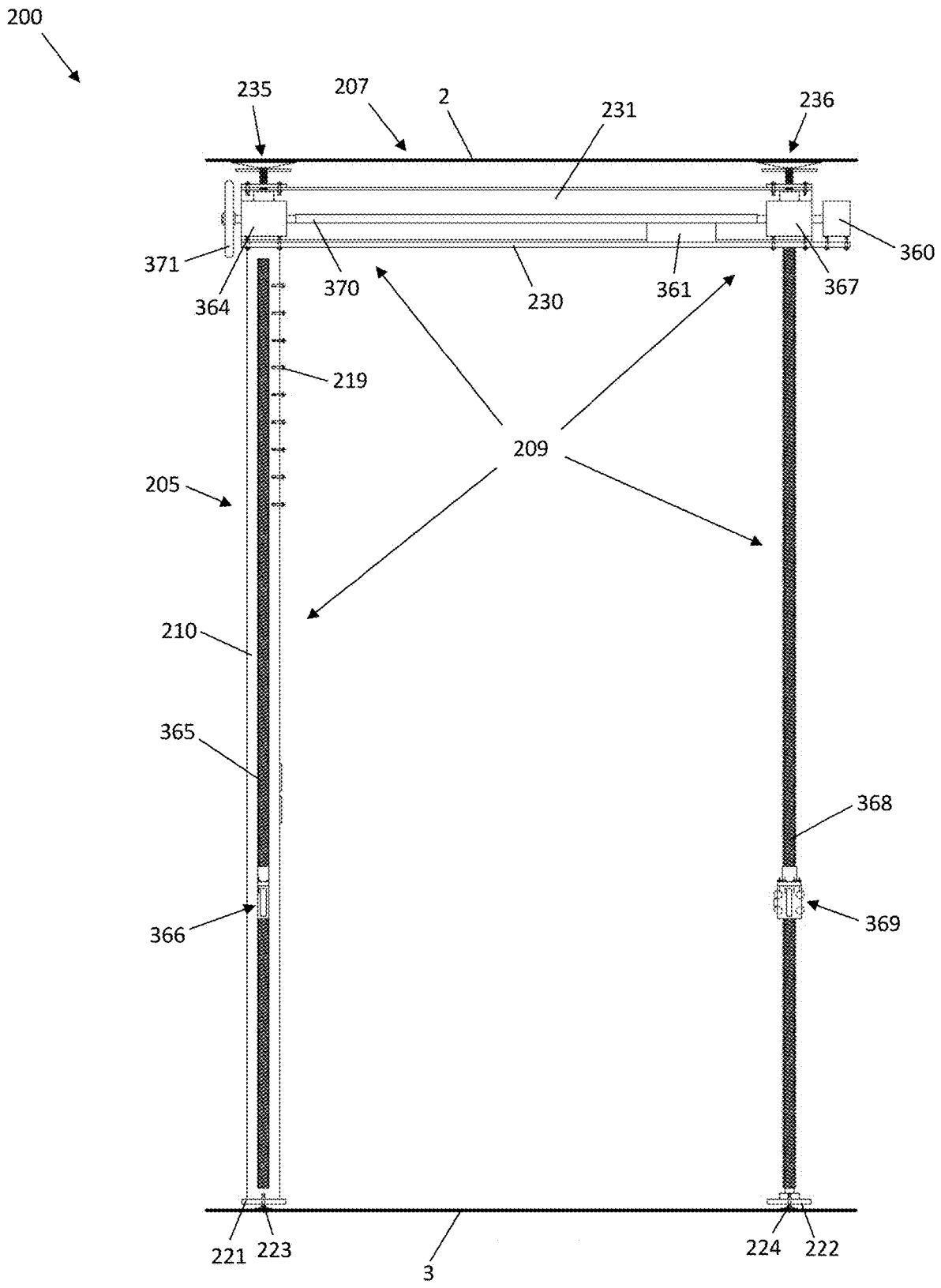
FIG. 20 depicts a profile section view of an actuator of the FIG. 17 workstation.
Figure 21:
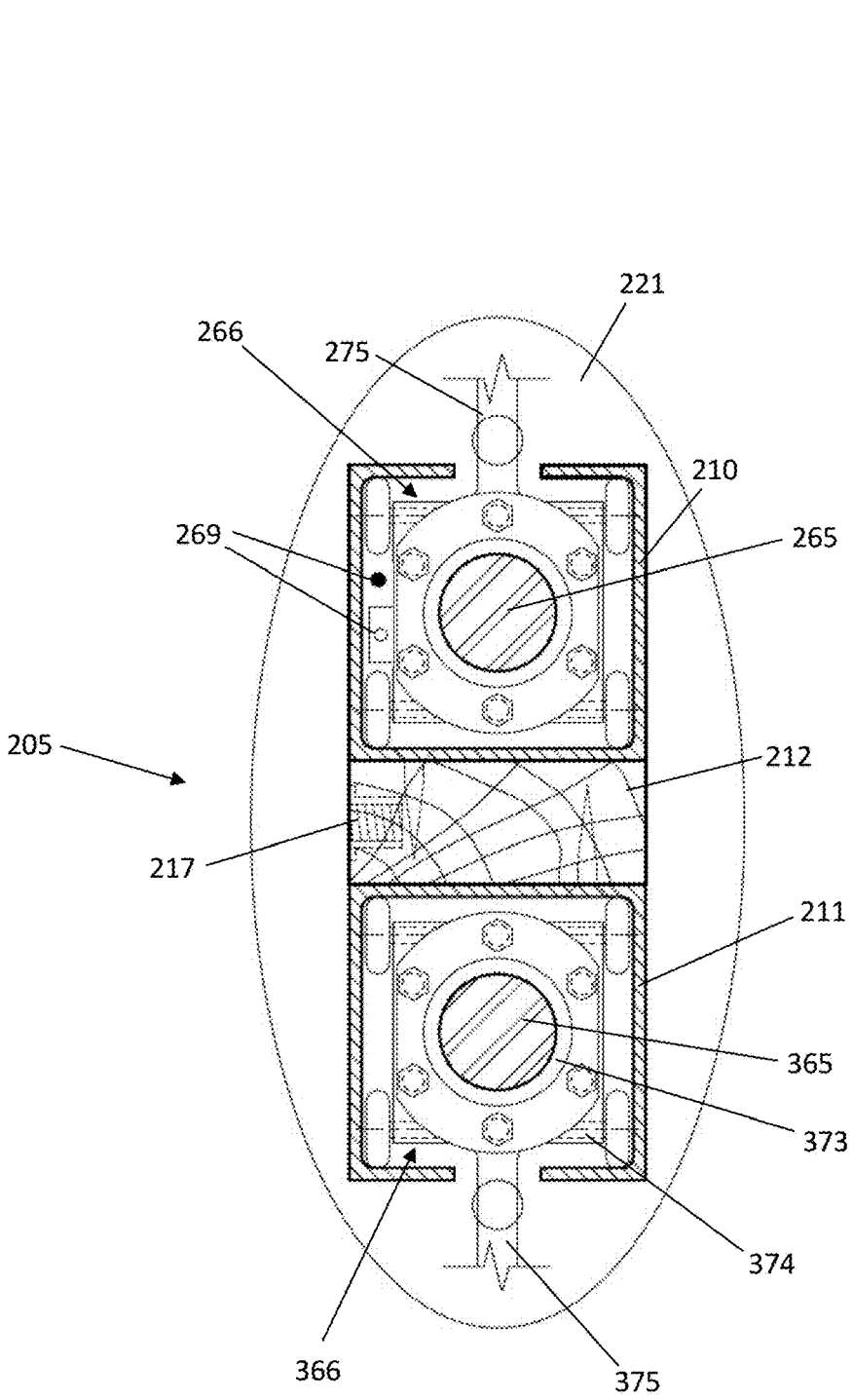
FIG. 21 depicts a top-down section view of a post of the FIG. 19 frame.
Figure 22:
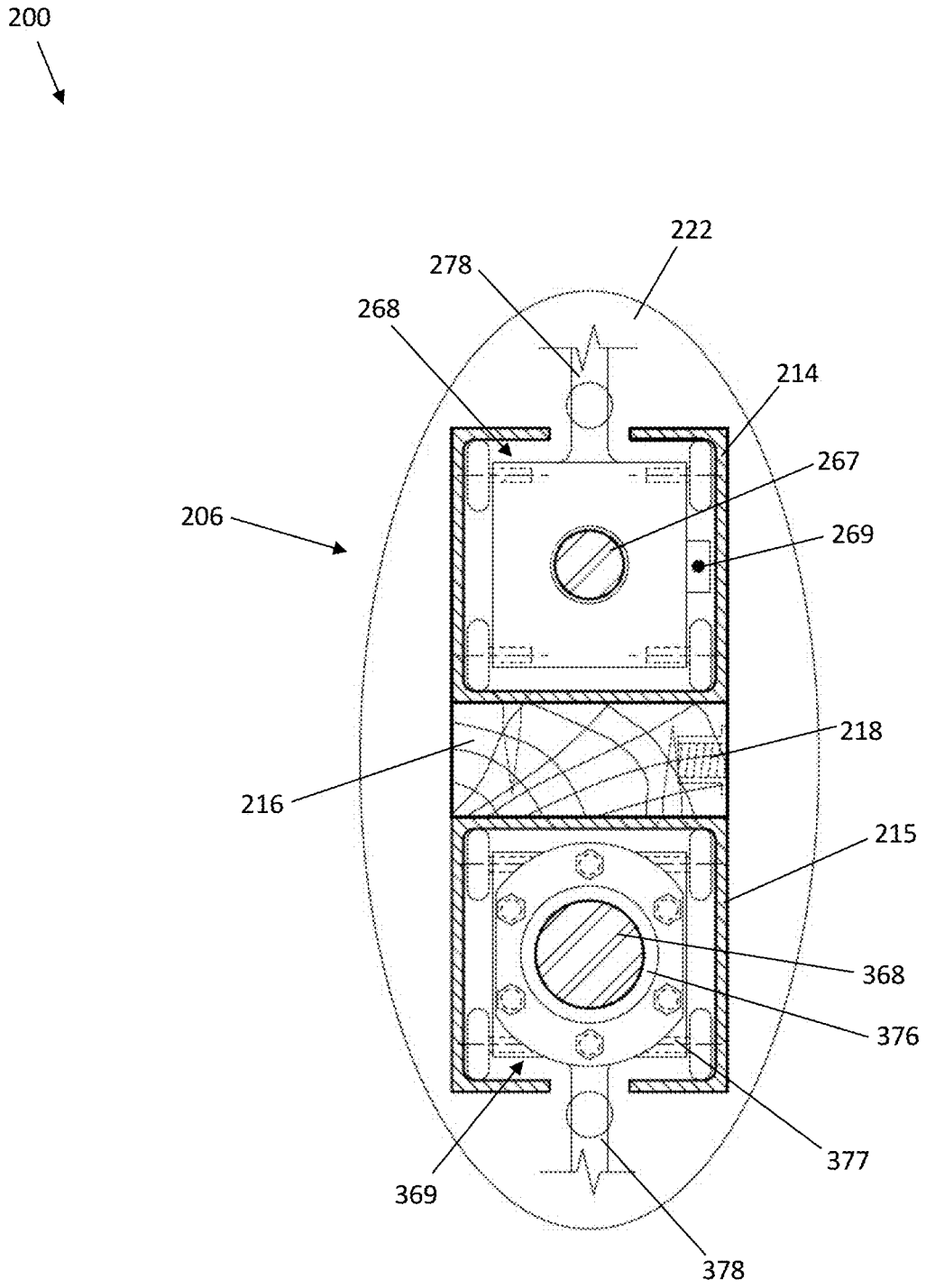
FIG. 22 depicts a top-down section view of another post of the FIG. 19 frame.

Frame 201 may comprise structural elements that are independently expandable upwards and/or downwards in the generally vertical direction to obtain the press fit. As shown in FIG. 18, for example, frame 201 may comprise a post 205, a post 206, and a header 207. As shown in FIG. 21, for example, post 205 may be a composite structure comprising a first tube 210, a second tube 211, and a spacer 212. As shown in FIG. 22, for example, post 206 may be a composite structure comprising a first tube 214, a second tube 215, and a spacer 216. Each tube 210, 211, 214, and 215 may be a structural shape, such as a 3"×3"×⅛" aluminum tube made of an aluminum alloy such as AA 6063. Spacers 212, 216 may be wooden structures that are attached to tubes 210, 211 or 214, 215 by adhesives and/or screws. As shown in FIG. 21 or 22, for example, spacer 212 may comprise threaded inserts 217 and spacer 216 may comprise threaded inserts 218. Pegs 219 (e.g., FIG. 20) may be inserted into threaded inserts 217 and pegs 220 (e.g., FIG. 19) may be inserted into threaded inserts 218, such that pegs 219, 220 are aligned vertically and horizontally when frame 201 is assembled and installed.

Figure 24:
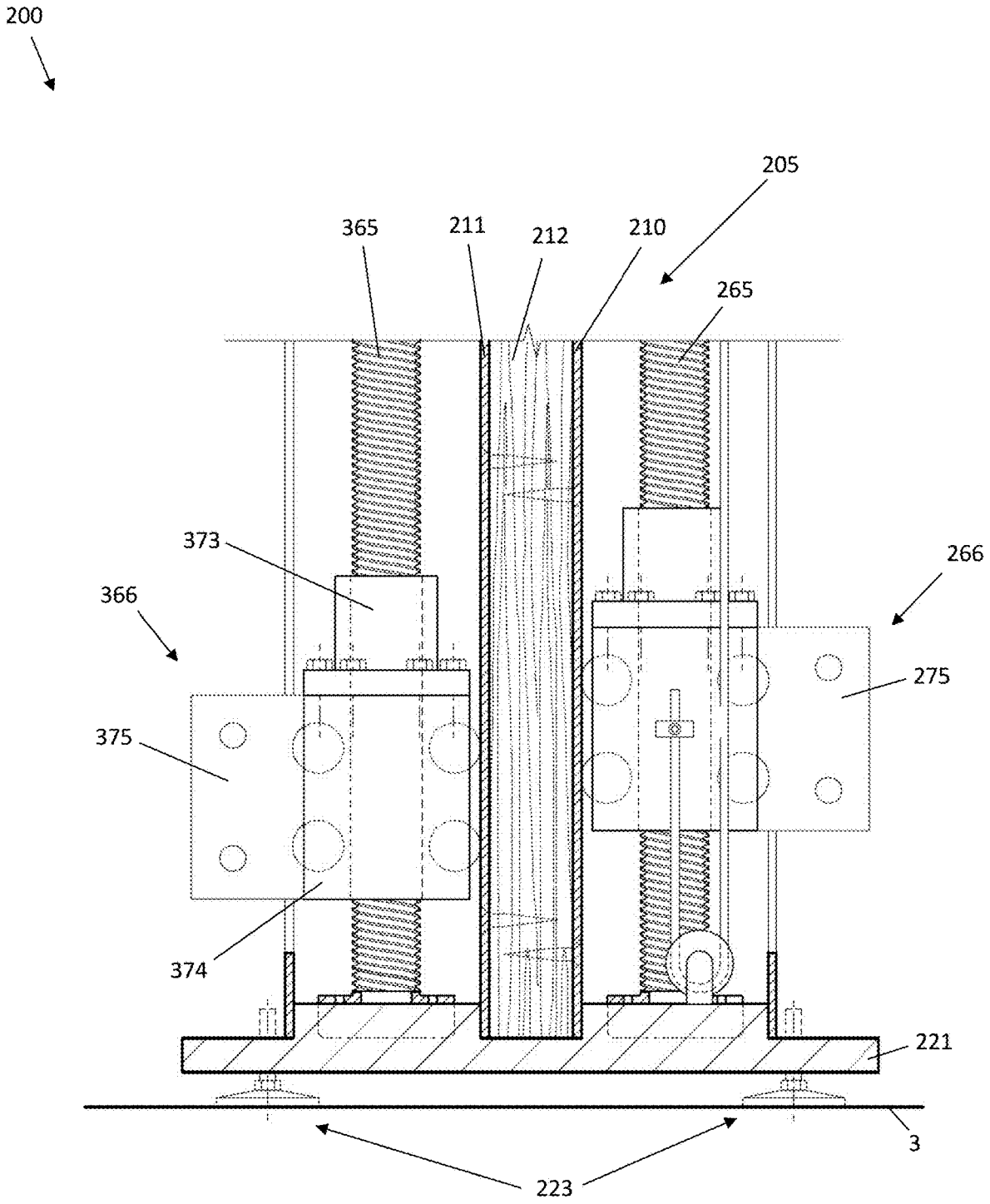
FIG. 24 depicts a profile section view of the FIG. 21 post.

Aspects of frame 201 may be independently expandable in the generally vertical direction to obtain the press fit. Posts 205, 206 may be independently expandable in a downward direction toward floor 3. Each post 205, 206 may comprise a leveling mechanism that is expandable downwardly toward floor 3. As shown in FIG. 20, for example, post 205 may be located between header 207 and a base plate 221 and post 206 may be located between header 207 and a base plate 222. As shown in FIG. 24, for example, base plate 221 may comprise raised portions that are receivable inside of tubes 210, 211 and leveling feet 223 like feet 123 described above, making base plate 221 expandable to adjust a vertical location and orientation of post 205 relative to floor 3. Base plate 222 may similarly comprise raised portions that are receivable inside of tube 214, 215 and leveling feet 224 like feet 124 described above, making base plate 122 similarly expandable to adjust a vertical location and orientation of post 206 relative to floor 3.

Figure 19:
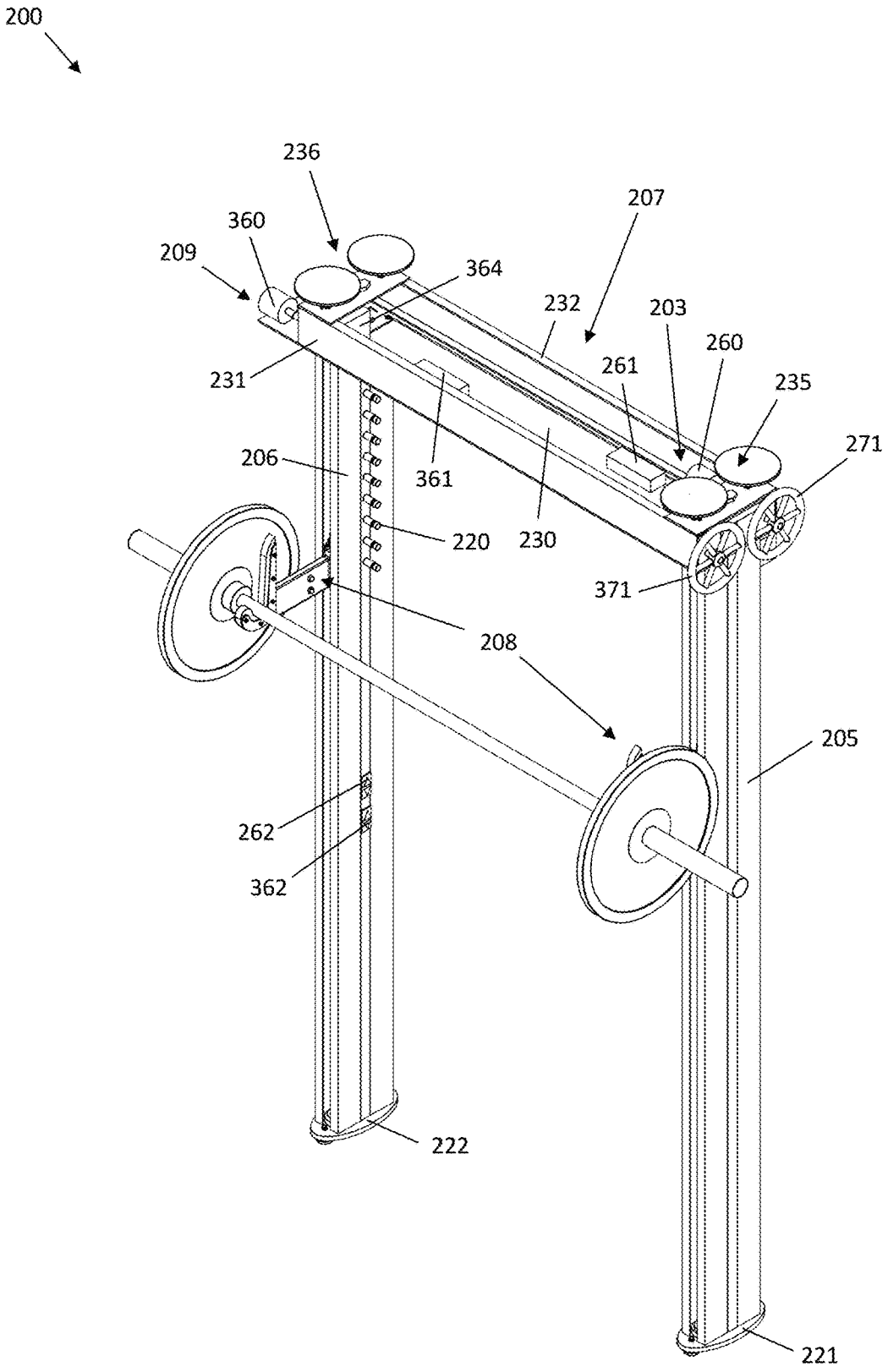
FIG. 19 depicts an assembled perspective view of a frame of the FIG. 17 workstation.

Header 207 may extend between posts 205 and 206. As shown in FIG. 19, for example, header 207 may comprise structural shapes rigidly attached to one another, like a box beam. As shown in FIGS. 19 and/or 25, for example, header 207 may comprise a header base plate 230, a C-channel 231, and a C-channel 232 that are bolted together to form a box beam spanning between post 105 and 106. Header base plate 230 may comprise a ⅜" steel plate and C-channels 231, 232 may comprise 3"×5"×¼" aluminum channels. Each end of header 207 may comprise an end plate (e.g., another ⅜" steel plate) that is rigidly attached to header base plate 230 and one of C-channels 231, 232. In keeping with FIG. 25, for example, header base plate 230 may comprise first lowered portions that are receivable inside of and rigidly attached to tubes 210, 211 and second lowered portions that are receivable inside of and rigidly attached to tubes 214, 215.

Figure 25:
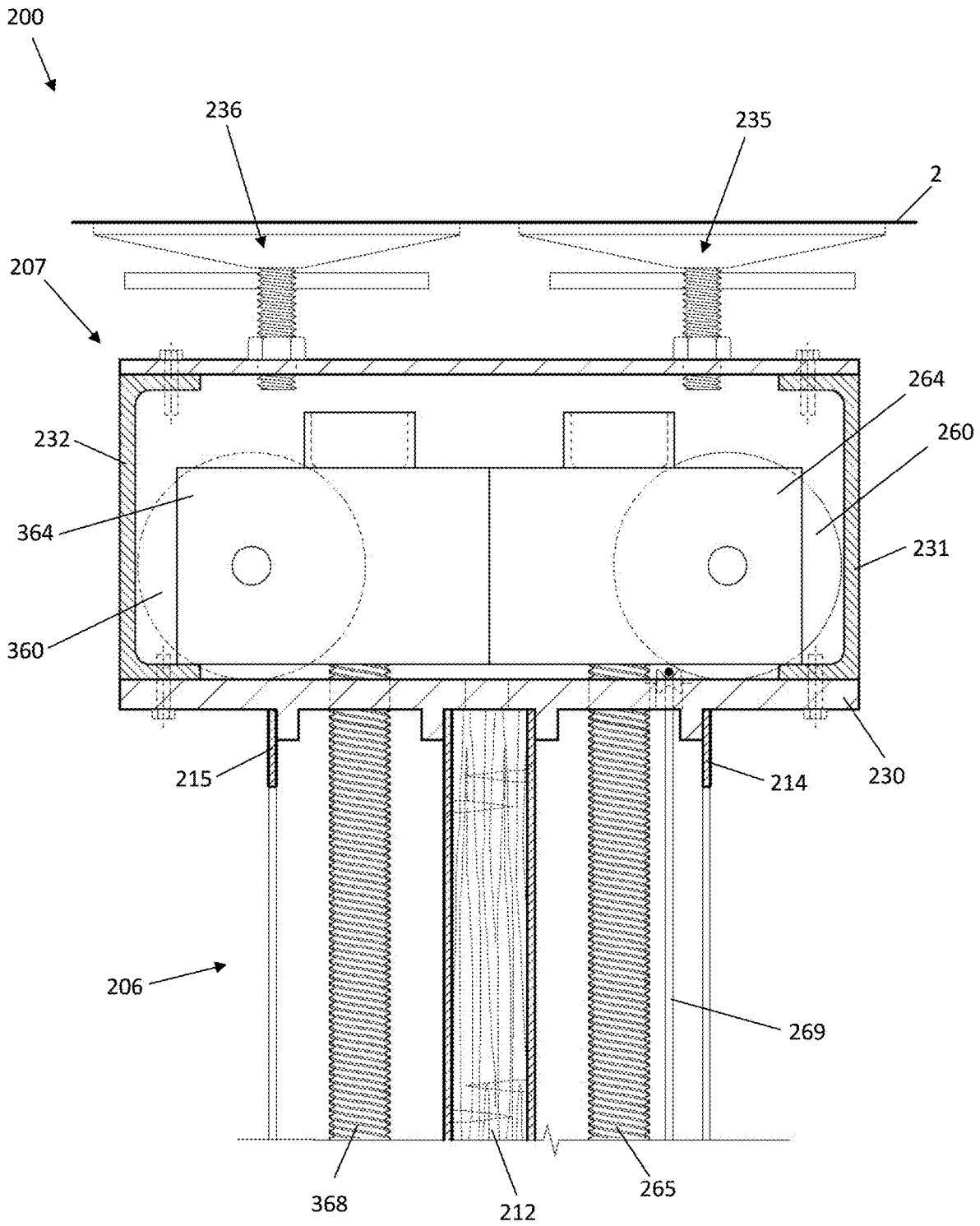
FIG. 25 depicts another profile section view of the FIG. 21 post.
Figure 26:
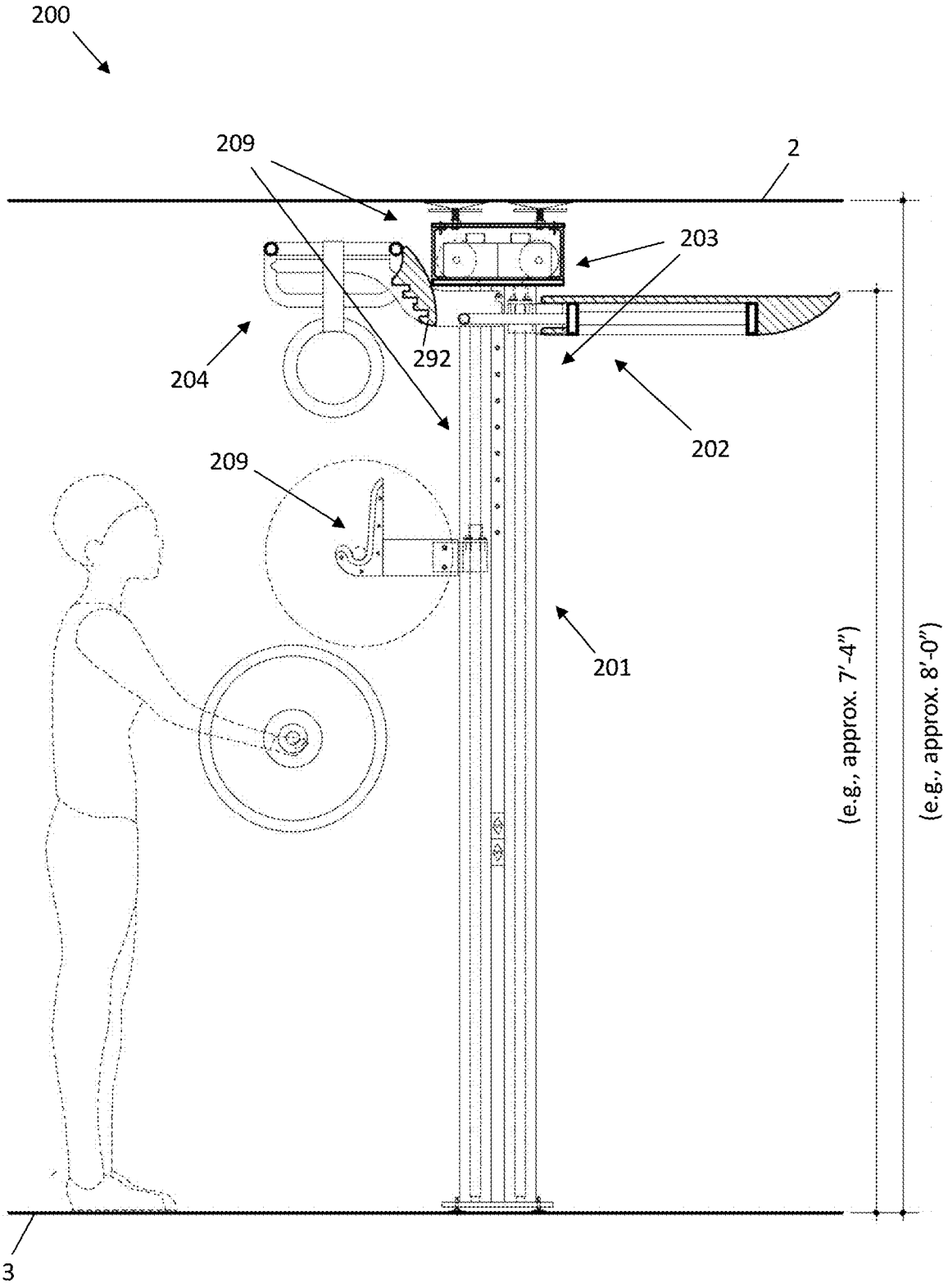
FIG. 26 depicts a section view of the FIG. 17 workstation with the work surface at a ceiling height and the equipment support at a standing height.

Aspects of header 207 may be expandable in the generally vertical direction toward ceiling 2 to obtain the press fit. As shown in FIG. 25, for example, header 207 may comprise a leveling mechanism that is vertically expandable toward ceiling 2, such as jack screws that are independently expandable toward ceiling 2. As shown in FIGS. 17, 18, and 25, for example, header 207 may comprise a pair of jack screws 235 located above post 205 at one end of header 207 and a pair of jack screws 236 located above post 206 at an opposite end of header 207. Pairs of jack screws 235, 236 may be similar to jack screws 135, 136 and thus similarly operable to adjust the vertical location and orientation of frame 201 relative to ceiling 2.

Work surface 202 may be similar or identical to work surface 102 described above. For example, aspects of work surface 102 may be similarly operable with frame 201 to support a weight of a user at each height of the plurality of different work surface heights. As a further example, work surface 202 may similarly comprise an internal frame 252, support grips 253, and movable grips 254 like their counterparts described above.

Like actuator 102, actuator 203 may comprise any combination of electrical and/or mechanical components operable to move work surface 202 within a range of movement including the plurality of different work surface heights while maintaining an orientation of work surface 202 relative to frame 201. All or portions of actuator 203 may be located inside elements of frame 201, such as inside of posts 205, 206 and/or header 207 to keep its components out of sight and harm's way. As shown in FIG. 18, for example, actuator 203 may comprise an electric motor 260, a controller 261 (e.g., operable with a control element 262), and a lift system like their counterparts described above. The lift system of actuator 203 may comprise a gear box 264, a threaded rod 265, a first actuator member 266 with a connector arm 275, a guide rod 267, a second actuator member 268 with a connector arm 278, and a cable 269 like their counterparts described above, of which gear box 264 may similarly comprise a manual crank 271 operable to cause vertical movements of work surface 202 in the event of a power outage.

Figure 23:
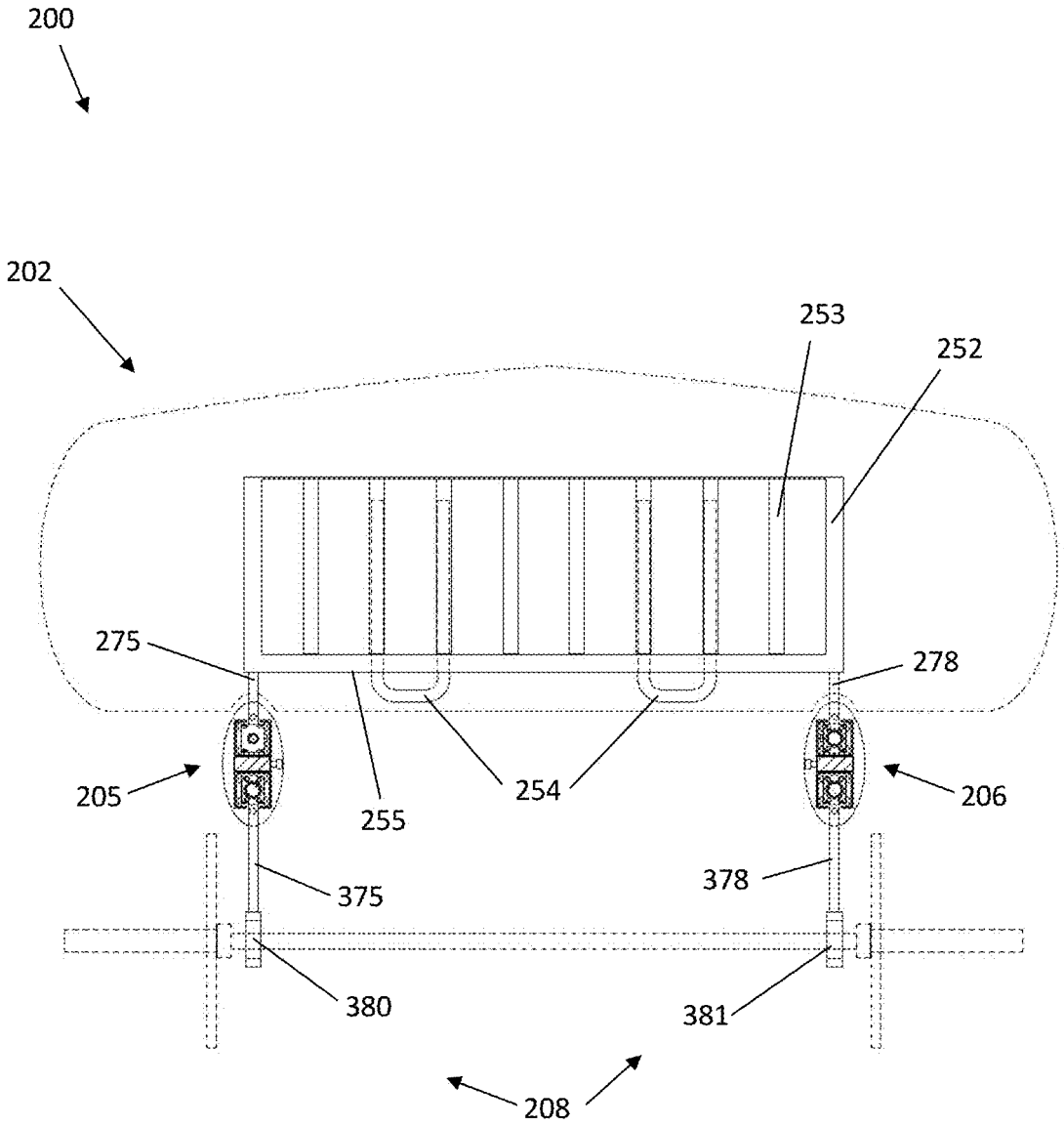
FIG. 23 depicts a bottom-up plan view of the FIG. 17 work surface.

Equipment support 208 may comprise one or more structures operable with frame 201 to support a piece of exercise equipment. As shown in FIGS. 18 and 23, for example, equipment support 208 may comprise a J-hook structure 380 and a J-hook structure 381 that are operable with actuator 209 to support a weight bar with frame 201. Equipment support 208 may be attachable to frame 221 and selectively positionable at a plurality of different equipment support heights between ceiling 2 and floor 3 when frame 201 is press fit between ceiling 2 and floor 3, allowing J-hook structures 280, 281 to be moved vertically with the piece of equipment. By way of example, the plurality of different equipment support heights may include a floor height like that shown in FIG. 13 for work surface 102, a seated height like that shown in FIG. 14 for work surface 102, a standing height like that shown in FIG. 26, and a ceiling height like that shown in FIG. 16 for work surface 102, in each of which the depicted person may be of average height.

Much like actuator 203, actuator 209 may comprise any combination of electrical and/or mechanical components operable to move equipment support 208 within a range of movement including the plurality of different equipment support heights while maintaining an orientation of equipment support 208 relative to frame 201. Aspects of actuator 209 may be similar to actuator 203 with select modifications to accommodate for the possibility of heavier structural loads being applied by the piece of exercise equipment, such as those applied when dropping the weight bar into J-hook structures during a vigorous workout. All or portions of actuator 209 may be located inside elements of frame 201, such as inside of posts 205, 206 and/or header 207 to keep its components out of sight and harm's way. As shown in FIG. 18, for example, actuator 209 may comprise an electric motor 360 that is located outside of header 207 and supported by an extension of header base plate 230 and similarly operable with frame 201 to move equipment support 208 within the range of movement including the plurality of different equipment support heights. Electric motor 360 may be similar to or more powerful than electric motors 160, 260.

As shown in FIG. 18, for example, actuator 209 may comprise a controller 361 that is located in header 207 with controller 261 and electronically operable with electric motor 360 to move equipment support 208. Controller 361 may be electronically operable with electric motor 360 responsive to one or more of a switch, a timer, a sensor, a program, and a computing device, any of which may be part of computer 4 or controller 261, 361 (e.g., FIG. 18), a control element 262, 362 (e.g., FIG. 17), and/or an external control device in communication therewith over a wired or wireless connection, such as a mobile phone with a WiFi connection to controller 261, 361 rendering workstation 200 operable with an application on the mobile phone.

Actuator 209 may comprise a lift system comprising mechanical components operable to generate an input torque sufficient to move equipment support 208. The lift system may be operable with frame 201 and an input torque applied by electric motor 360 to move equipment support 208 within the range of movement including the plurality of different equipment support heights, while maintaining an orientation of equipment support 208 relative to frame 201. Portions of the lift system may be located in frame 201, such as in post 205, post 206, and/or header 207, to keep them out of harm's way. As shown in FIG. 18, for example, the lift system may comprise a gear box 364, a threaded rod 365, a first actuator member 366, a gear box 367, a threaded rod 368, and a second actuator member 369.

Gear boxes 364, 367 may be located in header 207 and operable to cause the vertical movements of equipment support 208. As shown in FIG. 20, for example, electric motor 360 may comprise an output shaft 370 extending into and through header 207 and gear boxes 364, 367. As shown in FIGS. 19 and 20, for example, a manual crank 371 may be located outside of header 207, attached to output shaft 370, and operable to cause vertical movements of equipment support 208. In the event of a power outage, manual crank 371 may thus be manually operable to cause vertical movements of equipment support 208 without electricity.

As shown in FIG. 18, for example, threaded rod 365 may be rotatably mounted and vertically fixed in post 205 between gear box 364 and a lower rotational bearing located on base plate 221 (e.g., FIG. 24). Threaded rod 368 may similarly be rotatably mounted and vertically fixed in post 206 between gear box 367 and a lower rotational bearing located on base plate 222 (e.g., FIG. 18). Threaded rods 365, 368 may comprise 30 mm leadscrews with exterior threads. Drive gears located in gear boxes 364, 367 (e.g., FIG. 20) may be operable with an input torque applied by output shaft 370 to rotate threaded rods 365, 368 in a clockwise or counterclockwise direction within posts 205, 206. As shown in FIGS. 18, 19, and/or 20, for example, first actuator member 366 may be located in post 205 and operably attached to threaded rod 365 and equipment support 208 and second actuator member 369 may be located in post 206 and operably attached to threaded rod 368 and equipment support 208 so that rotation of threaded rods 365, 368 with the input torque causes vertical movements of equipment support 208.

As shown in FIG. 21, for example, first actuator member 366 may comprise a lifting nut 373, a guide track 374, and a connector arm 375. As shown in FIG. 22, for example, second actuator member 369 may similarly comprise a lifting nut 376, a guide track 377, and a connector arm 378. Lifting nuts 373, 376 may comprise internal threads operable with the external threads of threaded rods 365, 368 to cause the vertical movements of equipment support 208 when threaded rods 365, 368 are rotated, stabilize equipment support 208 during the vertical movements, and maintain a vertical position of equipment support 208 when threaded rods 365, 368 are not rotated. Lifting nuts 373, 376 may comprise circular bronze structures with internal threads. Guide tracks 374, 377 may comprise machined stainless-steel rectangular structures that are rigidly attached to lifting nuts 373, 376 and comprise wheels (e.g., nylon rollers) that act on interior surfaces of tubes 211, 215 to stabilize equipment support 208 during vertical movements thereof. As shown in FIG. 24, for example, guide track 374 of first actuator member 366 may be operable to position the wheels against the interior surfaces of tube 211 so that exterior surfaces of the wheels remain in contact therewith. In keeping with FIG. 22, for example, guide track 377 of second actuator member 269 may be operable to position the wheels against the interior surfaces of tube 215 so that exterior surfaces of the wheels remain in contact therewith.

Connector arms 375, 378 may be rigidly attached to guide tracks 374, 377. As shown in FIG. 19, for example, posts 205, 206 may comprise elongated openings extending in the generally vertical direction. Connector arm 375, 378 may extend outwardly from guide tracks 374, 377 through their respective elongated openings to vertically support equipment support 208. As shown in FIGS. 21, 22, and/or 23, for example, connector arms 375, 378 may be rigidly attached to a portion of equipment support 208, such as J-hook structures 380, 381, to transfer shear and moment forces from equipment support 208, to guide tracks 374, 377 and back to post 205, 206 with the wheels of guide tracks 374, 377.

Overhead element 204 may be similar or identical to overhead element 104 described above. As shown in FIG. 18, for example, overhead element 204 may be similarly comprise a pull-up bar 290, monkey bars 291, finger grips 292 (e.g., FIG. 26), a support leg 292, and a support leg 293 like their counterparts described above. As a further example, overhead element 204 may similarly be removably attached to frame 201 at a plurality of different heights, making it adjustable to accommodate different users and/or removable when not in use.

Operational aspects of workstation 200 may be similar to those of operational 100, meaning that workstation 200 may be assembled and installed using methods like those described above with reference to workstation 100. After which, aspects of actuator 203 (e.g., either electric motor 260 or manual crank 271) may be operable to move work surface 202 in a generally vertical direction from the floor height to the seated height, from the seated height to the standing height, from the standing height to the ceiling height, and vice versa, all while maintaining a generally horizontal orientation of work surface 202 relative to frame 201; and/or aspects of actuator 209 (e.g., either electric motor 360 or manual crank 371) may be operable to move equipment support 208 in a generally vertical direction from the floor height to the seated height, from the seated height to the standing height, from the standing height to the ceiling height, and vice versa, all while maintaining a generally horizontal orientation of equipment support 208 relative to frame 201.

As described herein, actuators 203 and/or 209 may be electronically or manually operable to move work surface 202 and/or equipment support 208 by independently rotating threaded rods 265 and/or 365, 368, causing their respective threads to interact with corresponding threads of the lifting nuts first actuator member 266 and/or lifting nuts 373, 376 and move actuator members 166 and/or 366, 369. Each of these threaded interactions may, turn-by-turn, incrementally move actuators 266, 268 and/or 366, 369 in a generally vertical direction, upwardly or downwardly, at approximately the same time, in a smooth and controlled manner so that workstation 200 may be adjusted as needed for a desired use.

Figure 27:
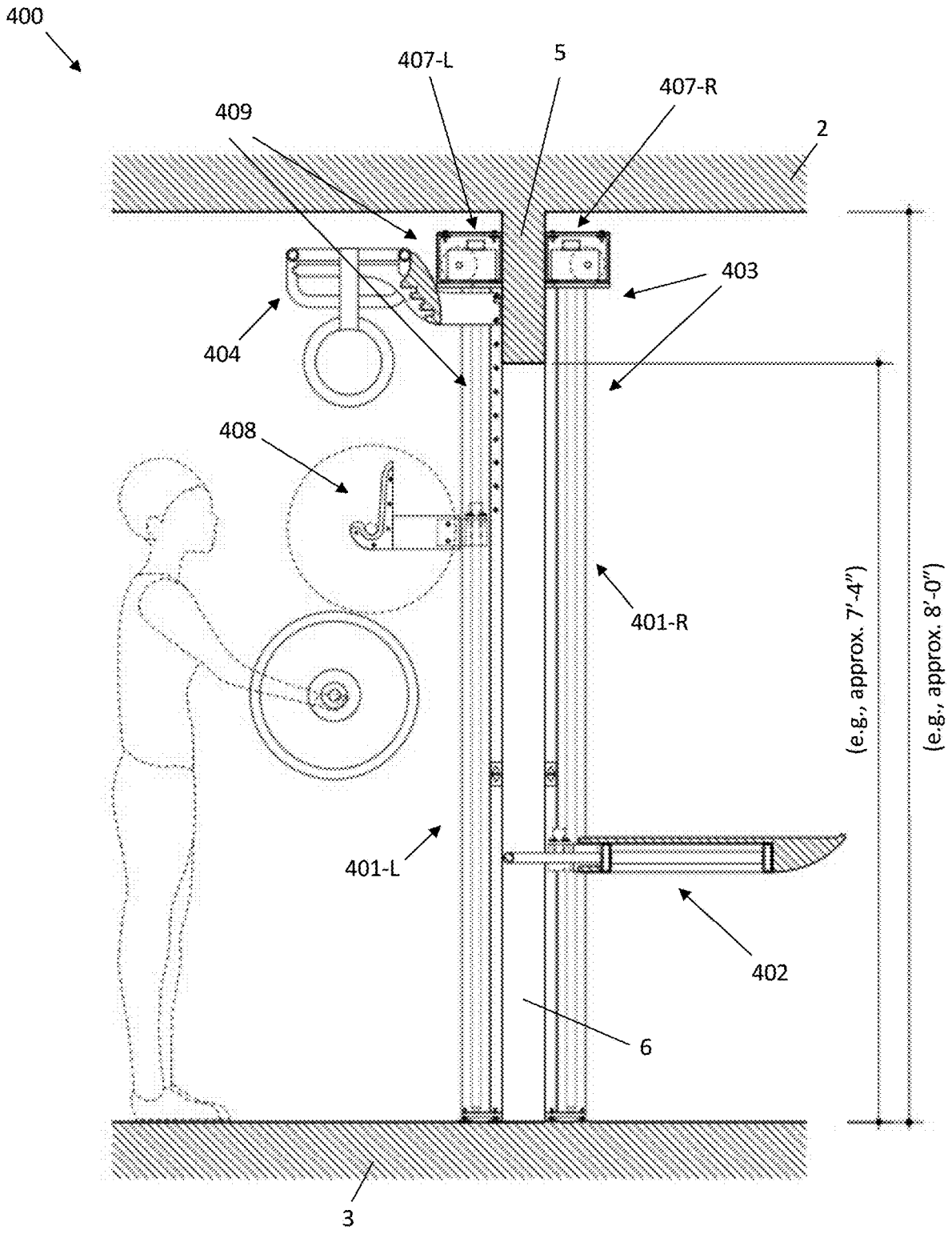
FIG. 27 depicts a section view of an exemplary workstation with a work surface at a seated height and an equipment support at a standing height.
Figure 28:
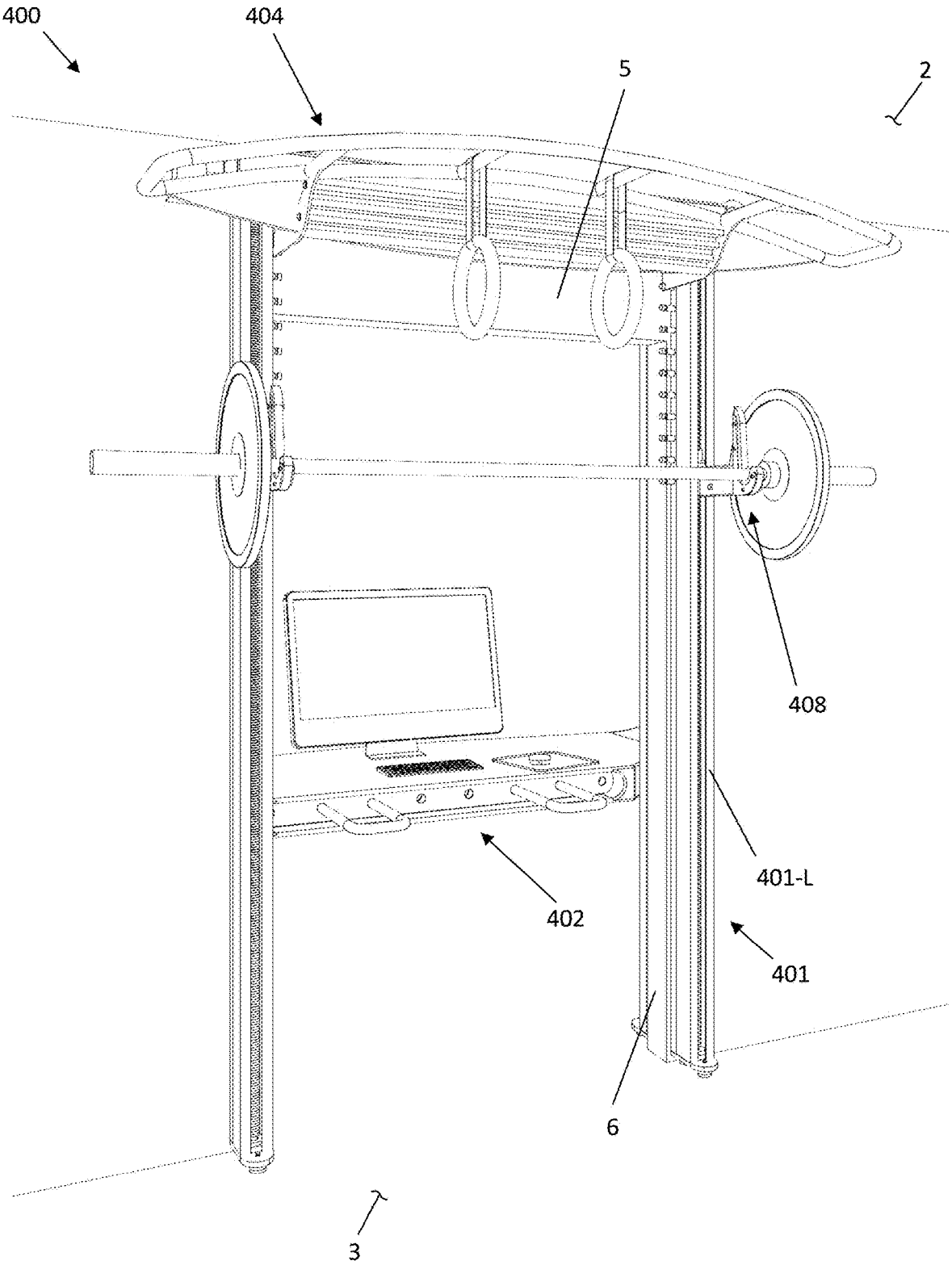
FIG. 28 depicts a perspective view of the FIG. 27 workstation integrated into a door frame.
Figure 29:
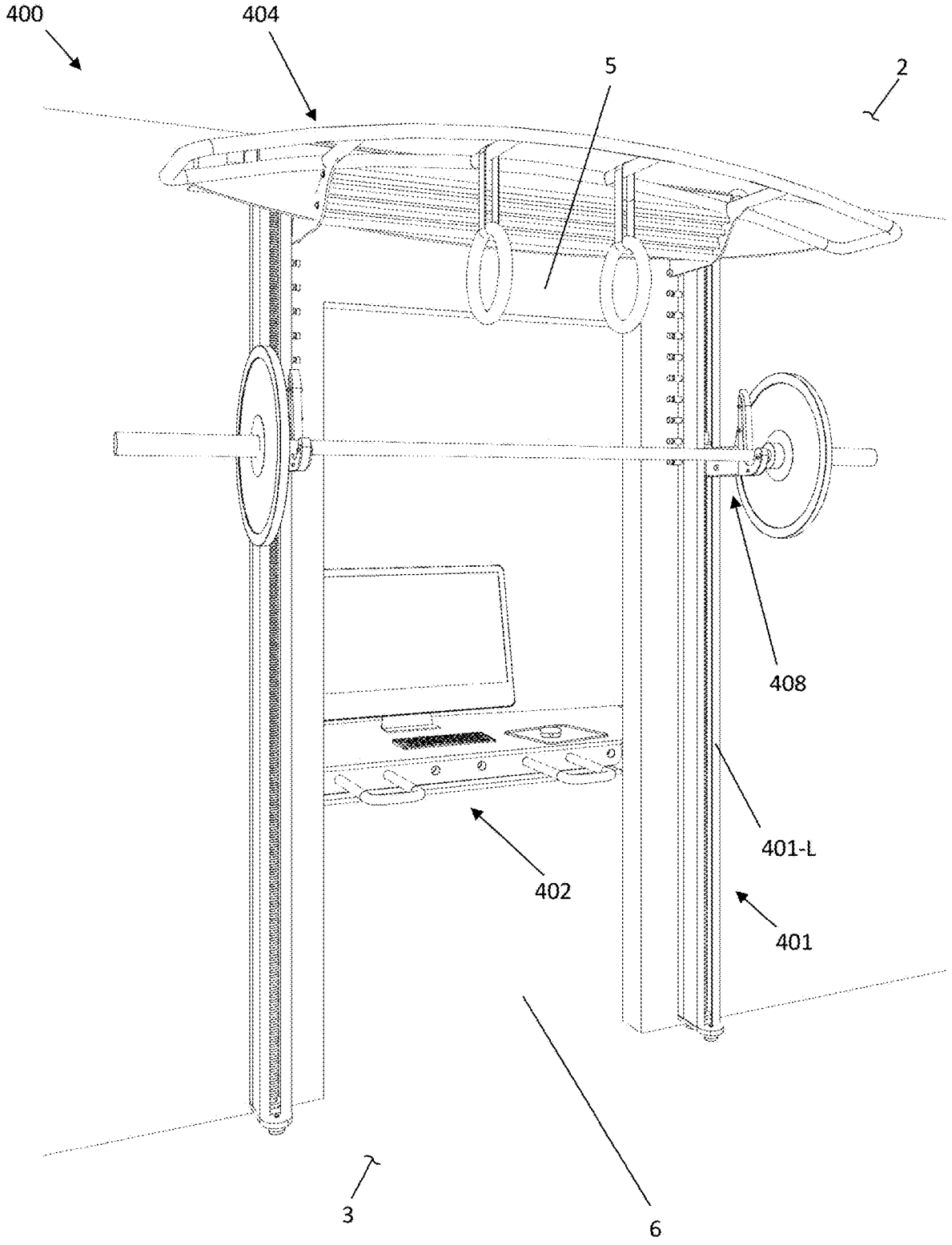
FIG. 29 depicts a perspective view of the FIG. 27 workstation integrated into a wall surrounding a door frame.

As shown in FIGS. 27 to 29, for example, workstation 400 may comprise a frame 401, a work surface 402, an actuator 403, an overhead element 404, an equipment support 408, and an actuator 409 like their counterparts described above. In contrast to workstations 100 and 200 described above, aspects of workstation 400 may be integrated directly into a portion of a building in order to leverage existing structural and/or electrical systems of the building, a feature that may be particularly desirable for some types of construction, such as wood framed buildings.

As shown in FIG. 27, for example, workstation 400 may comprise a bifurcated frame comprising a first or left frame half 401-L that is integrated into a left side of a door frame 6 and a second or right frame half 401-R is integrated into a right side of door frame 6. In this example, frame half 401-L may comprise overhead element 404, equipment support 408, and actuator 409; and frame half 401-R may comprise work surface 402 and actuator 403. Instead of a single box beam header, frame half 401-L may comprise a first or left header 407-L that is rigidly attached to a left side of a wall 5 surrounding door frame 6 and frame half 401-R may comprise a second or right header 407-R that is rigidly attached to a right side of wall 5 surrounding door frame 6. The bottom portions of frame halves 407-L, 407-R may be rigidly attached to floor 3 with leveling mechanisms like those described above, making it easy to square 407-L, 407-R with wall 5 before rigidly attaching their respective headers 407-L, 407-R.

As shown in FIG. 28, for example, door frame 6 may comprise a metal structure (e.g., a steel frame) that is packaged together with workstation 400 as part of an upgrade kit that may be ideal for new construction projects, in which frame halves 407-L, 407-R may be rigidly attached to door frame 6 and/or installed together therewith. As shown in FIG. 29, for example, workstation 400 may be part of a remodel kit that is installed independently of door frame 6 (e.g., much later), in which frame halves 407-L, 407-R may be rigidly attached to one or more portions of wall 5 surrounding door frame 6. Either way, the various features of work surface 402, overhead element 404, and equipment support 408 described above may be fully utilized without damaging wall 5 or door frame 6. As further shown in FIGS. 28 and 29, for example, installing workstation 400 in front of door frame 6 may be desirable in small living spaces, like those found in big cities, because it allows for conversion of door frame 6 from a mere passageway into a multifunction workspace and/or an exercise space that can be adjusted to accommodate the needs of a particular user and put away when not in use, converting door frame 6 back into a passageway by lifting work surface 402 and exercise support 408 up and out of the way with actuators 403 and 409.

Although shown as being part of one kit, it is contemplated that workstation 400 may be sold as a first kit comprising frame half 401-L and a second kit comprising frame half 401-R, making it possible to convert door frame 6 into either a workspace or an exercise space, allowing for independent and/or incremental enhancements. Moreover, although described with reference to door frame 6, it is completed that workstation 400 also may be part of a window frame kit for upgrade or remodel that functions in substantially the same way as depicted in FIGS. 27 to 29 and described in relation thereto. In complement to above, for small living spaces, this alternative kit may be used to enhance high value spaces like a bathroom or kitchen that may otherwise be deprived of usable square footage absent the functionality afforded by workstation 400.

Figure 30:
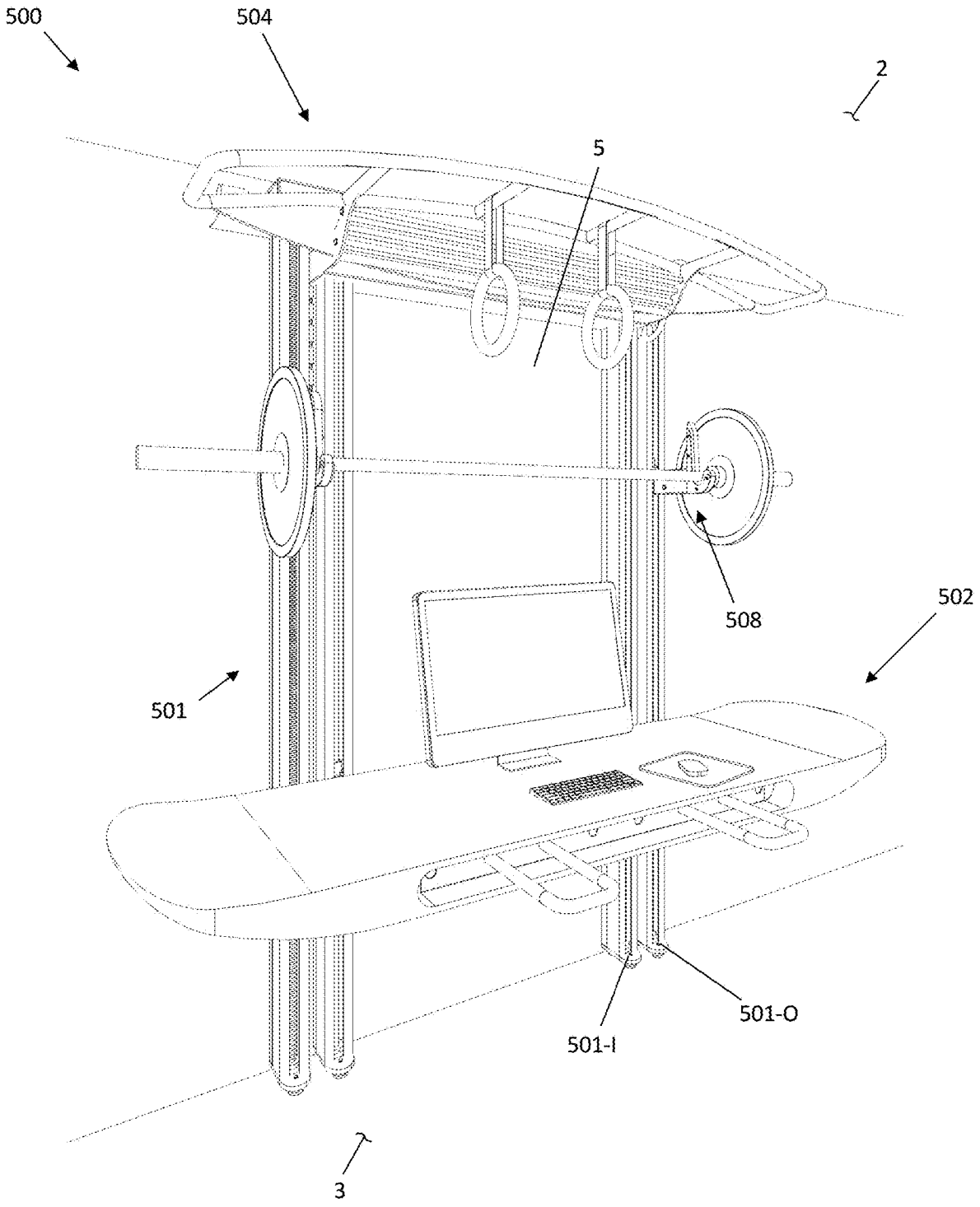
FIG. 30 depicts a perspective view of an exemplary workstation integrated into a wall with a work surface at a seated height and an equipment support at a standing height.

As shown in FIG. 30 for example, workstation 500 may comprise a frame 501, a work surface 502, an actuator 503, an overhead element 504, an equipment support 508, and an actuator 509 like their counterparts described above. Like workstation 400, aspects of workstation 400 may be integrated directly into a portion of building, such as concrete or wood frame wall 5. In contrast to workstations 100, 200, and 400, aspects of workstation 500 may be located on the same side of wall 5 to reduce a footprint of workstation 500. As shown in FIG. 30, for example, frame 501 may comprise a first or outer frame half 501-O that is rigidly attached to an outer perimeter of wall 5 and a second or inner frame half 501-I that is rigidly attached to an inner perimeter of wall 5. In this example, frame halves 501-O and 501-I may be assembled and installed separately in a stages to ensure proper attachment to wall 5.

As shown in FIG. 30, for example, frame half 501-O may comprise equipment support 508 and an actuator 509 and frame half 501-I may comprise work surface 502 and an actuator 503, allowing for independent movements of work surface 502 and equipment support 508. As shown in FIG. 30, for example, pegs (e.g., like pegs 119, 120 of workstation 100) may be located between frame halves 401-O and 401-I so that support legs of overhead element 404 may be located between frame halves 401-O and 401-I and further stabilized thereby. Aspects of work surface 502 and/or equipment support 508 may be modified to allow for vertical passage. For example, equipment support 508 may comprise foldable J-hook structures (e.g., like J-hook structures 380, 381 of workstation 200) and/or work surface 502 may comprise corresponding cut outs, making it possible to move work surface 502 vertically past equipment support 508 and vice versa.

Although shown as being part of one kit, it is contemplated that workstation 500 also may be sold as a first kit comprising frame half 501-O and a second kit comprising frame half 501-I, making it possible to convert wall 5 into either a workspace or an exercise space, allowing for independent and/or incremental enhancements. Moreover, although described with reference to wall 5, it is completed that workstation 500 also may part of a door or window frame kit for upgrade or remodel that functions in substantially the same way as depicted in FIGS. 27 to 29 and described in relation thereto. In complement to above, for small living spaces, this alternative kit may advantageously be used to free up additional floor space when workstation 500 is not in use.

Figure 31:
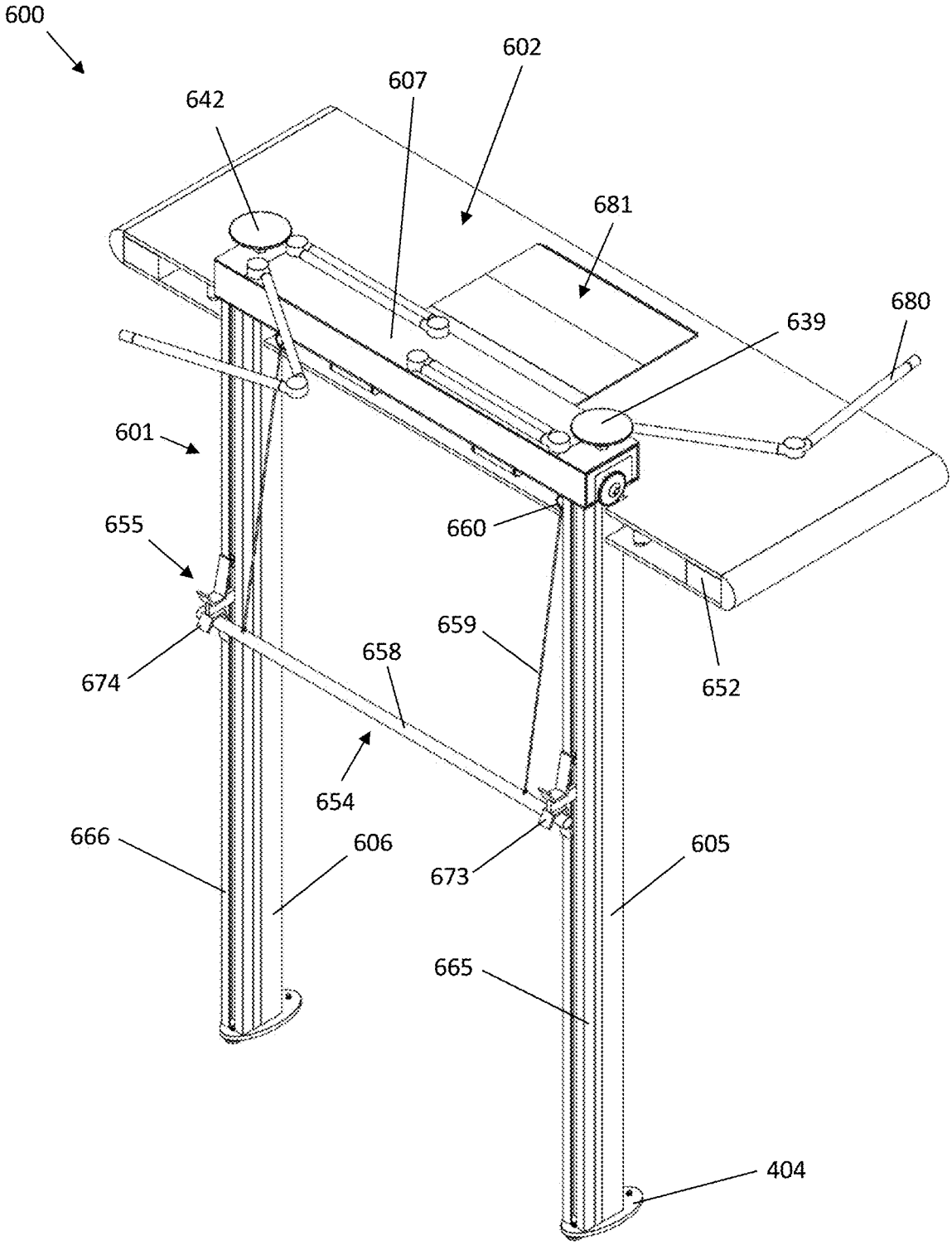
FIG. 31 depicts a perspective view of an exemplary workstation with frame, a work surface that is selectively movable relative to the frame between a plurality of different work surface heights, an equipment support that is selectively movable relative to the frame between a plurality of different equipment support heights, and a plurality of mounting arms, in which the work surface is at a ceiling height and the equipment support is at a standing height.

As shown in FIG. 31, for example, workstation 600 may similarly comprise a work surface that is adjustable between an extended range of positions including a floor height, a seated height, a standing height, and a ceiling height (e.g., like work surface 102 described above); and an equipment support that is adjustable between an extended range of positions including a floor height, a seated height, a standing height, and a ceiling height. As shown in FIGS. 31 and/or 32, for example, workstation 600 may comprise a frame 601, a work surface 602, an internal frame 652, movable grips 653, a resistance training system 654, and an equipment support 655.

Frame 601 may be similar or identical to frame 101, 201 described above, with exception for the differences noted below. As shown in FIG. 31, for example, frame 601 may comprise a post 605, a post 606, and a header 607 like those of frame 101, 201. Work surface 602 may be similar or identical to work surface 102, 202 described above. For example, aspects of work surface 602 may be similarly operable with frame 601 and internal frame 652 to support weight at each height of the plurality of different work surface heights.

Figure 32:
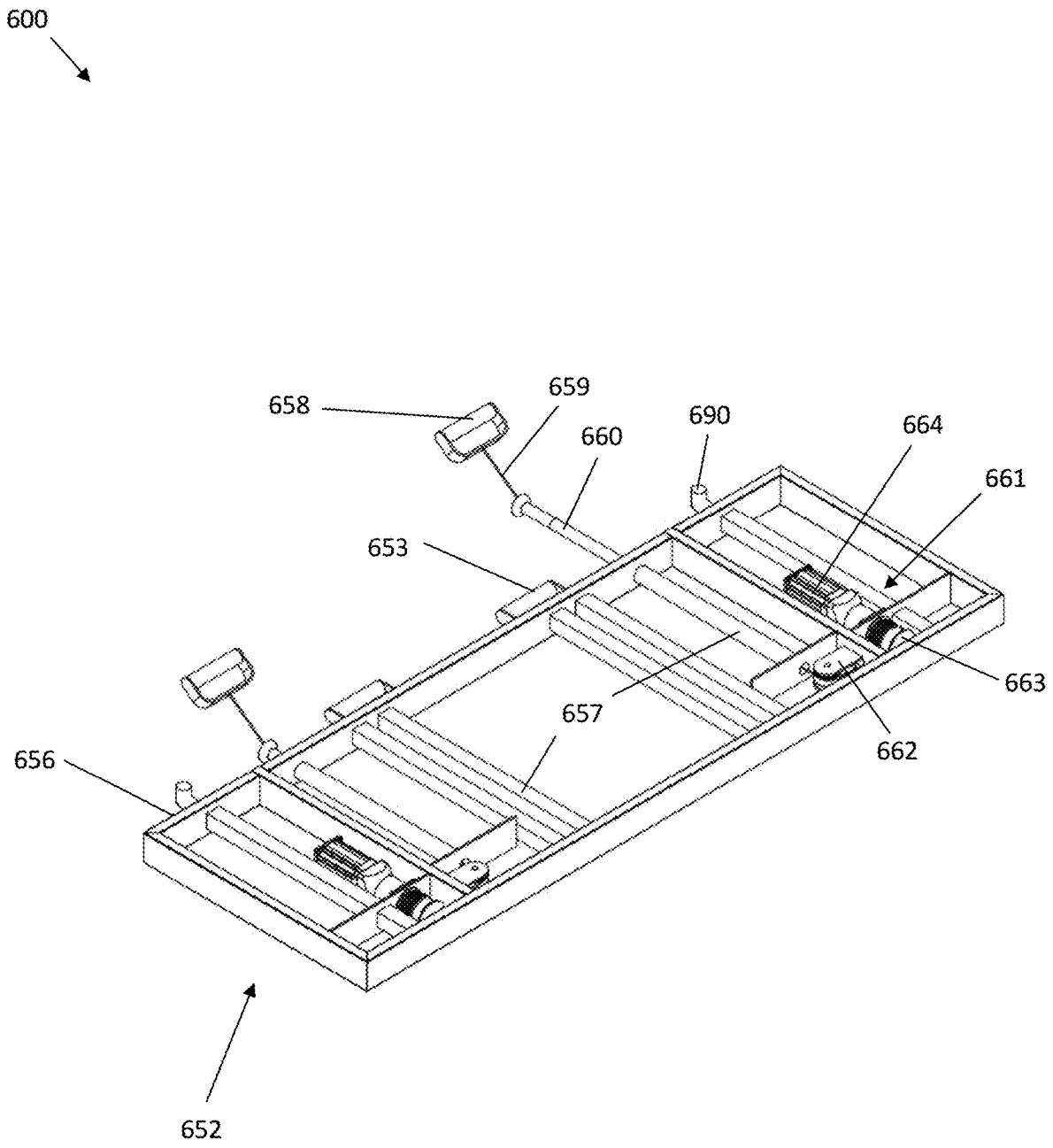
FIG. 32 depicts a perspective view of an exemplary internal frame for an exemplary workstation.
Figure 33:
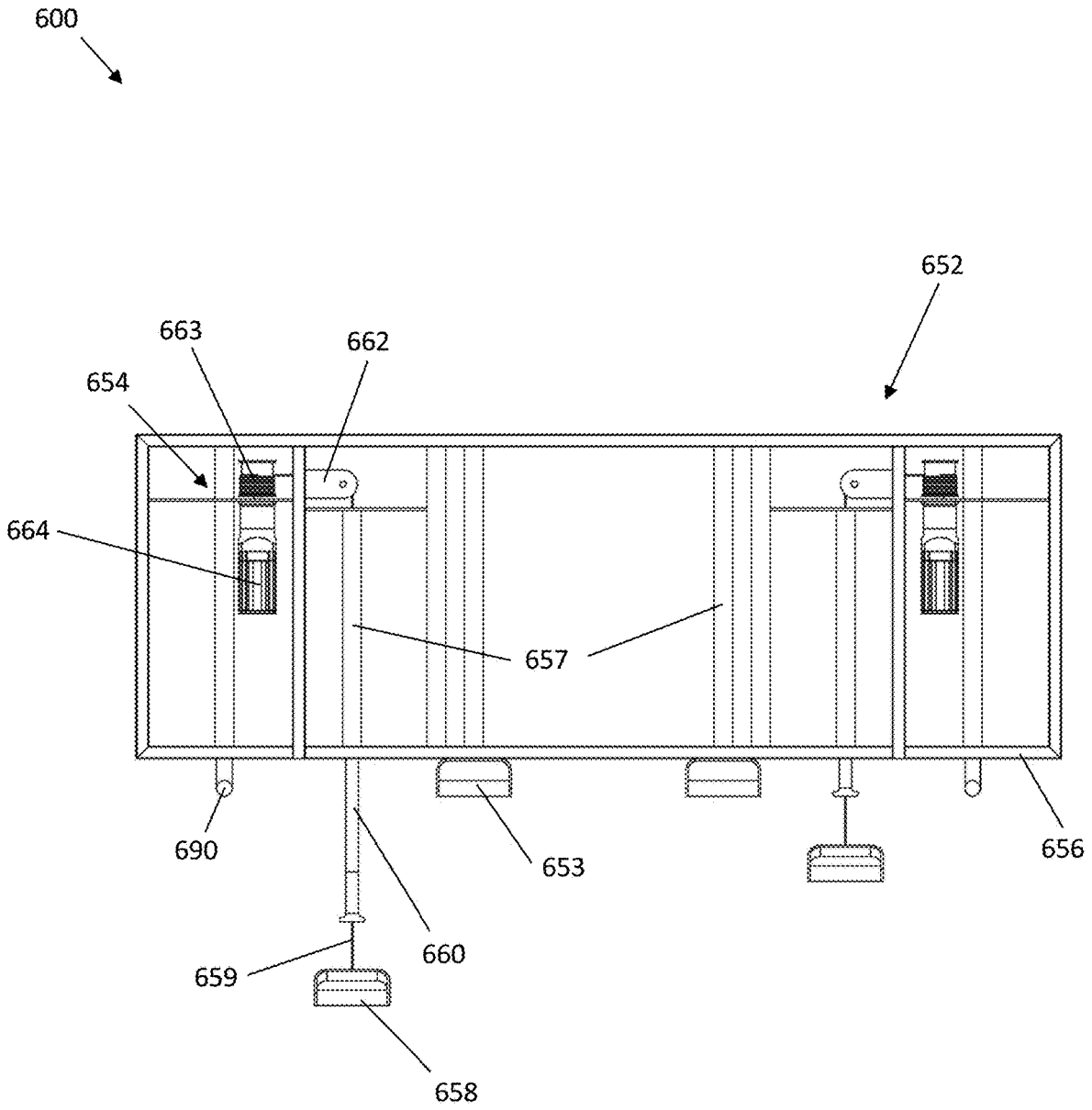
FIG. 33 depicts a top-down view of the FIG. 32 internal frame.

Internal frame 652 may be similar to internal frame 152 and uniquely configured for workstation 600. Like frame 152, internal frame 652 also may comprise a box frame structure formed by plurality of structural steel shapes that are arranged into a rectangular shape and rigidly attached to one another via bolting or welding. As shown in FIGS. 31, 32 and 33, for example, three sides of internal frame 652 may be embedded into work surface 602 and a side 656 of frame 652 may be offset from an outer perimeter of work surface 602. Similar to side 155 of frame 152, side 656 may comprise holes and internal frame 652 may comprise tubes 657 that are inserted into the holes and rigidly attached to internal frame 652, resulting in lumens extending into work surface 602.

Moveable grips 653 may be selectively moveable relative to internal frame 652. As shown in FIGS. 32 and 33, for example, some tubes 657 and their respective lumens may have square cross-sectional shapes and each moveable grip 653 may comprise a palm grip with a square grip shaft extending outwardly therefrom. Like support grips 153 described above, each grip shaft of each grip 653 may be received in one of the lumens, allowing the grip shafts to both support the weight of a user and be slid back and forth inside tubes 657. Moveable grips 653 may thus be moveable independent of work surface 602 in a generally horizontal direction between a plurality of different grip positions including a working position where they are spaced apart from the desk and operable to support a weight of a user (e.g., like FIG. 11) and a stored position where they are adjacent the desk frame (e.g., as in FIG. 32). The grip portion of moveable grips 653 may be hidden under work surface 602 and similarly operable to support the weight of the user when in the stored position.

Figure 34:
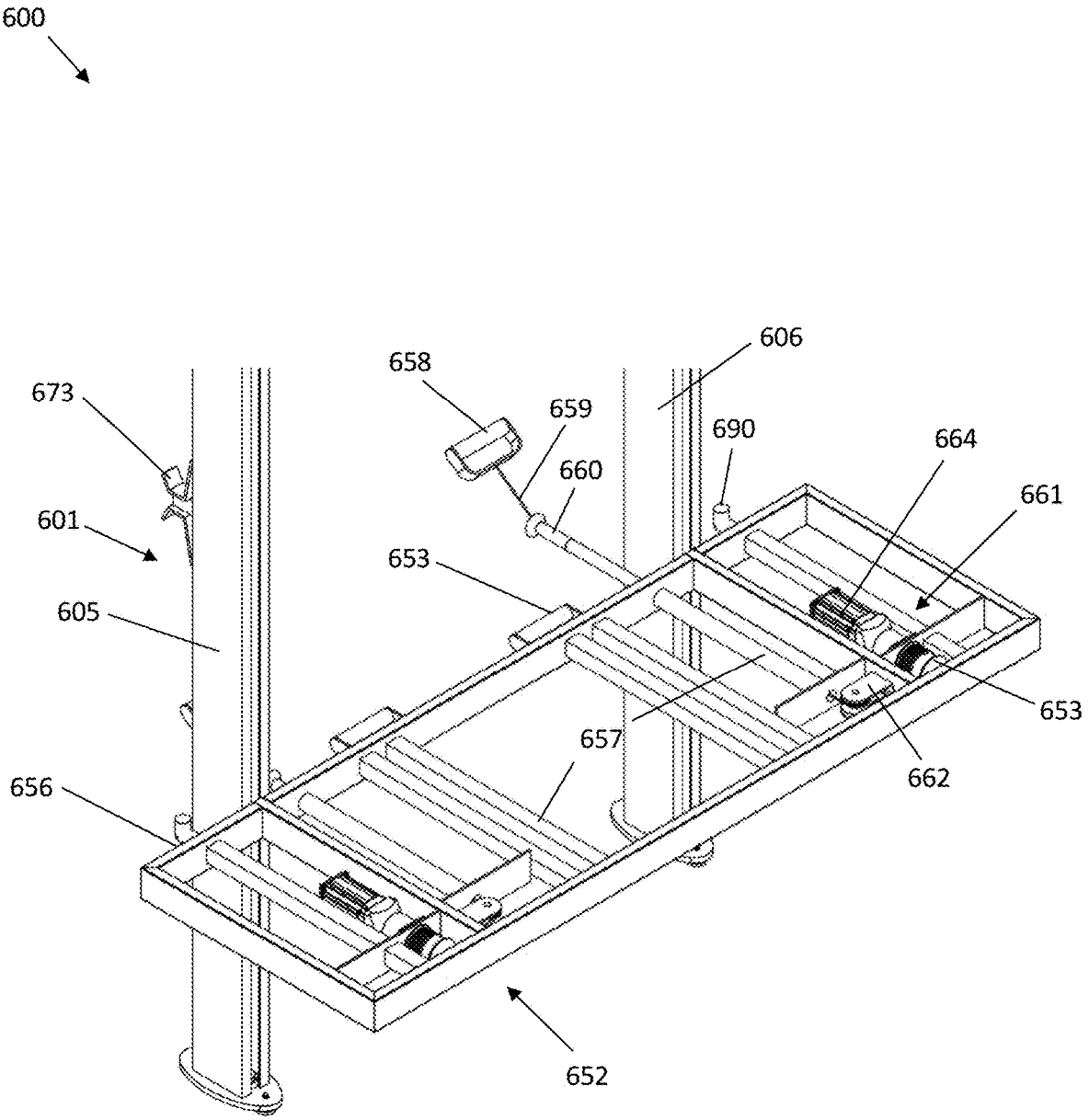
FIG. 34 depicts a perspective view of the FIG. 32 internal frame attached to exemplary posts.

As shown in FIGS. 32, 33, and 34, for example, resistance training system 654 may comprise one or more of an exercise grip 658, a cable 659, a cable guide 660, and a resistance device 661. Each exercise grip 658 may comprise a palm grip and be attached to one or both of cables 659. As shown in FIGS. 32 and 33, for example, two of steel tubes 657 and their respective lumens may have circular cross-sectional shapes and each cable guide 660 may a circular shaft extending outwardly therefrom. Like moveable grips 653 described above, each circular shaft of each cable guide 660 may be received in one of the lumens, allowing cable guides 660 to be slid back and forth inside tubes 657. Each cable guide 660 may define a cable guide lumen and be slidably mounted in the lumen of one of tubes 657. Cable 659 may be routed through the cable guide lumen. Cable guides 660 may thus be moveable independent of work surface 602 in a generally horizontal direction between a plurality of different grip positions including a first position where cable 659 exits the cable guide lumen at a first location spaced apart from internal frame 652 and a second position where cable 659 exits the cable guide lumen at a second location adjacent frame 652. Put another way, the plurality of different grip positions may include a working position where exercise grip(s) 658 are spaced apart from the desk and operable transfer a pulling force applied thereto by a user back to resistance device 661 via cable(s) 659 (e.g., at left in FIG. 32) and a stored position where exercise grip(s) 658 are adjacent the desk frame and yet similarly operable to transfer the pulling force back to resistance device 661 via cable(s) 659 (e.g., at right in FIG. 32).

Resistance device 661 may be operable to apply a resistance force to cables 659 when they are pulled by the user during a workout. Different types of electronic (e.g., motors) and/or manual (e.g., tension bands) components may be used to apply the resistance force. By way of example, resistance device 661 may operate similar to a counter-balanced Smith machine or similar device.

As shown in FIGS. 32 and 33, for example, resistance device 661 may comprise a pulley 662, a spool 663, and an electric motor 664. Each cable 659 may extend from an anchor point on spool 663, around spool 663, through pulley 662, and into one of cable guides 660 before terminating at one or more exercise grips 658, each of which may an eyelet or other quick-release mechanism for attachment to cable 659. In this configuration, each electronic motor 664 may be operable to apply the resistance force when a user pulls on one of handle grips 658 during a workout.

Figure 35:
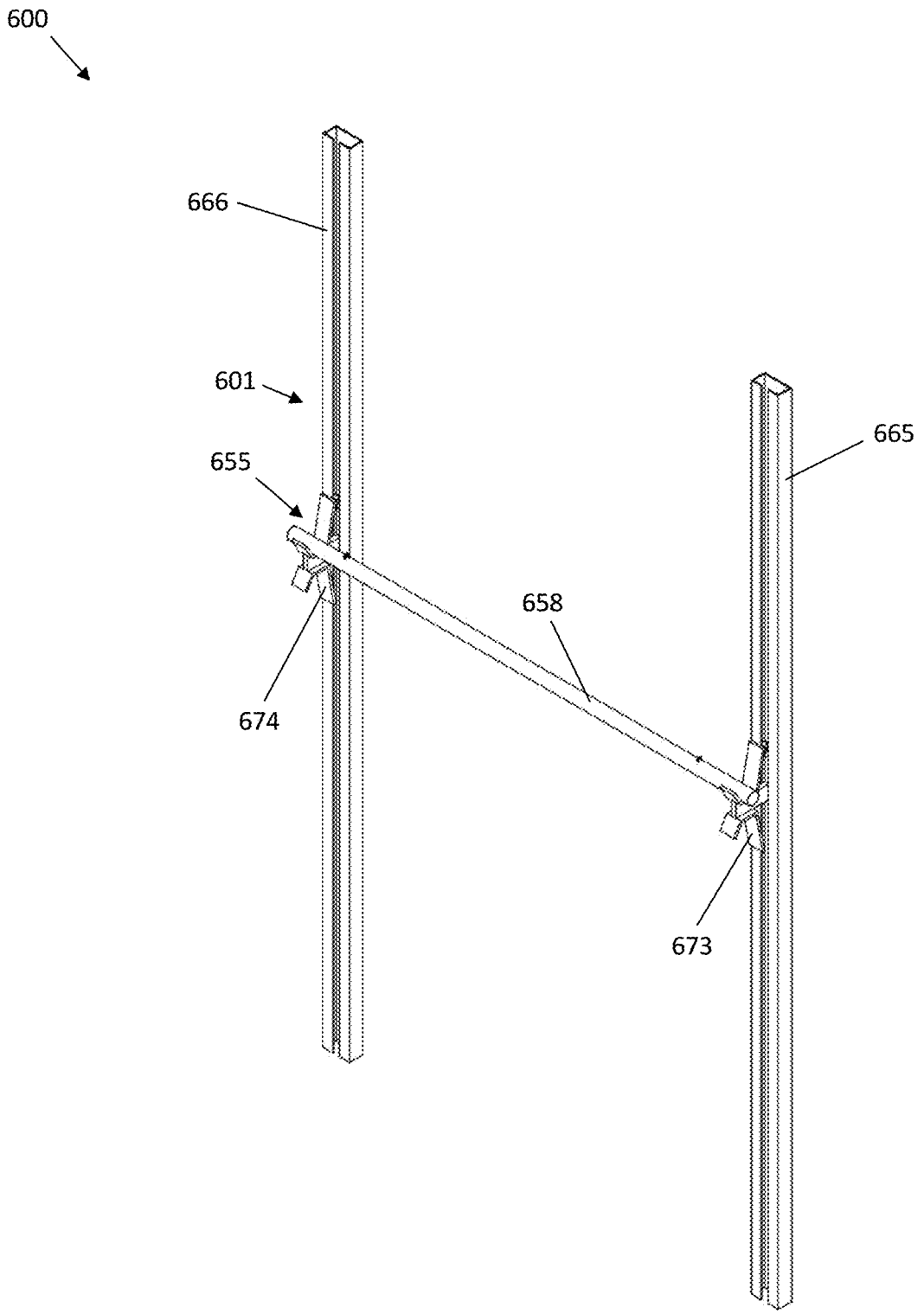
FIG. 35 depicts exemplary tracks for the FIG. 31 frame.
Figure 36:
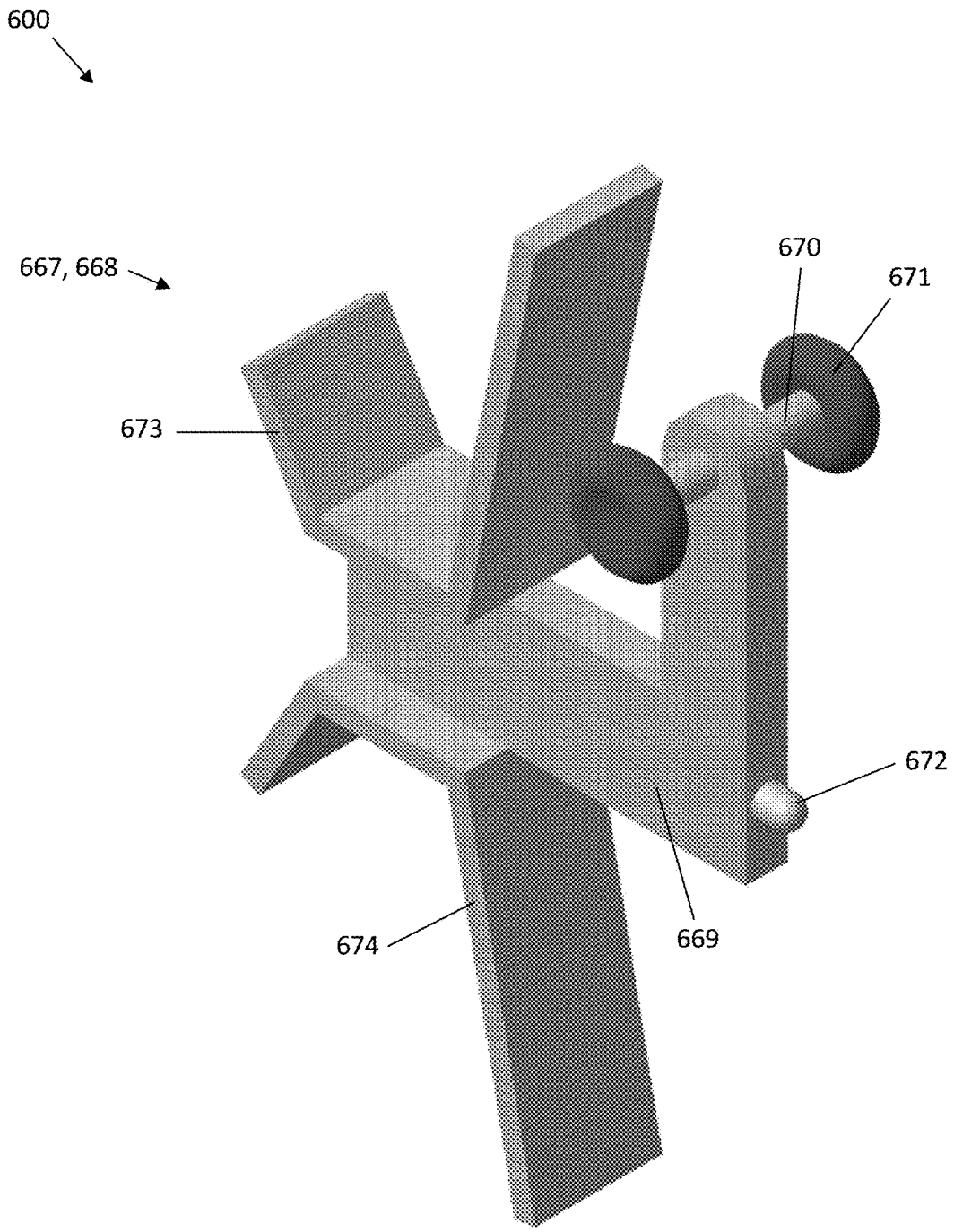
FIG. 36 depicts an exemplary support structure for use with the FIG. 35 tracks.

Different types of exercise grip(s) 658 may be used with resistance device 661. As shown in FIGS. 32-35, for example, one or more exercise grips 658 may comprise a pair of palm grips, one for each cable 659, allowing the user to exercise each side of their body (e.g., each arm) at different times. As shown in FIG. 35, for example, one or more exercise grips 658 may comprise a bar and each cable 659 may be attached to each side of the bar, allowing the user to exercise both sides of their body (e.g., each leg) at the same time. Either way, because they are extendable, cable guides 660 may operable one or more exercise grips to provide the user with an opportunity to adjust their centre of gravity relative to their pulling force and/or the resistance force applied by resistance device 661, allowing for different types of eccentric loading. Equipment support 655 may thus be operable with exercise grip(s) 658 to allow the user to perform a plurality of different types of exercises. As shown in FIGS. 35 and 36, for example, equipment support 655 may comprise a track 665, a track 666, a support structure 667, and a support structure 668.

Tracks 665, 666 may be rigidly attached to frame 601 and structurally support therewith. As shown in FIGS. 31, 34, and 37-40, for example, a rear face of track 665 may be mounted to a front side of post 605 and a rear side of track may be mounted to a front side of post 606. As shown in FIGS. 35 and 36, for example, each track 665, 666 may comprise a tube (e.g., like tubes 110, 114 described above) with an elongated opening extending through its front face in a generally vertical direction and plurality of holes extending through its rear face in a generally horizontal direction. Support structures 667, 668 may comprise quick-release mechanisms that are slidable inside of tracks 665, 666 and removeable attachable thereto at different equipment support heights. As shown in FIG. 36, for example, each of support structure 667 and support structure 668 may comprise an L-shaped body 669, an axle 670, wheels 671, a protrusion 672, a J-hook 673, and a J-hook 674. First and support structures 667, 668 may be manually moveable in the generally vertical direction to locate exercise grip(s) 658 at the plurality of different equipment support heights. As shown in FIG. 36, for example, axle 670 may be located on a vertical portion of L-shaped body 669 and one wheel 671 may be located on each side thereof and sized to interact with interior surfaces of track 665 or 665 when corresponding structure 667 or 668 is moved vertically.

As shown in FIGS. 35 and 36, for example, the vertical portion of L-shaped body 669 may be located inside of each track 665, 666 along with axle 670, wheels 671, and protrusion 672 so that a horizontal portion of L-shaped body 669 may extend outwardly through the elongated opening of each track 665, 666. A vertical position of each support structure 667 and 668 may be maintained by locating its protrusion 672 in one of the plurality of holes extending through the rear face of track 665 and 666. By way of example, each L-shaped body 669 may be moved between different equipment support heights by rotating body 669 in a first direction away from track 665 or 666, moving body 669 upwards or downwards to the desired equipment support height, and rotating body in a second direction toward track 665 or 666 to locate protrusion 672 in one of said holes.

Each protrusion 672 may be made of a metallic material having a shear strength suitable for support a weight of the user and any resistance forces applied by resistance device 661. By way of example, because of protrusions 672, J-hooks 673, 674 may be operable as a traditional pull-up bar, to support a traditional exercise bar (e.g., one not attached to cables 659), and/or to support traditional bar bells. Because of resistance device 661, exercise grip(s) 658 (e.g., the depicted bar) may be operable with resistance device 661 like a Smith machine, allowing the user to utilize whatever forms of exercise they deem appropriate.

Figure 37:
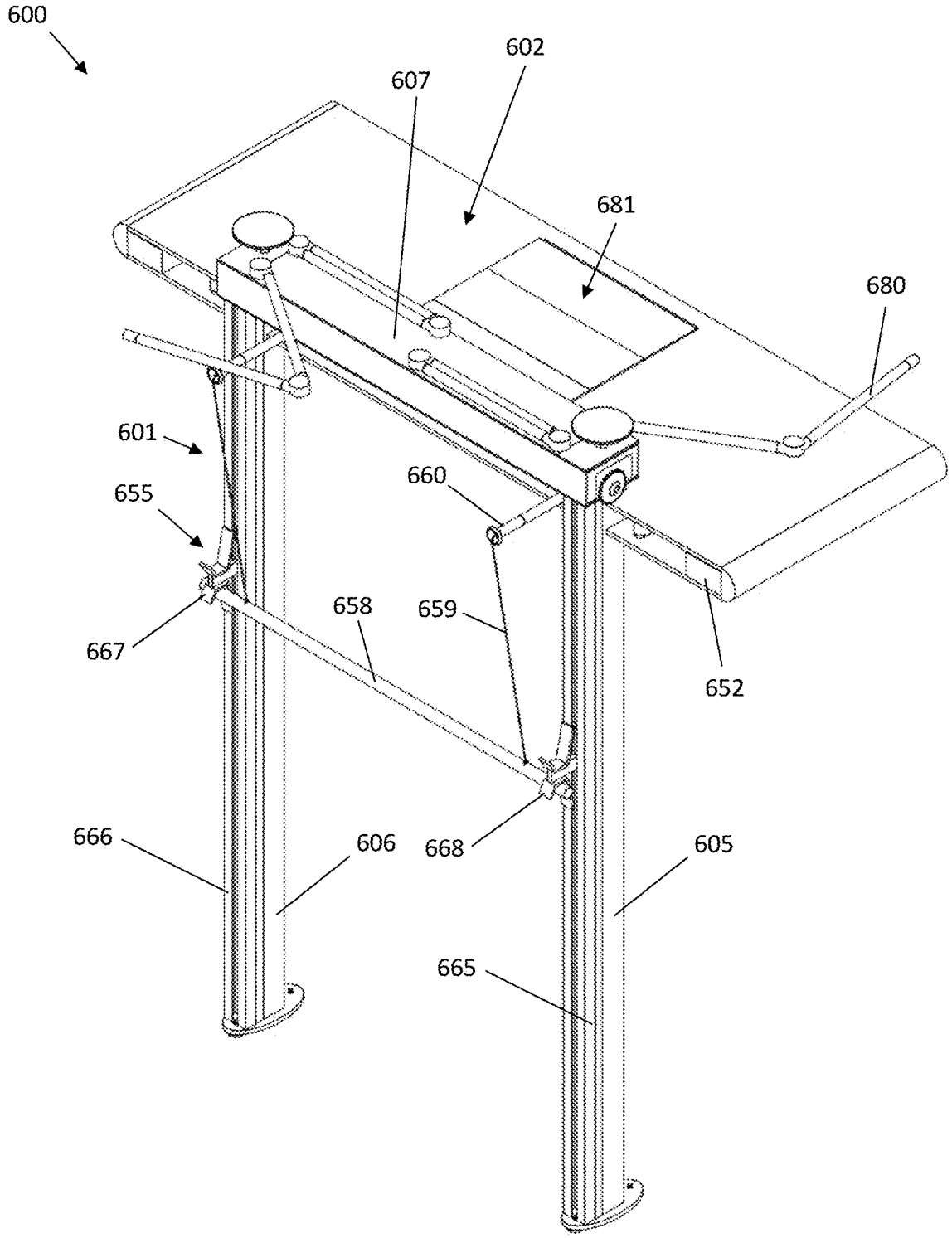
FIG. 37 depicts the FIG. 31 workstation with the work surface at a ceiling height, the equipment support at a standing height, and an exemplary set of cable guides in an extended position.
Figure 38:
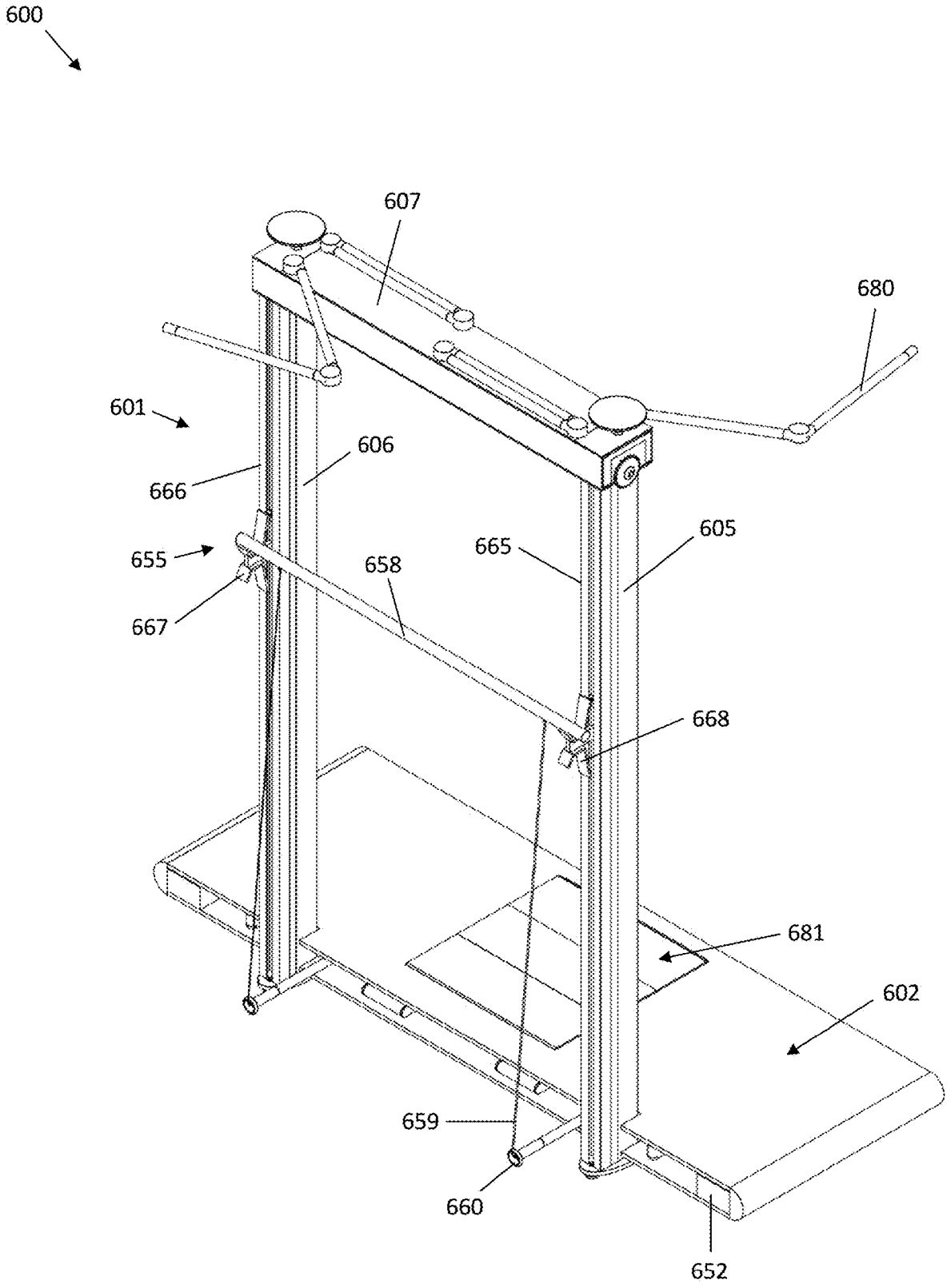
FIG. 38 depicts the FIG. 31 workstation with the work surface at a floor height, the equipment support at a standing height, and an exemplary set of cable guides in an extended position.
Figure 39:
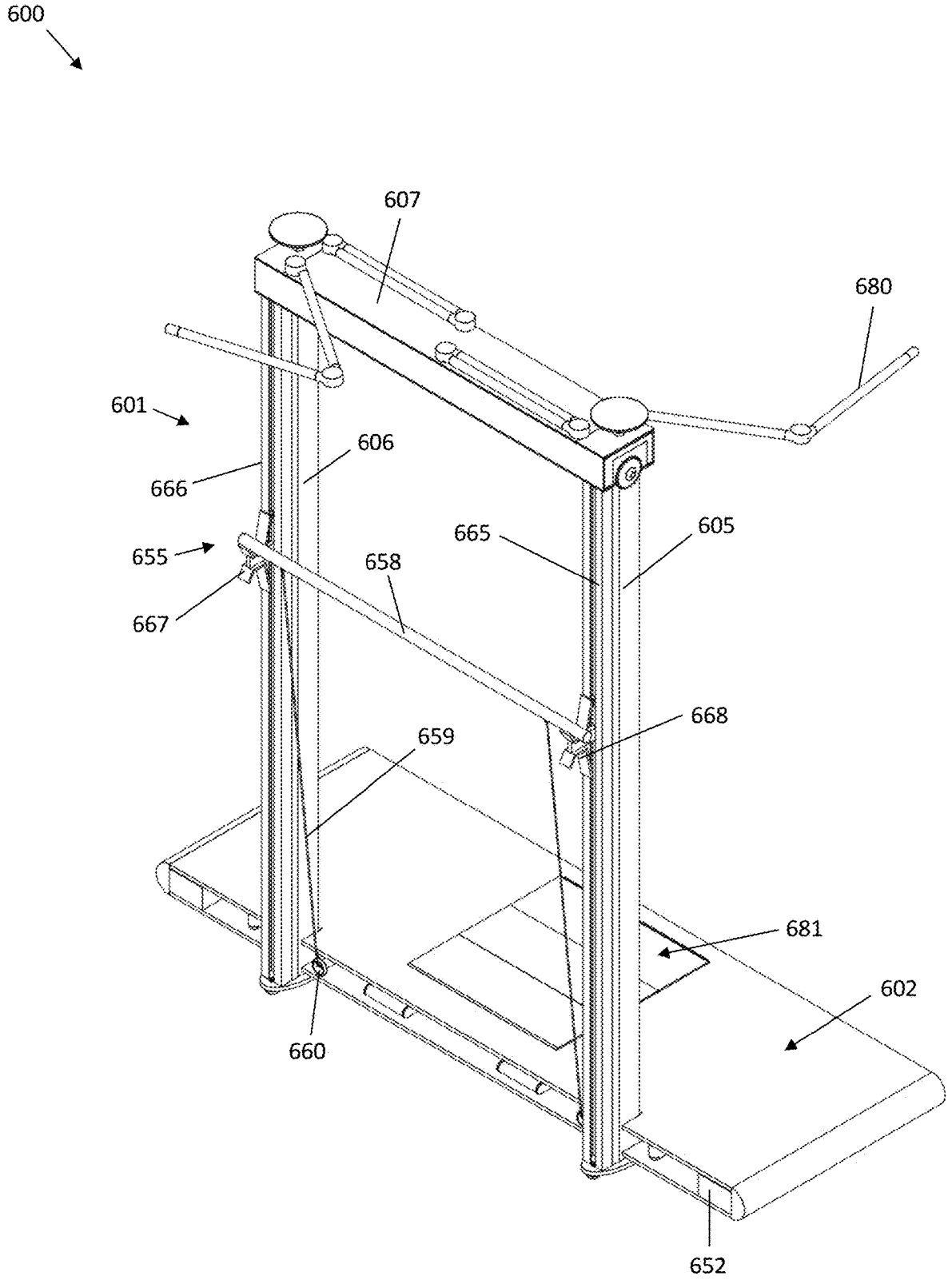
FIG. 39 depicts the FIG. 31 workstation with the work surface at a floor height, the equipment support at a standing height, and an exemplary set of cable guides in a retracted position.

Each J-hook 673, 674 may comprise a pair catchment arms facing in opposite directions, one up and down, so that equipment support 655 may be used to resist upward tensile forces applied to exercise grip(s) 658 by cable 659 when work surface 602 is moved to an elevated position (e.g., as shown in FIG. 37) or downward tensile forces applied to grip(s) 658 by cable 659 when work surface 602 is moved to a lowered position (e.g., as shown in FIG. 38). Although depicted as open in FIG. 36, the catchment arms of J-hooks 673, 674 may comprise a clamping mechanism (e.g., a vise-like structure) operable to secure exercise grip(s) 658 (e.g., the bar) support structures 667, 668 and/or prevent grip(s) 658 from rotating relative to frame 601 so that interactions between support structures 667, 668 and tracks 665, 666 may be used to guide and control vertical movements of exercise grip(s) 658. In this example, when clamped into J-hooks 673, 674, exercise grips(s) 658 may be constrained horizontally by interactions between side surfaces of L-shaped bodies 669 and interior surfaces of the elongated openings extending through tracks 665, 666; allowed to move freely in vertical directions by forces that prevent protrusions 672 from engaging any of the plurality holes extending through the rear face of tracks 665, 666 (e.g., by tilting it during a lift); and guided vertically by interactions between wheels 671 and interior surfaces of tracks 665, 666.

Aspects of support structures 667, 668 may thus be operable aspects of tracks 665, 666, frame 601, work surface 602, and/or exercise grip(s) 658 to enable different types of exercises. One exemplary exercise is a straight bar pushdown for working the triceps. As shown in FIG. 37, for example, work surface 602 may be moved to the ceiling height position (e.g., by operation of an actuator like actuators 103, 203 described above), cable guides 660 may be extended into the working position, and exercise grip 658 (e.g., shown as a bar) may be attached to cables 659 and engaged with J-hook 674 so that the user may perform straight bar pushdowns by pressing grip 658 downwards with an sufficient amount of force for overcoming the resistance force applied to cables 659 by resistance device 661.

Another exemplary exercise is a squat for working the legs. As shown in FIG. 38, for example, work surface 602 may be moved to the floor height position (e.g., by operation of an actuator like actuators 103, 203 described above), cable guides 660 may remain extended in the working position, and exercise grip(s) 658 (e.g., the bar) may be attached to cables 659 and engaged with J-hook 673 so that the user may perform squats by stepping under exercise grip 658, placing it against their back, and pressing grip 658 upwards an sufficient amount of force for overcoming the resistance force applied to cables 659 by resistance device 661. In this example, as described above, it may be desirable to clamp exercise grip(s) 658 onto J-hooks 673, 674 to constrain grip(s) 658 horizontally and/or vertically when performing squats, like a Smith machine.

Another exemplary exercise is an overhead press for working the shoulders. As shown in FIG. 38, for example, work surface 602 may remain the floor height position (e.g., by operation of an actuator like actuators 103, 203 described above), cable guides 660 may be moved toward work surface 602, and exercise grip 658 (e.g., the bar) may be attached to cables 659 and engaged with J-hook 673 so that the user may perform overhead presses by stepping under exercise grip 658 and pressing grip 658 upwards and away from frame 601 with an sufficient amount of force for overcoming the resistance force applied to cables 659 by resistance device 661. Here again, it may be desirable to clamp exercise grip(s) 658 onto J-hooks 673, 674 to constrain grip(s) 658 horizontally and/or vertically, like a Smith machine.

Each of these exemplary exercise and many others may be performed adjusting one or all of the vertical position of work surface 602 relative to frame 601, the vertical position of support structures 667 and 668, the position of cable guides 660 relative to work surface 602, and/or the type of exercise grip(s) 658. If resistance device 661 comprises an electric motor, then aspects of the resistance force applied therewith may be modified responsive to the user, such as by increasing or decreasing the resistance force applied by resistance system 661 during the exercise, such as during the positive and/or negative portions of any such exercises. Altogether, the adjustability of these and other elements workstation 600 make it an exceptionally versatile product suitable for use as both a home office and home gym.

To further increase its versatility, workstation 600 also may comprise one or more mounting arms 680 and/or a retractable computer system 681.

As shown in FIGS. 31 and 32, for example, each mounting arms 680 may comprise an adjustable support arm that is rotatably mounted to header 607, extendable therefrom, and operable to support a piece of electronic equipment from frame 601. Each mounting arm 680 may comprise multiple links, including hinges and related structures, making arms 680 foldable outwardly from frame 601 as shown in FIG. 31, extendable from one of tubes 657, and/or otherwise movably attached to frame 601. Different pieces of electronic equipment may be supported by each arm 680. By way of example, each mounting arm 680 may be operable to support a camera, a light, a microphone, a monitor, a motion sensor, a script prompter, and/or any other piece of equipment that is operable (e.g., with computer 4, controller 261 or 361, retractable computer system 681, and the like) to support a particular activity or exercise that is performable with workstation 600. As described herein, mounting arms 680 may increase the versatility of workstation 600 may making it convertible between a home studio for content producers, a home office for remote workers, and/or a home gym with similar capabilities for content production and online coaching.

Figure 10:
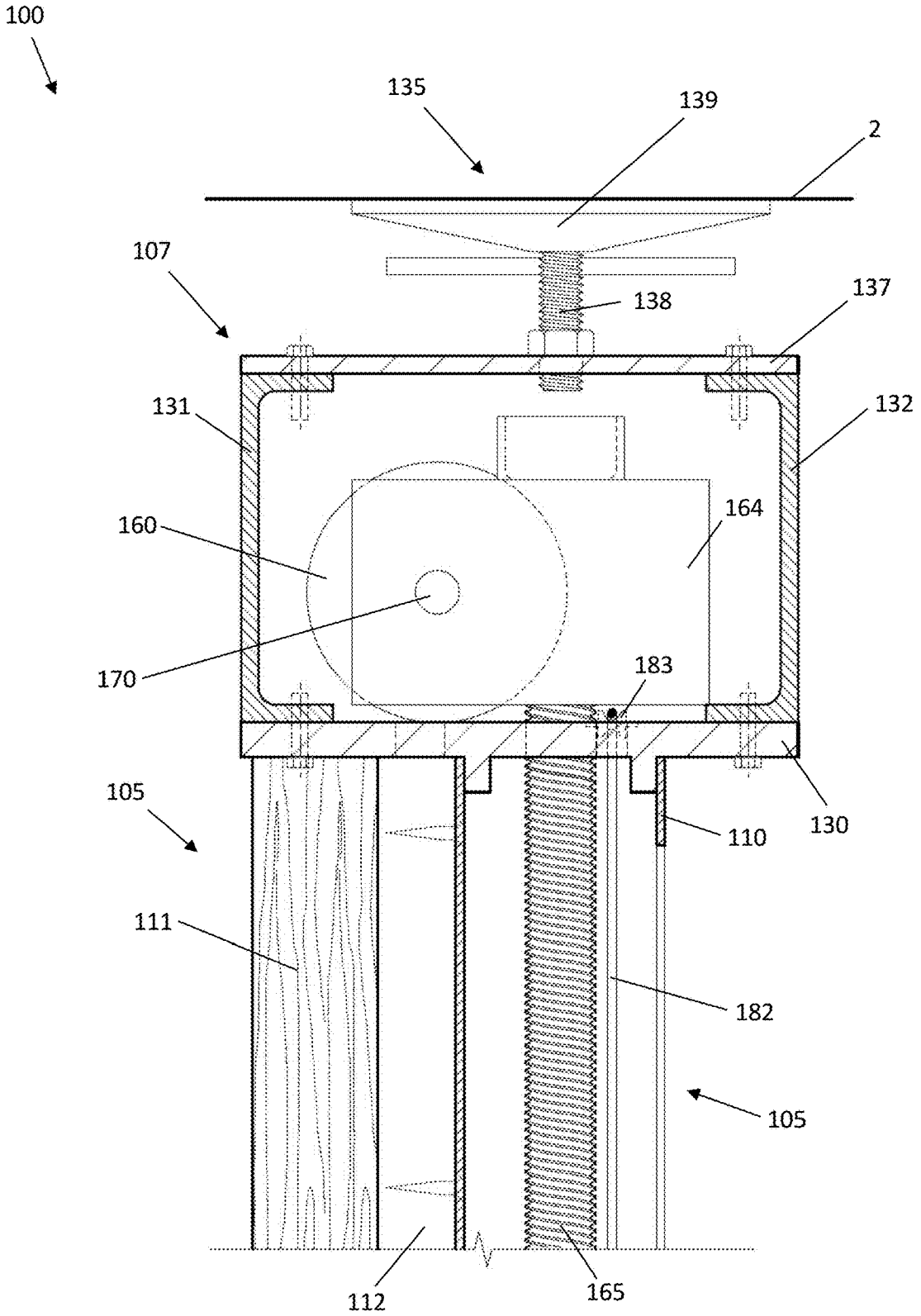
FIG. 10 depicts another profile section view of the FIG. 7 post.

As shown in FIG. 31, for example, header 607 may comprise a jack screw located above post 605 at one end of header 607 and a jack screw located above post 606 at an opposite end of header 607, each of which may be like jack screws 135, 136 described above and thus similarly operable to adjust the vertical location and orientation of frame 601 relative to a ceiling 2 (e.g., FIG. 10). In this example, the jack screw above post 605 may comprise a ceiling contact plate 639, the jack screw above post 606 may comprise a ceiling contact plate 642, each mounting arm 680 may be located in a space between header 607 and plates 639, 642 so that is moveable relative to frame 601 when attached to ceiling 2 by operation of the jack screws.

Figure 40:
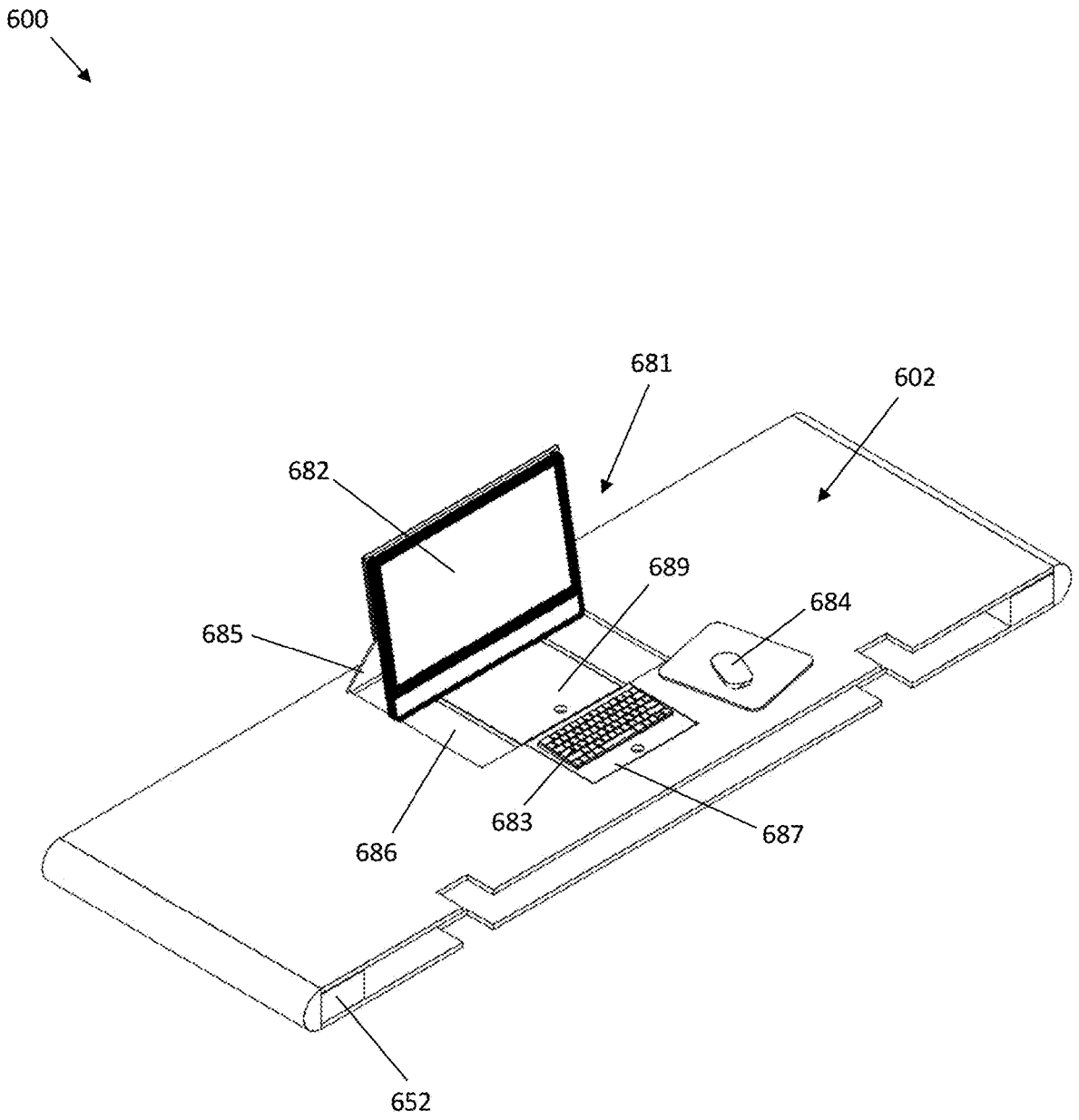
FIG. 40 depicts an exemplary work surface with a retractable computer.
Figure 41:
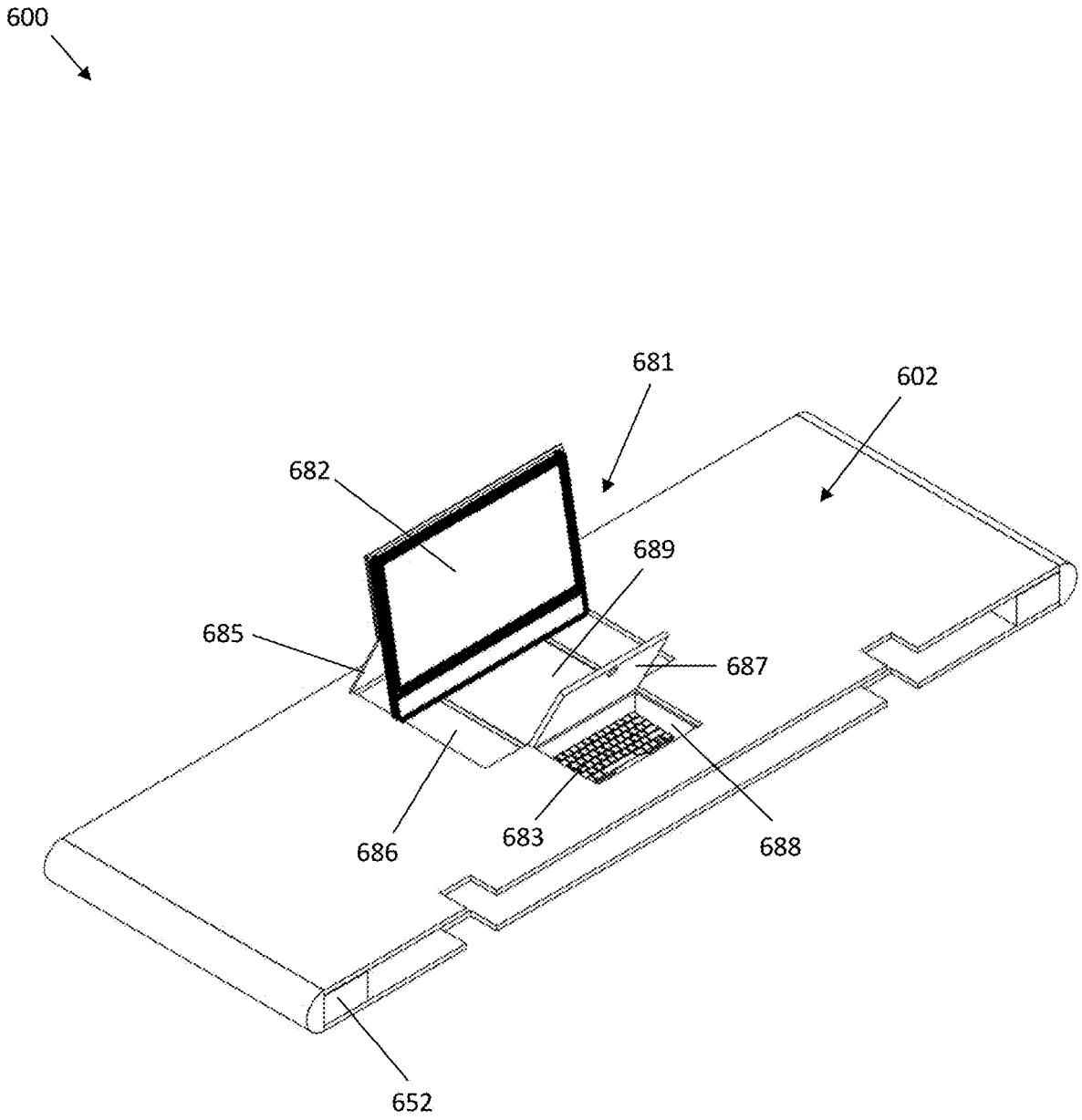
FIG. 41 depicts the FIG. 40 work surface in which the computer is partially retracted.
Figure 42:
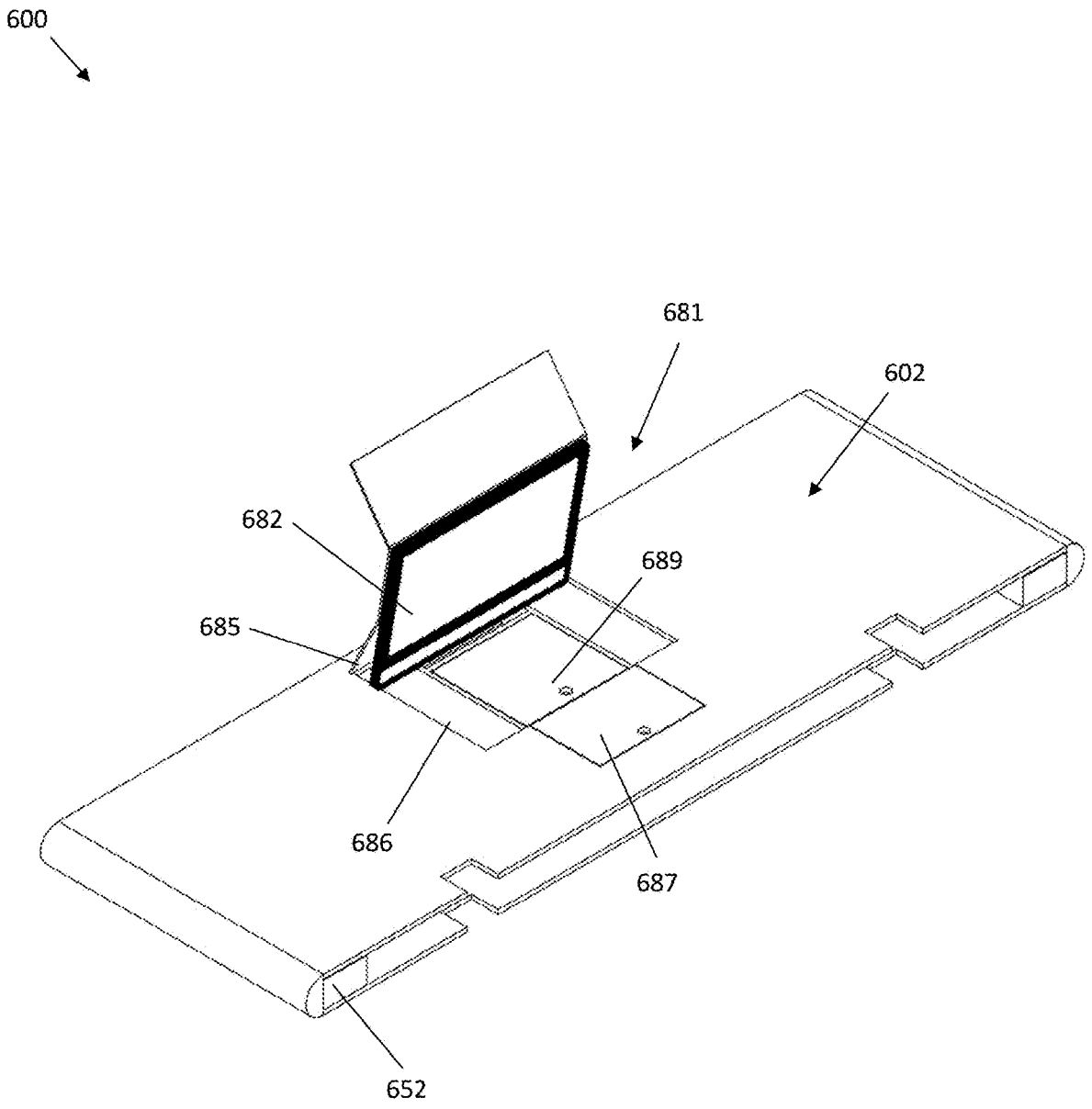
FIG. 42 depicts the FIG. 40 work surface in which the computer is partially retracted.

Retractable computer system 681 may be folded into and out of work surface 602, manually or automatically. As shown in FIGS. 40, 41, 42, and/or 43, for example, retractable computer system 681 may comprise a monitor 682, a keyboard 683, and a mouse 684 like those of an Apple® iMac® or similar device; and work surface 602 may comprise a monitor stand 685, a monitor cavity 686, a keyboard mount 687, and a keyboard cavity 688. Monitor stand 685 may support monitor 682 when retractable computer system 681 is in a working position and double as a cover for retractable computer system 681 when not in use. As shown in FIGS. 40, 41, 42, and/or 43, for example, monitor stand 685 may comprise a first panel that is rotatably attached to an edge of monitor cavity 686 (e.g., with a mechanical hinge); a second panel that is mounted to a back of monitor 682, rotatably attached to an edge of the first panel (e.g., with a living hinge), and rotatably attached to an edge of a third panel (e.g., with another living hinge). By way of example, monitor stand 685 may comprise a leather desk blotter and each living hinge may comprise a crease formed therein so that aspects of system 681 may be easily contained thereunder.

Figure 43:
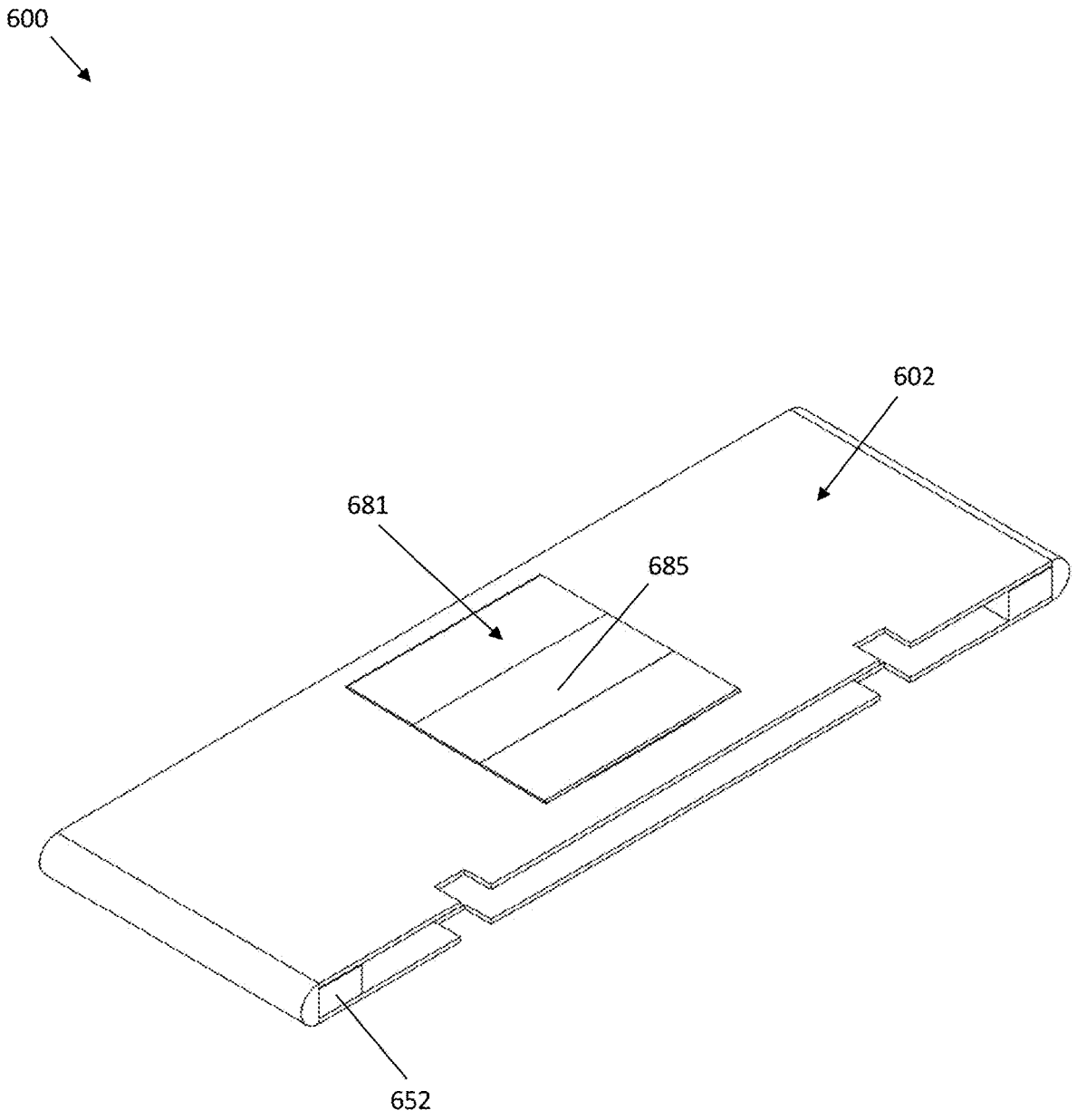
FIG. 43 depicts the FIG. 40 work surface in which the computer is fully retracted.

As shown in FIG. 40, for example, when retractable computer system 681 is in the working position, a bottom edge of monitor 682 may be located inside of monitor cavity 686 and supported by the first panel of monitor stand 685, allowing monitor 682 to be propped up with said first panel; and the third panel may be folded backwardly over the second panel so that a front of monitor 682 is visible. Keyboard mount 687 may comprise a cover for keyboard cavity 688, which may extend into an interior portion of work surface 602 located between an interior two of tubes 657. As shown in FIG. 40, for example, when retractable computer system 681 is in a working position, keyboard 683 may be placed on top of keyboard mount 687, a top of which may be flush with a top of work surface 602 when covering keyboard cavity 688 (e.g., FIG. 41). Mouse 684 may rest on work surface 602. As shown in FIGS. 41 and 42, for example, an edge of keyboard mount 687 may attached to an edge of keyboard cavity 688 with a hinge so that cavity 688 may be opened to receive keyboard 683 therein. As shown in FIG. 42, for example, monitor cavity 686 may comprise a peripheral storage cavity 689 for mouse 684, which may be similarly opened to receive it. As shown in FIGS. 42 and 43, for example, monitor 682 may be received in monitor cavity 686 by lifting it upward, moving its bottom edge toward the hinge of monitor stand 685, and folding it into monitor cavity 686 on top of peripheral storage cavity 689. As shown in FIG. 43, for example, the third panel of monitor stand 685 may be folded over keyboard mount 687 so that the entirety of retractable computer system 681 may be covered therewith.

As shown in FIGS. 31 and/or 43, for example, it may be desirable to move retractable computer system 681 into a stored position when moving work surface 602 to the ceiling height to avoid any conflicts between monitor 682 and ceiling 2, further increasing the versatility of workstation 600 by allowing computer system 681 to be moved out of sight when not in use.

The structural strength of frame 601 may allow for additional structures to be attached to, supported by, and moved vertically with work surface 602. As shown in FIGS. 32 and 33, for example, to increase the versatility of workstation 600, internal frame 652 also may comprise side supports 690 comprise shafts that are insertable through an outer set of holes extending through side 656 and into lumens of an outer set of tubes 657. Each side support 690, much like moveable grips 653 and cable guides 660, may thus be selectively moveable relative to internal frame 652 in a generally horizontal direction between an extended position, where they can be used to support weight; and a retracted position, where they are hidden under work surface 602. As shown in FIGS. 32 and 33, for example, each side support 690 may be extendable from work surface 602 and operable to support a weight of the user during particular exercise, such as dips or pull-ups, much like support grips 135 and moveable grips 653.

Figure 44:
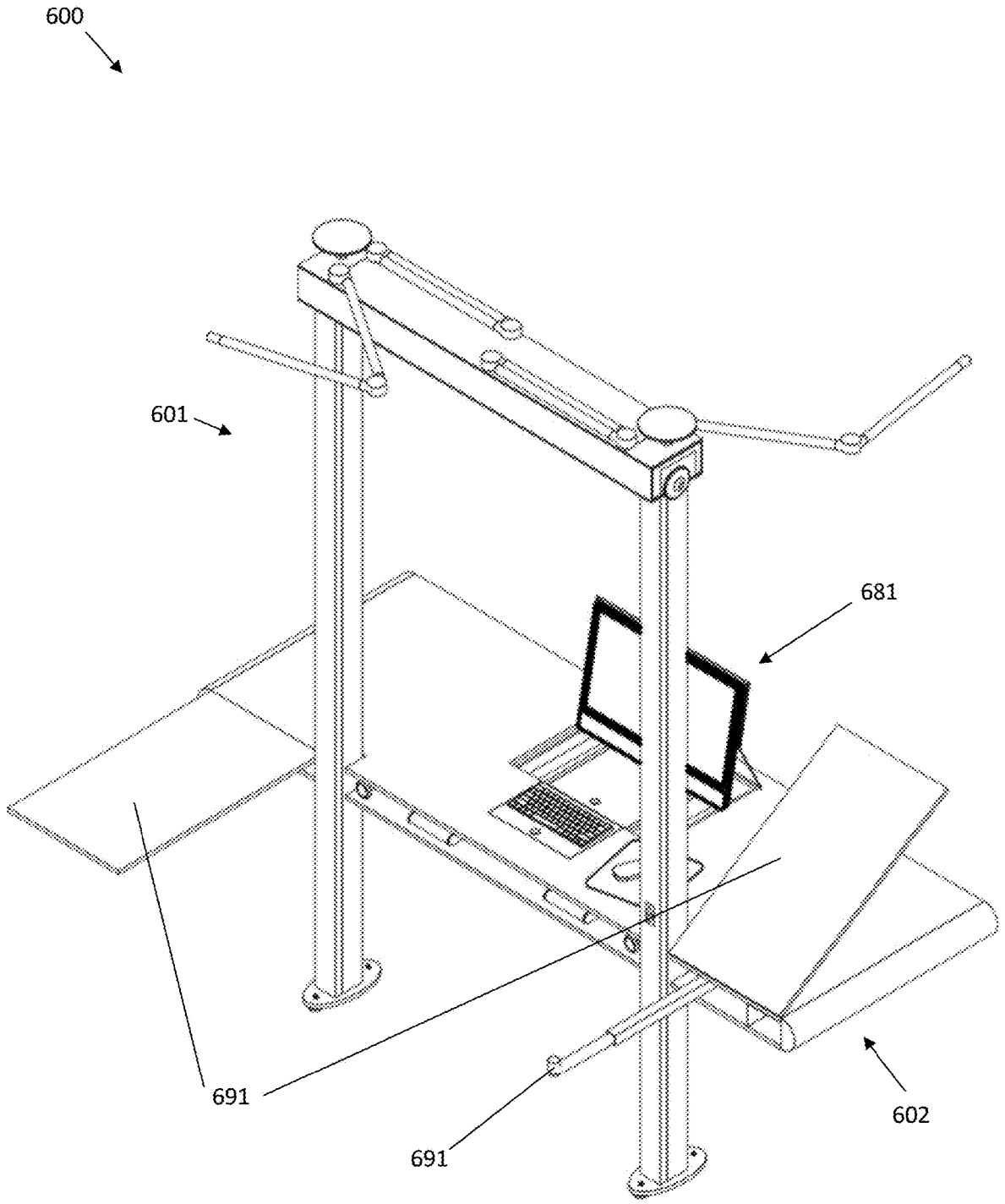
FIG. 44 depicts the FIG. 31 workstation with optional side tables.

The shape and/or size of work surface 602 may be changed to accommodate different uses. As shown in FIG. 44, each side support 690 may be extended from work surface 602 and operable to support a side table 691. A pair of side supports 690 and side tables 691 are depicted in FIG. 44. Each side table 691 may be removably attachable to work surface 602 and/or operatively attached to work surface 602. As shown in FIG. 44, each side support 690 may be stored in a cavity of work surface 602 when not in use. Should need arise, then each side support 690 may be moved into the extended position so that each side table 691 may be at least partially removed from its cavity into a working position where it is supported by one of side supports 690. As shown in FIG. 44, each side table 691 also may be attached to work support 602 with hinges and folded back over work surface 602 and/or into recess thereof when not in use.

While principles of the present disclosure are described herein with reference to illustrative aspects for particular applications, the disclosure is not limited thereto. Those having ordinary skill in the art and access to this disclosure will recognize additional modifications, applications, aspects, and substitution of equivalents all fall in the scope of the described aspects. Accordingly, the present disclosure is not to be considered as limited by the foregoing description.

The invention claimed is:

1. An apparatus comprising:

a frame having a length;

a work surface that is movably attached to the frame and selectively positionable at a plurality of different work surface heights along a substantial portion of the length of the frame configured to correspond to a standing height, a seated height and a floor height; and a resistance training system that is located within the work surface and comprises:

an exercise grip that is selectively movable together with the work surface in a generally vertical direction along the length of the frame, and independent of the work surface in a generally horizontal direction between a plurality of different grip positions including a working position where the exercise grip is configured to be pulled in a direction away from the work surface and a stored position where the exercise grip is adjacent the work surface;

an electric motor that is located within the work surface and operable to apply a resistance force to the exercise grip when moved away from the work surface; and a cable that is operatively attached to exercise grip and the electric motor, and configured to transfer the resistance force therebetween.

2. The apparatus of claim 1, wherein the frame is expandable in the generally vertical direction such that it is configured to obtain a press fit between a ceiling and a floor.

3. The apparatus of claim 2, wherein the frame comprises posts that are independently expandable in the generally vertical direction.

4. The apparatus of claim 3, wherein the frame comprises posts, further comprising a lift system in the posts that is operable with the actuator and the posts to cause vertical movements of the work surface within the range of movement and stabilize the work surface during the vertical movements of the work surface.

5. The apparatus of claim 4, wherein the lift system comprises a threaded rod that is rotatably mounted and vertically fixed in a first post of the posts.

6. The apparatus of claim 5, wherein the lift system comprises a first actuator member in the first post that is operably attached to the threaded rod and the work surface so that rotation of the threaded rod causes the vertical movements of the work surface.

7. The apparatus of claim 6, wherein:

the work surface comprises an internal frame that is attachable to the frame; and the electric motor is rigidly attached to the internal frame.

8. The apparatus of claim 7, wherein:

the electronic motor comprises a spool;

the spool is operatively attached to the cable; and the electronic motor applies the resistance force by rotating the spool.

9. The apparatus of claim 8, wherein:

the internal frame comprises a tube defining a lumen; and the cable is routed from the spool and through the lumen.

10. The apparatus of claim 9, comprising a cable guide defining a cable guide lumen, wherein:

the cable guide is slidably mounted in the tube;

the cable is routed through the cable guide lumen; and the cable guide is slidable between a first position where the cable exits the cable guide lumen at a first location spaced apart from the internal frame and a second position where the cable exits the cable guide lumen at a second location adjacent the frame.

11. The apparatus of claim 10, comprising:

a track that is attached to the frame;

a support structure that is moveably attachable to the track and operable to maintain a vertical position of the exercise grip by countering the resistance force, wherein:

the track comprises a front surface comprising an elongated opening and a rear surface comprising a plurality of holes; and the support structure comprises a hook portion extending through the elongated opening and a protrusion that is receivable in one hole of the plurality of holes and operable to resist counter the resistance force when received in the one hole.

12. The apparatus of claim 11, wherein:

the support structure comprises an L-shaped body with a vertical leg, a horizontal leg, and wheels on the vertical leg; and the hook portion is located on the horizontal leg.

13. The apparatus of claim 12, wherein the hook portion comprises one or both of:

a first J-hook that opens upwardly away from the horizontal leg and is operable to counter the resistance force when the work surface is positioned below the hook portion; and a second J-hook that opens downwardly away from the horizontal leg and is operable to counter the resistance force when the work surface is positioned above the hook portion.

14. The apparatus of claim 13, wherein one or both of the first J-hook and the second J-hook comprise a clamping mechanism operable to secure the exercise grip to the support structure.

15. The apparatus of claim 2, comprising an actuator that is attachable to and operable with the frame to move the work surface within a range of movement including the plurality of different work surface heights while maintaining an orientation of the work surface relative to the frame.

* * * * *